US007913629B2

(12) United States Patent
Gordon

(10) Patent No.: US 7,913,629 B2
(45) Date of Patent: Mar. 29, 2011

(54) COLLAPSIBLE PALLET SYSTEM AND METHODS

(76) Inventor: Norman H. Gordon, Munster, IN (US)

( * ) Notice: Subject to any disclaimer, the term of this patent is extended or adjusted under 35 U.S.C. 154(b) by 525 days.

(21) Appl. No.: 11/118,904

(22) Filed: Apr. 29, 2005

(65) Prior Publication Data

US 2005/0241549 A1 Nov. 3, 2005

Related U.S. Application Data

(60) Provisional application No. 60/566,256, filed on Apr. 29, 2004, provisional application No. 60/632,554, filed on Dec. 1, 2004, provisional application No. 60/652,871, filed on Feb. 15, 2005.

(51) Int. Cl.
*B65D 19/00* (2006.01)

(52) U.S. Cl. ..... 108/51.3

(58) Field of Classification Search ..... 108/51.3, 108/51.11, 56.3, 57.29, 54.1
See application file for complete search history.

(56) References Cited

U.S. PATENT DOCUMENTS

| | | | | | |
|---|---|---|---|---|---|
| 2,444,183 | A * | 6/1948 | Cahners | 108/51.3 |
| 2,611,569 | A * | 9/1952 | Coleman et al. | 108/51.3 |
| 2,904,297 | A * | 9/1959 | Hamilton | 108/51.3 |
| 3,216,376 | A * | 11/1965 | Anderson et al. | 108/51.3 |
| 3,434,435 | A * | 3/1969 | Achermann et. al. | 108/51.3 |
| 3,626,860 | A * | 12/1971 | Blatt | 108/51.3 |
| 4,095,769 | A * | 6/1978 | Fengels | 248/346.02 |
| 4,303,020 | A * | 12/1981 | Houle | 108/51.3 |
| 4,694,962 | A * | 9/1987 | Taub | 206/600 |
| 4,759,295 | A * | 7/1988 | Nilsen et al. | 108/51.3 |
| 4,831,938 | A * | 5/1989 | Atterby et al. | 108/51.3 |
| 4,863,024 | A * | 9/1989 | Booth | 206/386 |
| 4,864,940 | A * | 9/1989 | Dunn | 108/51.3 |
| 5,141,109 | A * | 8/1992 | Bergeron, Sr. | 206/599 |
| 5,365,857 | A * | 11/1994 | Kilpatrick et al. | 108/51.3 |
| 5,377,600 | A * | 1/1995 | Speese et al. | 108/51.3 |
| 5,660,119 | A * | 8/1997 | Perkins | 108/51.3 |
| 5,662,048 | A * | 9/1997 | Kralj et al. | 108/56.3 |
| 5,921,187 | A * | 7/1999 | Wang | 108/51.3 |
| 5,996,510 | A * | 12/1999 | Harpman et al. | 108/51.3 |
| 6,357,364 | B1 * | 3/2002 | Maloney et al. | 108/51.3 |
| 6,564,724 | B2 * | 5/2003 | Moberg | 108/51.3 |
| 7,231,879 | B2 * | 6/2007 | Gordon | 108/51.3 |
| 2001/0025589 | A1 * | 10/2001 | Moberg | 108/51.3 |
| 2003/0209171 | A1 * | 11/2003 | Milles | 108/53.1 |

* cited by examiner

*Primary Examiner* — Janet M Wilkens
(74) *Attorney, Agent, or Firm* — Valauskas Corder LLC

(57) ABSTRACT

Collapsible type pallets and related products embodiments of which include a construction wherein support beams can be integrally formed from the sheet material of the pallet itself. The beams can be supported internally by structural inserts. Additionally, the supporting inserts may include braces for added stability and strength. The beams, as well as the platform can be further braced and structurally supported by cross braces, which run generally at right angles to the beams and pass through apertures in the beams themselves and slots in the inserts. In certain embodiments, the cross braces pass underneath and support the underside of the platform to create significant structural advantages to the pallet. Embodiments of the pallet can be easily assembled from components that can be easily and economically stored and transported. Embodiments are light-weight thereby providing savings in assembly, transportation, and storage.

11 Claims, 49 Drawing Sheets

Fig. 20
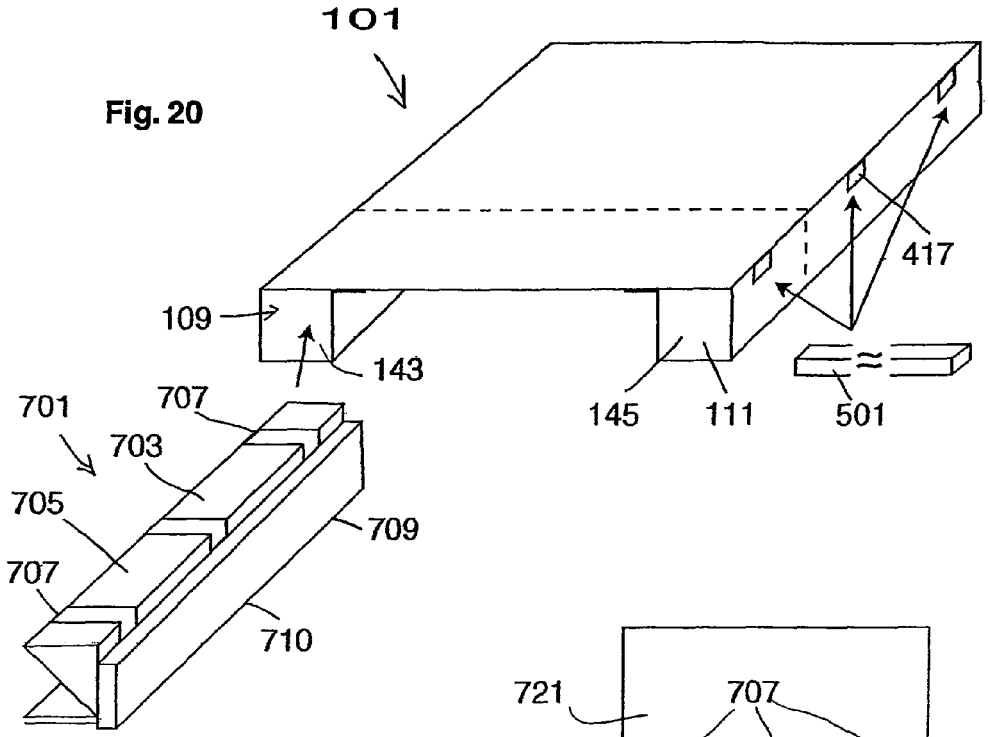
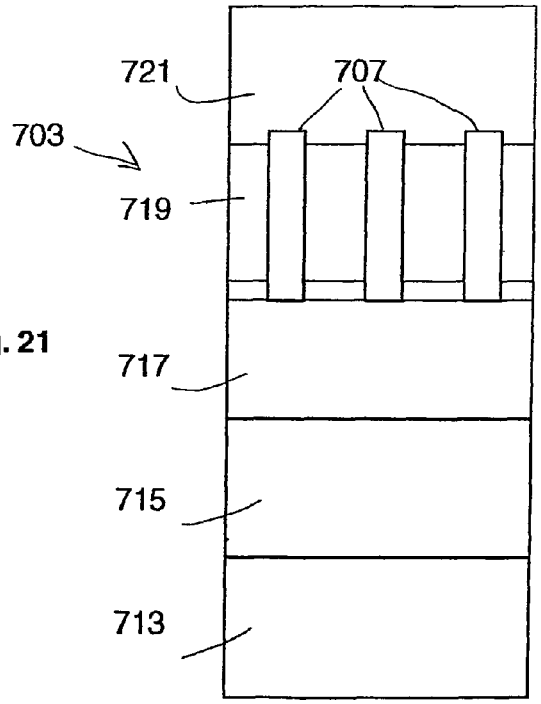
Fig. 21

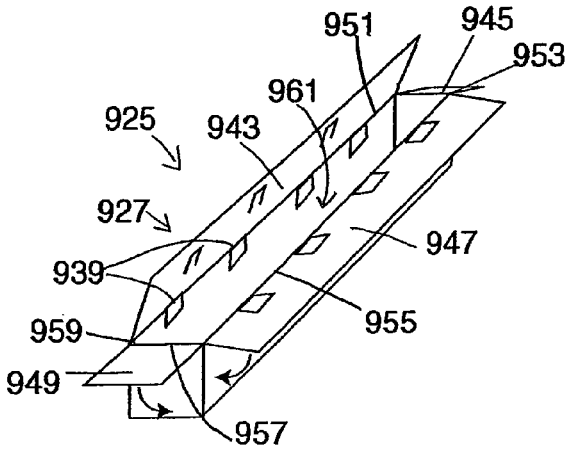
Fig. 33
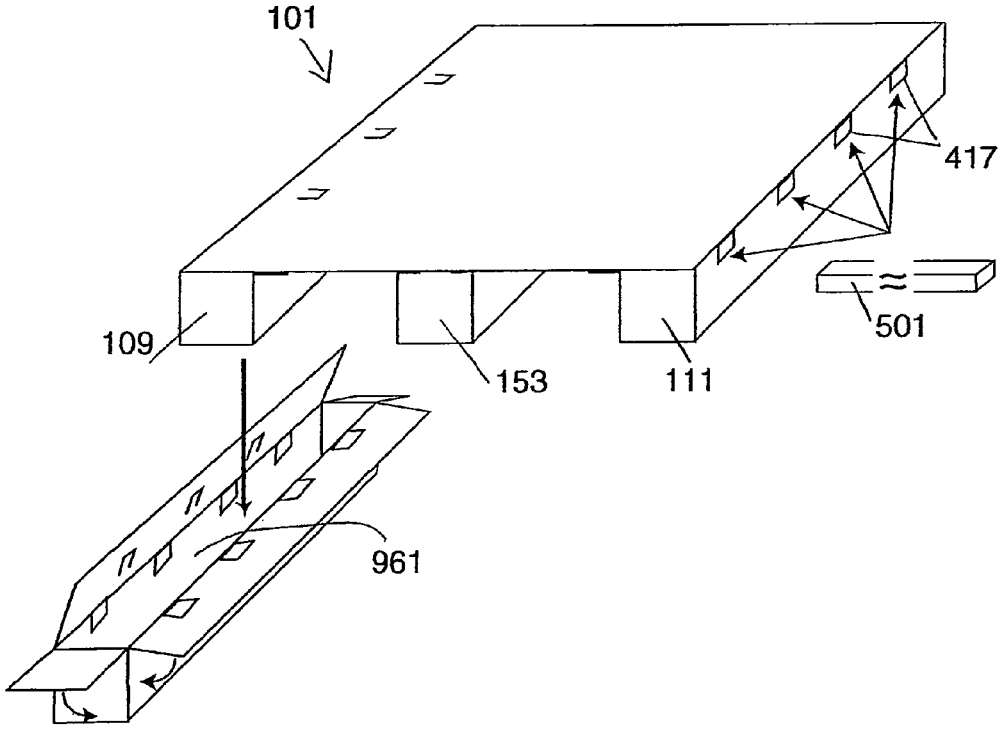

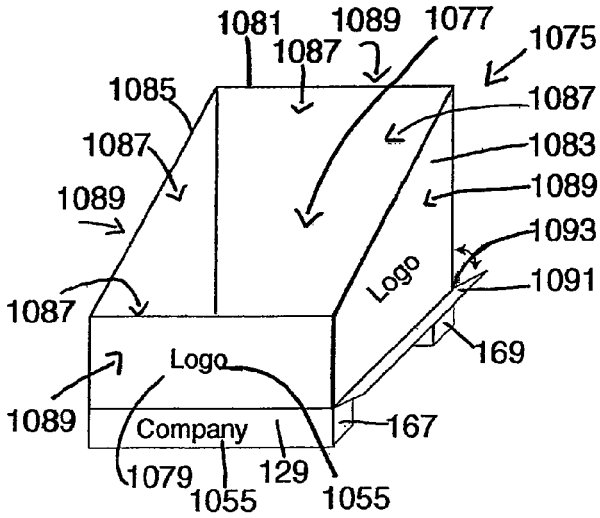
Fig. 42
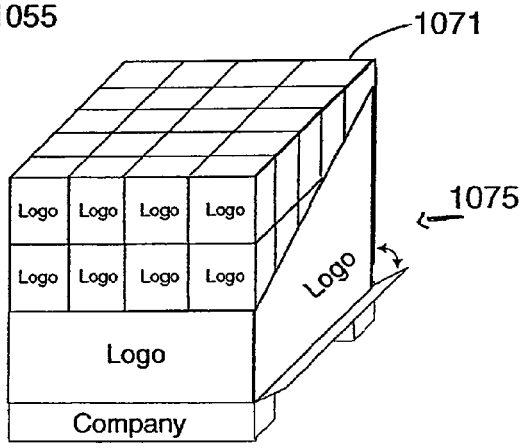
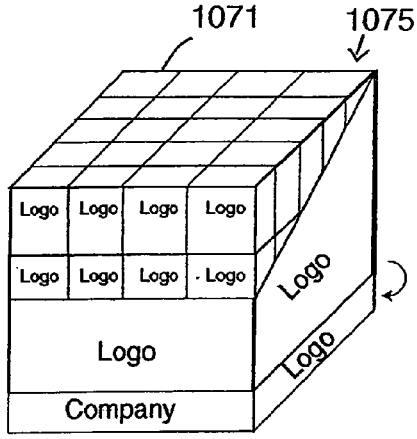

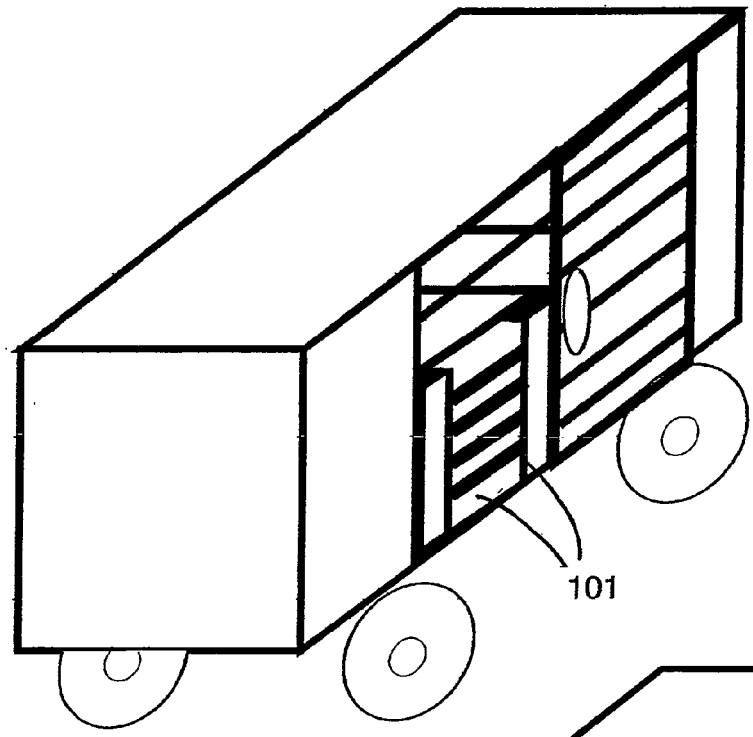
Fig. 51
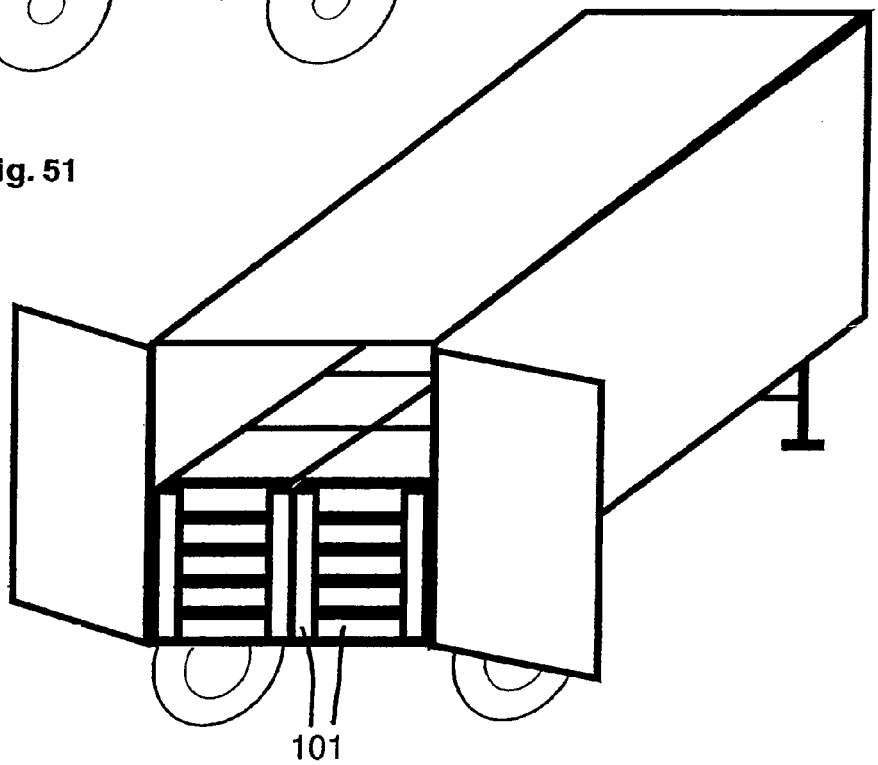

Certification Stamp

COLLAPSIBLE PALLET SYSTEM AND METHODS

This application claims the benefit of U.S. Provisional Application No. 60/566,256 filed Apr. 29, 2004; U.S. Provisional Application No. 60/632,554 filed Dec. 1, 2004; and U.S. Provisional Application No. 60/652,871 filed Feb. 15, 2005.

FIELD OF THE INVENTION

The present invention relates to a collapsible pallet and more specifically to a pallet formed from a sheet material.

BACKGROUND OF THE INVENTION

Pallets are platforms for supporting weight thereon, and by which materials, packages, or goods that are stacked thereon may be handled, stored and/or moved. Goods positioned on pallets are typically moved and stored in warehouses, factories, or vehicles, for example, by forklift equipment, in which the forklift tines are inserted into channels in the pallet or by way of engagement with an undersurface of a top deck of the pallet.

Pallets have traditionally been formed from wood, plastic and various composite materials. Wood pallets, however, are subject to breakage and difficult to obtain and maintain in a sanitary condition. In environments where sanitation is important, such as in the food industry, pallets may be of limited usefulness. From time to time, the wood used in pallets is also known to contain eggs or actual insects thereby causing problematic infestations. Plastic pallets are bulky and initially, may be very expensive. Wood or plastic pallets are typically provided in a fully erected or constructed state and not deconstructed when not in use and therefore always require a maximum amount of space.

A variety of cardboard or pallets that are erectable and collapsible have been suggested. The following discusses some of these.

U.S. Pat. No. 2,944,296 to Hamilton describes a pallet consisting of a plurality of channels which are made from folded cardboard or the like and which include slots through which wooden slats are inserted to create a basic pallet lattice structure. The Hamilton type pallet is made of independent channels that are free floating relative to one another, are not pre-aligned with respect to the distances between each of the channels and do not appear to always be maintainable in parallel. Additionally, when the Hamilton type pallet is in use, the channels may move thereby creating some risk of tipping. Thus, while the Hamilton pallet uses a substantially smaller amount of wood, the complexity of the arrangement creates risks that are not inherent in the conventional nailed pallet design.

U.S. Pat. No. 2,444,183 to Cahners describes a fiber board portable platform which includes the formation of channels from folded cardboard and their interlocked relationship including the use of cross members located within the channels to enhance support. While the fiberboard platform of Cahners does allow for formation out of fiberboard without the need for any nailing, the Cahners' channels are formed in one direction with no support members at right angles thereto other than the flat cardboard surfaces. Thus, if the weight load is shifted onto, for example, two out of three of the channels of this type of fiberboard portable platform, the lifting of the pallet with a forklift may cause the cardboard flat surface to fold and the structural integrity of the platform itself to be permanently damaged.

U.S. Pat. No. 4,378,743 to McFarland describes a paperboard pallet having interlocking runners. However, this pallet is tray-like wherein the runners are inserted into the bottom, i.e., are located above and not below the basic horizontal surface, and are inserted by the use of blocks located at the bottom of the channels. However, as with the prior art described above, the runners are all in a single direction and only the tray cardboard sidewalls provide for structural support at right angles to the runners. Additionally, forklift motion or other motion of the McFarland type pallet may cause the blocks to pop up through the base and therefore destroy the integrity of the structure itself. Additionally, the shifting of weight or movement of the McFarland pallet such that force is applied to the areas of the pallet where there is no significant weight may cause a folding to occur at points parallel to the runners.

U.S. Pat. No. 3,308,772 describes a disposal pallet having basically U-shaped channels formed of sheet material located on the underside, This type of pallet does not allow for significant structural support at right angles to the parallel channel. Additionally, the pallet channels themselves are hollow and subjecting the pallet to weight may cause flattening, and therefore destruction of the basic integrity of the pallet.

U.S. Pat. No. 4,185,565 to Nymoen describes sheet material type pallets having a base with parallel channels on the underside. The Nymoen parallel channels are initially formed by a series of folds from a single under sheet that are interlocked with hollow channels formed at the ends of a second base sheet. The result is a pallet which has channels that are hollow but with closed ends. Both the flattening problems as well as the problems of bending at points between the channels may occur with this type of design.

U.S. Pat. No. 4,091,923 is directed to a combined carton and supporting pallet. This particular design involves a typical cardboard box, and more specifically a synthetic pallet with a base in the flap, the flap being tucked into the folding flaps of the typical box and the base positioned over it. The box as turned over rests on sections or channels, which are attached to the bottom of the base. This particular type of pallet does not teach any structural support at right angles to the runners located on the bottom and is fully functional when it is located in place in a particular carton for which it is designed to fit. In other words, the pallet described in this patent is unique to a particular size carton but yet is not an integral part thereof and must be inserted into the carton. If the pallet of this patent is used without being inserted into a carton, it appears to be even less structurally dependable than the other pallets cited above due to the fact that one of the two top layers is a free floating flap. Also, the lack of structural support—other than the single piece of cardboard which would bind the runners at right angles to the runners—reduces its structural dependability.

U.S. Pat. No. 2,494,730 to Thursby describes palletized containers, which rely upon folded cardboard channels, and inserts. The Thursby containers lack any additional structural support other than cardboard at right angles to the channels.

U.S. Pat. No. 4,863,024 to Booth is directed to a collapsible pallet. The Booth pallet has a base sheet with side edges foldable into U-type runner channels and further folded to form under supports resting under the base sheet. Because of what appears to be the excessively large size of the Booth base sheet, the Booth pallet is difficult to store, manipulate and assemble. For example, an assembled standard 40"×48" pallet would require a Booth base sheet on the order of at least 80", not including the material necessary for forming the channels. Because of the size, the Booth pallet also requires more than one person to assemble the unit plus space large enough to accommodate the Booth pallet materials in order to assemble the pallet. Booth does not describe rackability as a feature. A further disadvantage is the shown type of friction lock, which is easily collapsible due to vibration or movement or heavy weight loads.

While it can be seen that a number of attempts have been made to design inexpensive, but structural dependable pallets, there continues to be a need for improvements in both cost, ease of use, and overall strength. The present invention satisfies this need.

SUMMARY OF THE INVENTION

The present invention is directed to a pallet that is easily assembled by a single person without tools and from easily transported and manipulated components. The components can be varied to easily provide pallets of different size and structural dependability. Each of the components for and the assembled pallet is lightweight and uses less materials than many pallets made from similar materials. This further reduces waste, lowers shipping costs and ultimately fuel consumption costs associated with the transport of the product shipped on the pallets on the issue of fuel consumption. It has been estimated by the Ford Motor and Automotive Aluminum Association that for every 10 percent reduction in vehicle weight there is a corresponding 6 to 8 percent savings decrease in fuel usage. Comparing an embodiment of the pallet of the present invention to a standard 48×40 inch wood pallet, a savings in fuel usage to carry up to 1200 pounds per truck load (i.e., 30 pounds per pallet savings multiplied by 40 pallets per truck) would result. Less weight means decreased fuel usage and therefore fewer atmospheric emissions. Also, since weight is a factor in road and highway damage, the less weight per truck means less road damage and fewer traffic jams due to highway construction.

The modular pallet of the present invention is formed from components that can be shipped and stored in a largely flattened state. As a result, prior to assembly, a pallet according to the present invention takes up little space, thereby reducing transportation and storage costs. After assembly, for example, the pallet may be racked into the size permitted by the components, such as a space occupying 4½"×48"×42".

The materials from which the pallet components may be made can be "environmentally friendly" and therefore present low environmental impact. The pallet of the present invention and its components may be formed or joined without the use of metal staples, nails, or other fasteners. The staples, nails or other fasteners used in constructing conventional pallets are typically environmentally "less friendly". They also may cause harm, such as to a user, when dislodged from the pallet. The use of materials other than wood for the collapsible pallet of the present invention is also economically and environmentally friendly. For example, the use of material other than wood for components of the pallet of the present invention mostly eliminates the need to fumigate the pallet in order to destroy those destructive elements, such as the longhorn beetle that are typically harbored in the wood. In addition, the collapsible pallet of the present invention can be re-used multiple times. Due to the materials used in preferred embodiments of the invention, namely cardboard and like paper-based materials, repairs can be easily made and the present invention contemplates the inclusion of repair kits with the pallets.

The materials from which the components of the pallet may be made may be of a composition, or treated with other materials so that the components and the assembled pallet is generally insect or germ free and water resistant thereby permitting the pallet to be used in a moist or wet environment without perceptible loss in structural dependability. Other embodiments may include components and be structured so that the pallets are fire resistant, heat resistant, anti-static, or respond to additional user transport and storage specifications.

The pallet of the present invention includes tubing elements, either singular or multi positional, for the construction of the platform, either in a permanent or semi-permanent way. The tubing may be sized and shaped to hold a variety of materials on the inside or outside thereof, yet not restrict the ability of the pallet to be assembled or disassembled in a "knock-down" fashion and provide a variety of options for reinforcing the strength and stability of the pallet by adding or subtracting material structure and material strength depending on the load placed on the platform. Heavier loads may require higher yield material while lighter loads may be constructed of lesser yield materials.

Additional advantageous features of the pallet of the present invention are many. The pallet may include informational surfaces that may be used, if desired, for informational purposes such as by being decorated by processes of printing, laminating, stamping, spraying, etc. and can offer benefits such as bar coding, assembly instructions, and advertising. The platform may carry radio frequency friendly identification devices by which information concerning, for example, ownership and use of the platform may be provided. Various parts, sections or components of the pallet may be color coded, for example, for decorative purposes or for informational purposes such as to identify the carrying capacity or special use purpose of the pallet, to identify the owner of the material carried in the pallet, the owner of the pallet, promotional or advertising purposes, or simply to facilitate the construction or deconstruction of the pallet.

Additionally, the material used, in the making of the platform, may also be constructed in such a way that it offers cushioning to help absorb shock vibrations. The platform user may be able to choose if they wish the platform delivered to them in an assembled state for immediate use or in a disassembled state. Because the components of the platform are sized and shaped to fit in a reduced amount of space (relative to the fully assembled pallet) in a disassembled state, shipping and storage costs are reduced. The platform may be made so that it can be erected by hand, hand and machine or machine only. This offers options in the assembly process. The platform, if need be, can be constructed in such ways that it can be moved on conveyors or accept wheels, castors, or another roller type product for movement, or racking systems for storage or display. Multiple points of entry can be provided in pallets of the present invention so that a fork lift truck or hand jack can be used to lift and move the pallet. Components of the pallet can be formed through materials that facilitate reuse or recycling of the components or the material from which the components are made. The platform can be constructed so that additional uses, such as add-on parts, can be added to give the platform added benefits such as display advertising, void filling, and convention type presentation. The platform itself may be saved and recycled to use as a cost saving feature in other inventions.

A summary of some of the advantages and features of the pallet of the present invention is provided.

Additional Advantages/Features

1. Shipped unassembled to save on shipping. Can also be shipped to the customer in an inverted position so that two pallets take the space of one.

2. Modularity makes for adjustability of parts based on size and weight of products.
3. Pallet embodiments may be assembled in less than 2 minutes.
4. No tools required to assemble or seal.
5. Extreme light weight saves freight and gasoline and facilitates handling and assembly.
6. No outside storage needed since reduced space per pallet makes it possible to store many more pallets inside the user's facility.
7. Save time in material handling.
8. A wide variety of people can handle the pallet components and assembled pallet.
9. Takes little room for assembly and therefore can be assembled in confined areas.
10. Assembled pallet is durable at the runner level in order to help prevent fork lift damage. The pallet modular pieces are intended to give, but not break. If one of the internal parts of the tubular compartment is shifted, the reinforcement from other compartment members plus the newly realigned parts, help keep the pallet from collapsing.
11. Embodiments with a flat surface can have with no unfilled spaces eliminates a bottom layer sheet and can be printed for informational usage.
12. Pallet can be designed to make a built in bottom tray or bulk pack system.
13. Expandable and contractible.
14. Rackable.
15. Center runner easily added.
16. Four way entry embodiments among the pallet embodiments.
17. Embodiments can include repair kits useful to repair damaged areas thereby allowing the strength and stability of the unit to be kept intact.
18. Easily disposable and environmentally friendly.
19. Printable surfaces made affordable for logos, bar codes, or instructions.
20. Colored board available to assist in inventory control and display friendly.
21. Anti-static material and elements available.
22. Embodiments can include plastic for out of country shipments. Such embodiments require no fumigating and the plastic pieces can be returnable and are environmentally safe.
23. Corrugated plastic can be used for returnable embodiments. The product is quickly disassembled for minimal costs on return.
24. Wooden slats are returnable.
25. Jig easily made for fast assembly.
26. Pallet embodiments may include components for shock absorption.
27. RFID hologram and certification of structure and numbering system available thereby assisting in tracking such as regarding origin of original shipment. Different sequentially coded numbers on each component tracks possible point of damage or theft-sequential numbering system marries an information code between the pallet and packages used in conjunction with the pallet.
28. Reusable with repair patches.
29. A "two-fer" option—that is, a reusable component may also add strength to the pallet.
30. May include surfaces on which shipping info labels and other warning devices may be carried.
31. Machine assembable.
32. Strapping kits available.

A further object of the present invention is to provide a pallet that includes decorative or esthetic elements such that the pallet may be used in more public venues and not simply the warehouse. Conventional pallets, to the extent they are constructed of cardboard, have corrugated flutes. Embodiments of the present invention eliminate what may be viewed as aesthetically unappealing exposure of corrugated flutes by providing various assembly constructions such that the cross sections of the corrugated cardboard are hidden or secluded from all outside or exposed surfaces. Moreover, it is contemplated the present invention may be assembled of cardboard constructed without corrugated flutes. The singularity of sheet through a printing press means the sheet can be printed and die cut at the same time therefore saving money on many decorative operations.

A further object is to provide a tracking functionality to one or more pallets, for example, through the coordinated use of bar codes, hologram, or RFID tags (tracking devices). A bar code is a series of lines of that can be read by a computer input device, for example, a bar code scanner and provide a wide variety of information. A hologram is a three-dimensional photograph or illustration, created with an optical process that uses lasers. Holograms are difficult to replicate or counterfeit. A RFID tag, or radio frequency identification tag, is a type of electronic identification that uses radio frequency signals to read information. A tracking device may be applied to each component, larger groupings of components, or the fully assembled pallet. The tracking device can communicate a variety of information, for example, certification of the maximum weight the pallet is capable of supporting, origin, and destination of the product associated with a particular pallet along with the location at any given moment in time. It is further contemplated that the tracking device may include other sorts of information such as a customer's logo. The components of the pallet may additionally have designations by which the pallet components may be identified and tracked. Components suitable for reuse may include designations or identifications that assist one or more subsequent purchasers of the use history of that component. A corporate certification stamp backed by insurance, such as is used in the corrugated box industry, can be used to designate manufacturing guarantees such as product transport or storage warranties. In fact, one or more components of the pallet may be certified, such as in printed information including the manufacturer's or shipper's information, identification or logo to make sure that only that business' product is shipped or used with the identified pallet. This is important when quality control certification only applies when the business' given product is carried on the identified pallet. Other features will become apparent in the following description.

While the prior art describes many variations on cardboard type pallets and related products, no apparatus system or method is described wherein a pallet is formed with support beams that are integrally formed from the sheet material base. Embodiments of the present invention can include supporting inserts in the beams as well as cross-braces or slats located against the underside of the base platform itself. The beams as well as the platform are structurally supported by cross-braces, which run at right angles to the beams. They can be angled, positioned, or arranged in different formats depending on the need.

In other words, embodiments of the pallet of the present invention include beams, which are supported internally by structural inserts that may be of varying size and shape. Moreover, the inserts may further include braces that are positioned within the structural inserts to provide additional support. The braces may be of any suitable material, size, and shape to fit within the structural insert.

Embodiments may include cross-braces that pass through an aperture in the beams themselves. The cross-braces may be positioned such that they do not interfere with the structural inserts or braces. Moreover, the structural inserts and braces themselves may include slots through which the cross-braces may pass. The cross-braces may pass underneath and support the underside of the platform to create significant structural support.

A further object of the present invention is to provide a supporting structure, or stabilizer, under the pallet to adequately distribute the load carried on the platform panel of the pallet. The stabilizer can be of any shape or size and constructed from various materials including, wood, plastic, cardboard, fiberboard, rigid foam, fiberglass, carbon-fiber, composite materials and so on, capable of providing support to the platform panel of the pallet.

Multiple pallets may be joined through a variety of simplified embodiments of the pallet including those having interconnecting male and female components that permit the engagement of the male protrusion into a female receptacle, each of which is positioned within the support beams. The male protrusion and female receptacle can be broken down flat along with the entirety of the pallet for ease of shipping and storage described above.

The present invention, in one aspect, is a pallet fabricated of a sheet of material for receiving product, including a platform including a first platform side and a second platform side, the first platform side being opposite the second platform side. A first beam is located along the first platform side on an underside of the platform and a second beam is located along the second platform side on the underside of the platform. An insert is positioned in each of the first beam and the second beam, each of the inserts being constructed and formed of a material capable of withstanding at least the weight of the product bearing thereupon.

Another aspect of the invention provides a pallet for receiving product thereupon, including a platform including a first platform side and a second platform side, the first platform side being opposite the second platform side. A first beam is located along the first platform side on an underside of the platform and a second beam is located along the second platform side on the underside of the platform. A third beam is positioned between the first beam and the second beam and an insert is positioned in each of the first beam, second beam and third beam, each insert being constructed and formed of a material capable of withstanding at least the weight of the product bearing thereupon.

Yet another aspect of the invention provides a pallet for receiving product, including a platform with a first platform side and a second platform side, the first platform side being opposite the second platform side. A first beam is positioned along the first platform side on an underside of the platform. A second beam is positioned along the second platform side on the underside of the platform. A third beam is positioned between the first beam and the second beam. Each of the first beam, the second beam and the third beam includes a plurality of cross-brace beam openings formed therethrough. A plurality of cross-braces are positioned in the cross-brace beam openings to extend from the first platform side to the second platform side and adjacent the underside of the platform to support the platform. An insert is positioned in each of the first beam, second beam and third beam, each insert being constructed and formed of a material capable of withstanding at least weight of the product bearing thereupon.

Yet another aspect of the invention provides a pallet for receiving product, including a platform with a first platform side and a second platform side, the first platform side being opposite the second platform side. A first beam is positioned along the first platform side on an underside of the platform. A second beam positioned along the second platform side on the underside of the platform. A support structure is positioned between the first beam and the second beam, wherein each of the beams includes a plurality of cross-brace beam openings formed therethrough. Cross-braces are positioned in the cross-brace beam openings to extend from the first platform side to the second platform side and adjacent the underside of the platform to support the platform. Inserts in each of the first beam, second beam and third beam, are constructed and formed of a material capable of withstanding at least weight of the product bearing thereupon.

Yet another embodiment of the invention provides a pallet for receiving product, including a platform with a first platform side and a second platform side, the first platform side being opposite the second platform side. A first beam is positioned along the first platform side on an underside of the platform. A second beam is positioned along the second platform side on the underside of the platform. Each of the first beam and the second beam includes a plurality of cross-brace beam openings formed therethrough. Cross-braces are positioned in the cross-brace beam openings to extend from the first platform side to the second platform side and adjacent the underside of the platform to support the platform and an insert is positioned in each of the first beam, second beam and third beam. Each insert is constructed and formed of a material capable of withstanding at least weight of the product bearing thereupon.

Yet another embodiment of the invention provides a pallet system for receiving product, including a pallet with a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam. Each insert is constructed and formed of a material capable of withstanding at least weight of the product bearing thereupon. A hollow, rectangular sleeve is sized and shaped to fit over the pallet.

Yet another embodiment of the invention provides a system for supporting, transporting and/or storing product, including a first pallet with a first pallet platform including a first platform side and a second platform side, the first platform side being opposite the second platform side. A first beam is located along the first platform side on an underside of the platform. A second beam is located along the second platform side on the underside of the platform, wherein the second beam includes one or more male protrusions. A second pallet is provided with a second pallet platform including a third platform side and a fourth platform side, the third platform side being opposite the fourth platform side. A third beam is located along the third platform side on an underside of the second pallet platform. A fourth beam is located along the fourth platform side on the underside of the second pallet platform, wherein the fourth beam includes one or more female receptacles sized and shaped to receive the one or more male protrusions to form a combined pallet system from the first pallet and the second pallet. An insert is provided in each of respective the first beam, the second beam, the third beam and the fourth beam, each insert being constructed and formed of a material capable of withstanding at least weight of the product bearing thereupon.

Yet another embodiment of the invention provides a system for supporting, transporting and/or storing product, including a pallet with a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam, each the insert being constructed and formed of a material capable of withstanding at least weight of the product bearing thereupon and a display element including display information is positioned on the pallet and wherein the display covers some or the entire pallet.

Another aspect of the invention provides a method of forming a pallet, including providing a sheet of material, positioning one or more cross-braces on an underside of the sheet of material, positioning two or more spaced inserts on the underside of the sheet of material and over the one or more cross-braces, and assembling a beam over each of the two or more spaced inserts, whereby both the one or more cross-braces and the two or more spaced inserts are locked in place with each of the two or more spaced inserts being located within a respective beam.

Yet another aspect of the invention provides a lightweight, foldable cost-saving pallet system for shipping product, including a pallet with a single sheet of foldable material including a central platform with a first platform side and a second platform side, the first platform side being opposite the second platform side. A first beam is located along the first platform side on an underside of the central platform. The first beam is shaped to expand from a first configuration to a second configuration, wherein the first configuration is rhomboid or a flattened rectangle in cross section and the second configuration is in the form of a hollow rectangle in cross section. A second beam is located along the second platform side on the underside of the central platform, wherein the second beam has the same shape as the first beam. An insert is sized and shaped to fit within each of the first beam and the second beam when the first beam and the beam are in the second configuration, each insert being constructed and formed of a material capable of withstanding at least weight of the product bearing thereupon.

Yet another aspect of the invention provides a system for supporting product with a tracking feature, including a pallet for supporting product thereupon, including a platform including a first platform side and a second platform side, the first platform side being opposite the second platform side. A first beam is located along the first platform side on an underside of the platform. A second beam is located along the second platform side on the underside of the platform. An insert is positioned in each of the first beam and second beam, each insert being constructed and formed of a material capable of withstanding at least weight of the product bearing thereupon and a tracking device for tracking one or both of the pallet and product positioned upon the pallet. The tracking device may be a RFID or the like encapsulated in the pallet material or inside a separate compartment of the pallet.

The present invention and its attributes and advantages further understood, will be further appreciated with reference to the detailed description below of some presently contemplated embodiments, taken in conjunction with the accompanying drawings.

BRIEF DESCRIPTION OF THE DRAWINGS

The preferred embodiments of the invention will be described in conjunction with the appended drawings provided to illustrate and not to the limit the invention, where like designations denoted like elements, and in which:

FIG. 20 shows a perspective view of the pallet of FIG. 1 with one embodiment of an assembled beam insert member.

FIG. 21 shows a top expanded view of the beam insert member of FIG. 20

FIG. 33 shows an assembly view of an alternate embodiment of the pallet of FIG. 1 with an optional auxiliary beam.

FIG. 42 shows perspective views of an additional embodiment that includes display elements.

FIG. 51 shows an alternate embodiment for multiple pallets for protection or packaging of items for transport or shipping.

DETAILED DESCRIPTION OF THE PREFERRED EMBODIMENTS

The present invention will now be described in detail with reference to preferred embodiments as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures are not described in detail in order to not unnecessarily obscure the present invention. For convenience of description, terms such as "upper", "lower", "top", "bottom", "above", "underneath", "outer", "inner", "horizontal", "vertical" "outwardly", and "inwardly" are used to refer to the orientation illustrated in the accompanying drawings. However, it will be understood that embodiments advantageously can be used in a variety of orientations.

Figure 1:
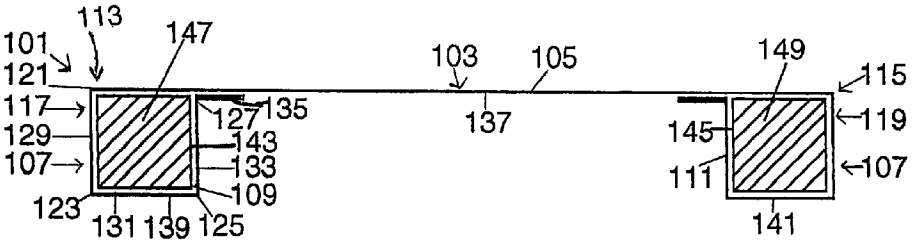
FIG. 1 shows an end view of one embodiment of a pallet according to the present invention.

Referring to FIG. 1, one embodiment of a pallet, according to the present invention, is illustrated generally by reference to number 101. Generally, the illustrated embodiment of the pallet 101 is of a unique construction including a continuous, single material sheet 103 forming a supporting platform 105. Preferably, the material from which the sheet 103 is made is corrugated paperboard or cardboard. However, any suitable material may be used, such as, for example, plastic or combinations of plastic and paper material or other composite materials. Also, the material may include wood, metal, or extruded recycled material. The present invention may relate to an assemblable pallet or pre-assembled pallet and more specifically assembled from a sheet-like material.

A key feature of the present invention includes the ability to provide one or more pallets 101 in a flat, pre-assembled condition 151 (See FIG. 4), which when needed, is easily erected into a supporting state for use as will be explained more fully hereinafter.

The embodiment of the pallet 101 shown in FIG. 1 is configurable to provide two main pallet portions, 105 and 107. The pallet 101 includes a platform 105 sized and shaped to receive goods (not shown) to be stored and/or transported thereon, and a supporting area 107, including in the illustrated embodiment, a pair of parallel beams 109, 111 positioned generally aside and/or underneath the platform 105 and on or adjacent opposing edges or sides 113, 115 of the platform 105. Sides 113, 115 may also be referred to as first and second platform sides respectively.

The two beams 109, 111 in the illustrated embodiment are identical and so only one will be described herein. It is to be understood that the description given here with respect to this embodiment applies to both beams. The illustrated embodiment of the beams 109, 111 are formed from peripheral edges 117, 119 of the sheet material 103 by forming, such as by crimping or bending the material such as by way of some sort of flexible joint, for example, a fold line, line of perforation, line of weakened material, or a hinge. Such flexible joints are specifically identified in the embodiment illustrated in FIG. 1 by numbers 121, 123, 125 and 127. The embodiment of the sheet 101 is thus subdivided by way of the fold lines or hinges into flaps or panels as is known in the art, the precise nature of the subdivision of the sheet to be explained below.

The sheet 103 includes a platform 105 oriented along a plane—shown as horizontal in the figures, but which can be in any spatial orientation—which functions to support weight, including goods stored thereon. The supporting elements can be different sized so that the platform can be at all overall angle relative, for example, to a floor or a step-like arrangement can be formed. The invention can then be used as a void filler.

Underneath the platform 105 are a pair of beams 109, 111. The platform 105 is coupled to a first beam 109 at one side 113 thereof and a second beam 111 at a second side 115 thereof. The beams 109, 111 in the embodiment illustrated in FIG. 1 are hollow, corrugated, positioned in a parallel configuration, and square in cross section. Each beam includes an outer panel 129, which extends generally at right angles downwardly from the platform 105 and separated from the platform 105 by way of a first flexible joint 121. A bottom panel 131 extends inwardly from the outer panel 129 by way of second flexible joint 123. The bottom panel 131 is oriented generally parallel to the surface of platform 105. An inner panel 133 extends upwardly at right angles to the bottom panel 131 by way of third flexible joint 125. The inner panel 133 is oriented generally parallel to the outer panel 129. Finally, a panel 135 for securing the beam structure to the remaining portion of the platform 105—including by the use of glue applied to an underside 137 of the platform 105—extends inwardly from the inner panel 133 by way of fourth flexible joint 127 and is glued, or otherwise secured, to an underside 137 of the platform panel 105 in a horizontal orientation, parallel with respect to the platform panel 105.

Inner panel and bottom panel 133, 131 with outer panel 129 and the underside 137 of the platform panel 105 define beams 109, 111. Each beam 109, 111 is shown as including an inner wall 139, 141 that defines a hollow interior 143, 145 respectively, shaped and sized to receive one or more inserts 147, 149.

Figure 2:
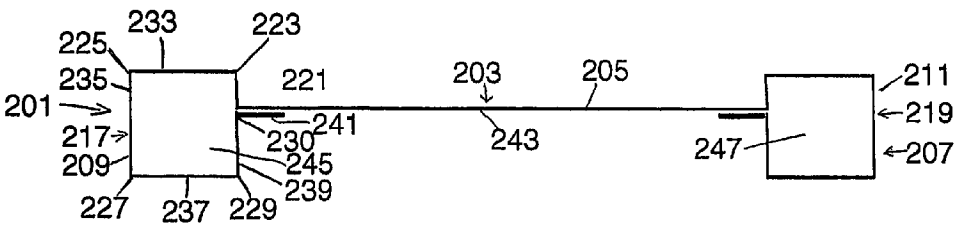
FIG. 2 shows an end view of another embodiment of an improved pallet according to the present invention.

FIG. 2 shows another embodiment of the present invention. The pallet 201 shown in FIG. 2 includes a sheet 203 of material including a recessed platform 205. The embodiment of the pallet 201 shown in FIG. 2 is configurable to a platform 205 that has a pair of parallel beams 209, 211 positioned generally aside and/or underneath the platform 205.

The two beams 209, 211 in the illustrated embodiment are identical and are formed from peripheral edges 217, 219 of the sheet material 203 by subdividing by the way of fold lines, hinges or flexible joints as identified in the embodiment illustrated in FIG. 2 by numbers 221, 223, 225, 227, 229 and 230.

Formed from the platform 205 are a pair of beams 209, 211. Each beam includes first inner panel 231 that extends generally at right angles upwardly from the platform 205 formable from a first fold line 221. A top panel 233 extends outwardly from the first inner panel 231 by way of a second fold line 223. An outer panel 235, which extends generally at right angles downwardly from the top panel 233 and separated by way of a third fold line 225. A bottom panel 237 extends inwardly from the outer panel 235 by way of fold line 227. The bottom panel 237 is oriented generally parallel to the surface of platform 205 and top panel 233. An second inner panel 239 extends upwardly at right angles to the bottom panel 237 by way of fold line 229. The second inner panel 239 is oriented generally parallel to the outer panel 235. Finally, a panel 241 for securing the beam structure to the remaining portion of the platform 205 extends inwardly from the second inner panel 239 by way of fold line 230 and is glued, or otherwise secured, to an underside 243 of the platform panel 205 in a horizontal orientation, parallel with respect to the platform panel 205.

Inner panels 231, 239, top panel 233 and bottom panel 237 with outer panel 235 and the underside 243 of the platform panel 205 define beams 209, 211. Each beam 209, 211 is shown as forming a hollow interior 245, 247 respectively, shaped and sized to receive one or more inserts (not shown).

Another embodiment of the pallet 301 of the present invention is shown and includes a sheet 303 of material including a raised platform 305. The shown raised platform 305 is maintained in a spaced relationship from a top panel 321 of each beam 307, 309. The spaced relationship provides an above-beam channel 337, which is sized and shaped to receive one or more reinforcing member (not shown), such as, for example, a plywood sheet, one or more wood beams, one or more stretcher, a plurality of slats and the like, for providing reinforcement to the platform 305 and the overall structure of the pallet.

The pallet 301 is formed by beams 307, 309, underneath sides 311, 313 and maintained in a spaced condition from platform 305. At each of the platform sides 311, 313, the sheet 303 is turned vertically downwardly to form outer panel 315 by way of first fold line 325. Bottom panel 317 extends horizontally inwardly from the outer panel 315 by way of second fold line 327. Inner panel 319 extends vertically upwardly from the bottom panel 317 by way of third fold line 329. Top panel 321 extends horizontally outwardly from the inner panel 319 by way of fourth fold line 331. Panel 323 extends vertically upwardly from the top panel 321 by way of the fifth fold line 333 and is secured to an inside surface 335 of outer panel 315, preferably by gluing. As mentioned above, channel 337, defined by the platform underside 339, glue panel 323 and top panel 321 is sized and shaped to receive end or edge portions of one or more reinforcing member (not shown).

Top panel and bottom panel 321, 317 with outer panel and inner panel 315, 319 define beams 307, 309. Each beam 307, 309 includes a hollow interior 341, 343, shaped and sized to receive one or more insert (not shown).

Referring to FIG. 1, each beam 109, 111 is formed to define an entire respective edge or side 113, 115 of the platform panel 105 and has a hollow, rectangular or square cross-sectional shape. Because the panels of the beams 109, 111 are hingeably attached by way of fold lines, hinges, creases, or the like to the platform 105, the pallet 101 may be provided with the beams 109, 111 in a flattened condition 151 (See FIG. 4) which are then expanded or erected into an expanded or vertical condition as shown in FIG. 1 prior to use. Accordingly, the pallet 101 can be shipped in a compact condition which takes relatively little space compared to many of the prior devices. The embodiments of FIGS. 2 and 3 may also be provided in a flattened condition.

Figure 5:
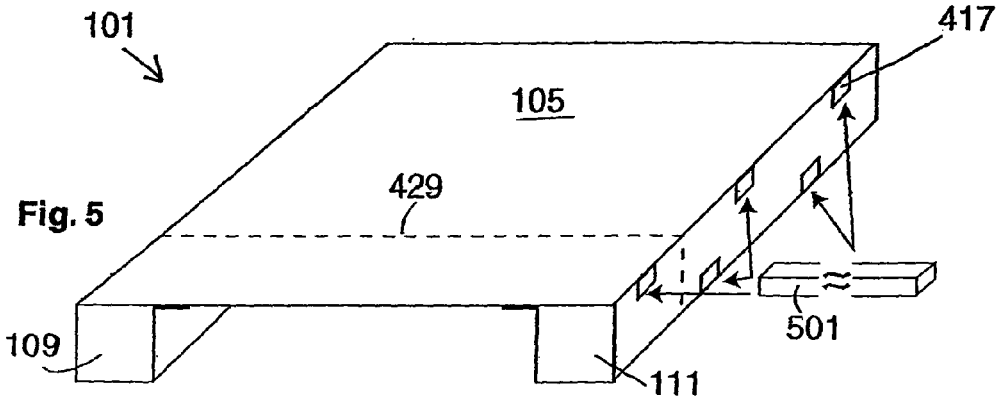
FIG. 5 shows a perspective view of the pallet of FIG. 1 including an embodiment of an optional reinforcement sheet.
Figure 6:
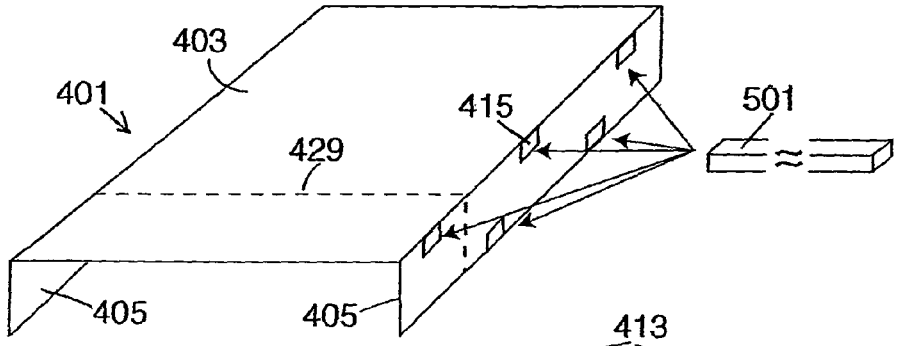
FIG. 6 shows a perspective view of another embodiment of an optional reinforcement sheet.
Figure 6:
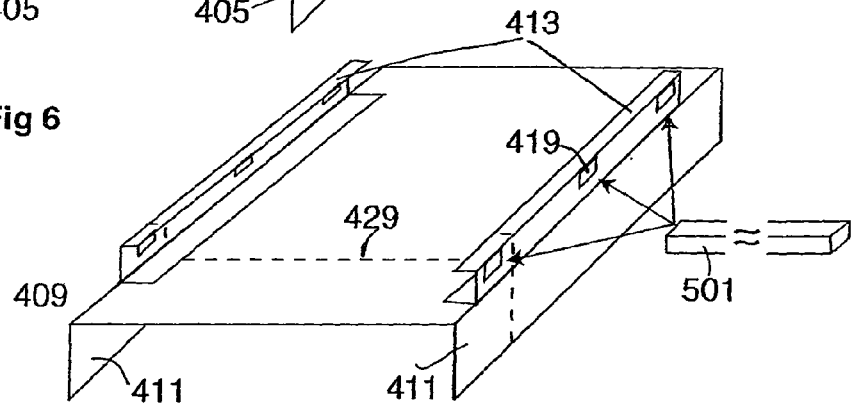
Figure 7:
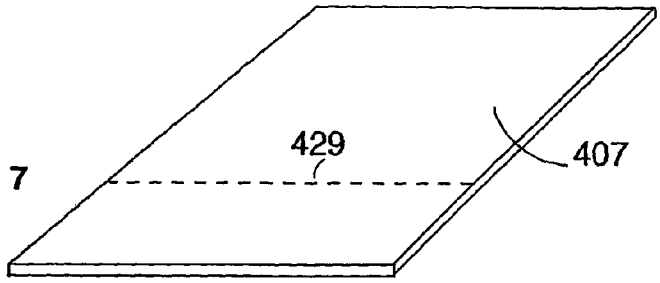
FIG. 7 shows a perspective view of yet another embodiment of an optional reinforcement sheet.
Figure 8:
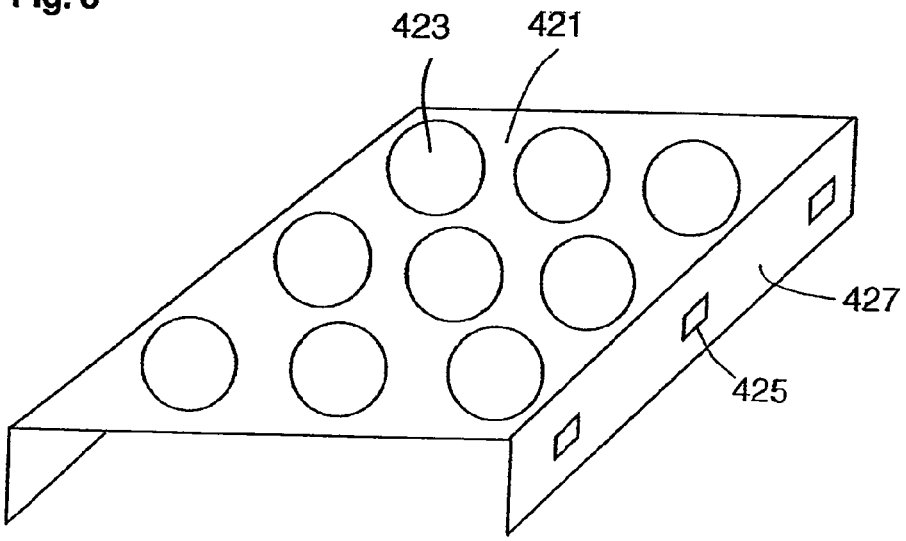
FIG. 8 shows a perspective view of yet another embodiment of an optional reinforcement sheet.

FIG. 5 shows a perspective view of the pallet 101 of FIG. 1 including an embodiment with an optional reinforcement sheet. Various embodiments of an optional reinforcement sheet are shown in FIGS. 6-8. The pallet 101 of FIG. 1 may optionally be provided with an under-sheet shown generically at 401 of FIG. 5, which may be in the form of a plain pad 407 (See FIG. 7), a U-sheet 403 (See FIG. 5), which is a plain pad with a pair of side legs 405 or a modified U-sheet 409 (See FIG. 6) having both a pair of side legs 411 and a pair of upper arms 413. When the pad 407 (FIG. 7) is used with a pallet 101 (FIG. 5) the pallet is first erected, the pad 407 is positioned underneath the pallet platform 105, and any cross braces 501 through side openings 417 and underneath the pad. Cross braces 501 can be positioned underneath the pallet platform 105 without the use of a reinforcement sheet.

Depending on the application and materials from which the pallet is made, it may be advantageous to use one or more additional structure or reinforcing element. One such structure is shown in FIG. 5 and includes the formation of one or more openings 417 in beams 111. A corresponding opening (not shown) is likewise formed in beam 109 aligned with the opening 417 such that a cross brace 501 may be inserted therethrough, which, when inserted, extends across the pallet 101 underneath the platform 105. Each of the one or more cross braces 501 functions to reinforce the platform 105. The cross brace 501 may be formed from a variety of materials including the same or different material from which the pallet 101 is formed. While the cross brace 501 may be made of cardboard, it also may be made of plastic, wood, metal, or a composite if the cross-brace is formed from a "2×4", or any other suitable size. The cross-braces 501 pass underneath and support the underside of the platform 105 to provide significant structural support.

The U-sheet 403 shown in FIG. 5 includes under sheet openings 415 which are provided in alignment of openings 417 of pallet 101 to permit cross braces 501 to pass through both pallet 101 and U-sheet 403. Preferably, the directionality of the corrugated material is aligned orthogonally in the U-sheet 403 with respect to the directionality of the corrugated material of pallet 101. Of course, if the material of the pallet 101 is multidirectional this may be less important.

Under sheet openings 419 may be provided in the upper arms 413 to provide the same benefit as the under sheet openings 415 in the under sheet 403 of FIG. 5 as shown in FIG. 6.

Figure 9:
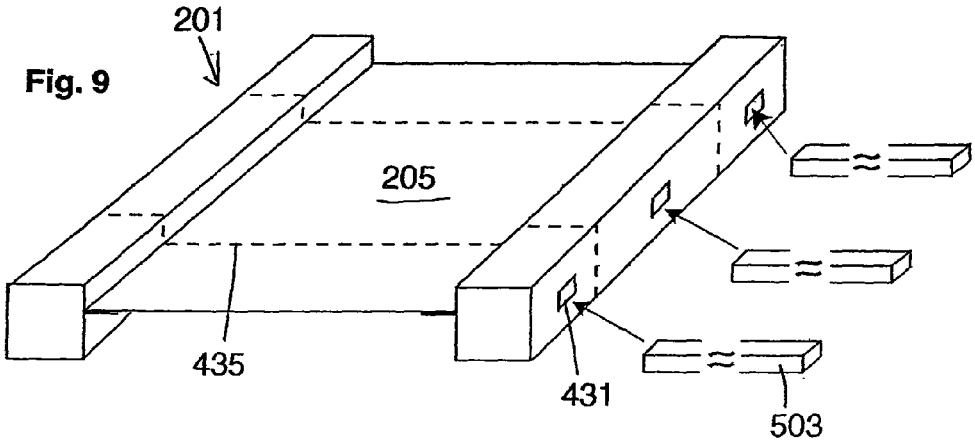
FIG. 9 shows a perspective view of the pallet of FIG. 2.

The platform 105 of the pallet 101 may include an optional U-sheet 421 (see FIG. 9). In one embodiment, the U-sheet 421 may be positioned upon the platform 105 and may include one or more hole 423 sized and shaped to receive like-shaped articles (not-shown), which in the illustrated example may be buckets of goods or materials or other types of canisters and the like. The one or more holes 423 may be die-cut to form a template to receive the goods, for example, flower pots. Of course, other shaped holes are contemplated. Openings 425 in legs 427 may be provided to retain the U-sheet 421 on the pallet 101 when interlocked with slats (not shown).

FIGS. 5, 6, and 7 all show perforations 429 for making smaller pallets from the base sheet of the illustrated embodiment. Smaller pallets 101 are made by separating platform 105 by way of perforation 429.

Figure 3:
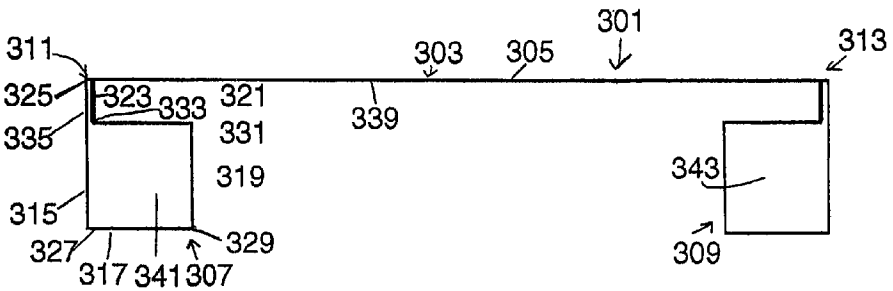
FIG. 3 shows an end view of yet another embodiment of an improved pallet according to the present invention.
Figure 10:
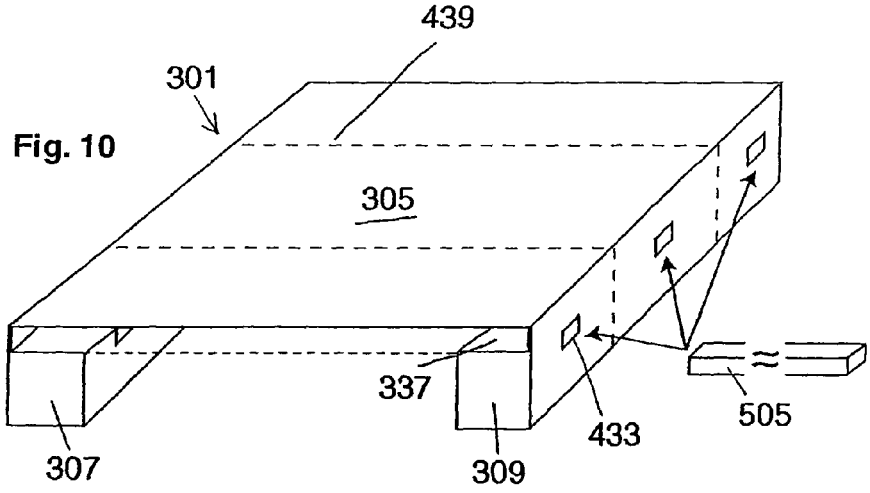
FIG. 10 shows a perspective view of the pallet of FIG. 3.

FIGS. 9 and 10 show the embodiments described with respect to FIGS. 2 and 3 respectively. The pallet 201 of FIG. 2 is shown in FIG. 9 and includes openings 431 for receiving cross braces 503 for reinforcement purposes, and so on. These openings 431 may be positioned so that the cross braces 503 pass underneath or alternately, over the pallet platform 205. FIG. 10 illustrates openings 433 formed to accept cross braces 505 for purposes of providing reinforcement to pallet 301. It can also be seen that channel 337 is formed between the pallet platform 305 and a horizontal line 280 corresponding to a top of each beam 307, 309. The cross braces 505 pass through openings 433 and fit securely within channel 337.

FIGS. 9 and 10 both show perforations 435, 439 for making smaller pallets from the base sheet of the illustrated embodiment. Smaller pallets 201, 301 are made by separating the platforms 205, 305 by way of perforation 435, 439.

Figure 11:
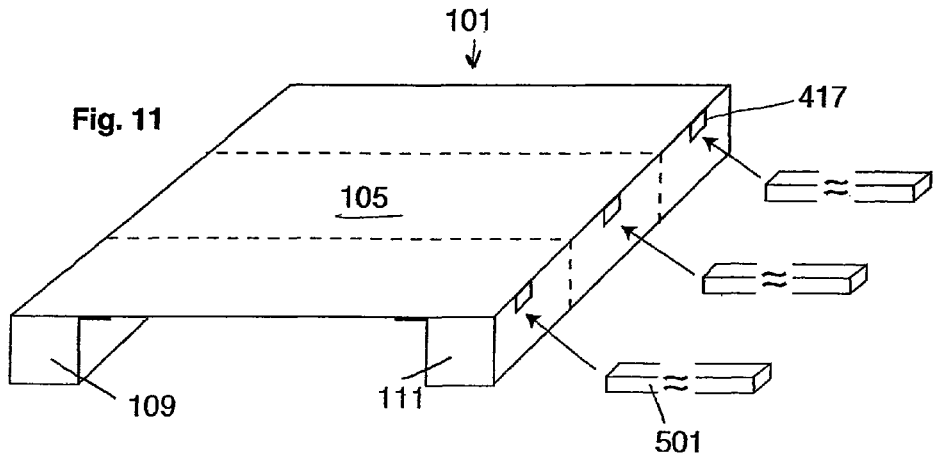
FIG. 11 shows a perspective view of the pallet of FIG. 1.
Figure 12:
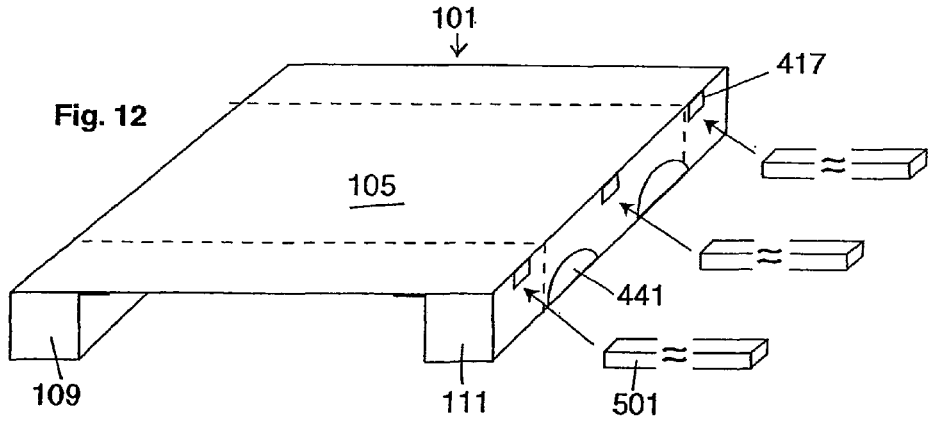
FIG. 12 shows a perspective view of the pallet of FIG. 1 with optional openings in the beams for permitting insertion of forklift fork members.

FIGS. 11 and 12 illustrate the pallet 101 of FIGS. 1 and 5 with cross braces 501 positioned for insertion through openings 417. The pallet 101 of FIG. 12 includes additional forklift openings 441 through beams 109, 111 to permit a forklift to insert forklift tines therethrough and engage/lift pallet 101 from the side direction shown.

Figure 13:
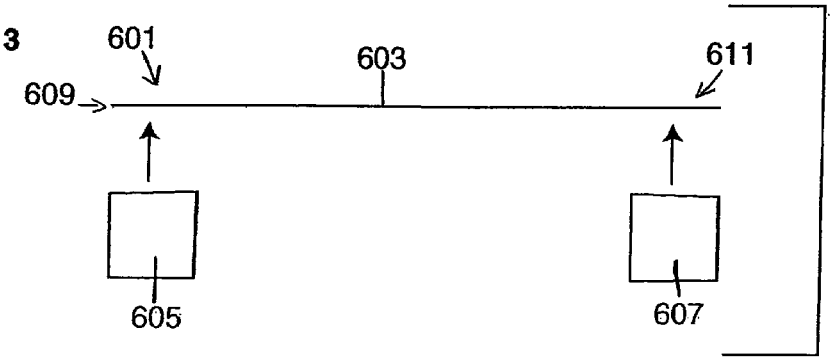
FIG. 13 shows an end view of an embodiment of the present invention in a three-piece initial configuration.

FIG. 13 shows a simplified version of one embodiment of the invention. The pallet 601 includes a platform 603 coupled to a first beam 605 at one side 609 thereof and a second beam 607 at a second side 611 thereof. The beams 605, 607 are hollow corrugated positioned in a parallel configuration and square in cross section.

Figure 14:
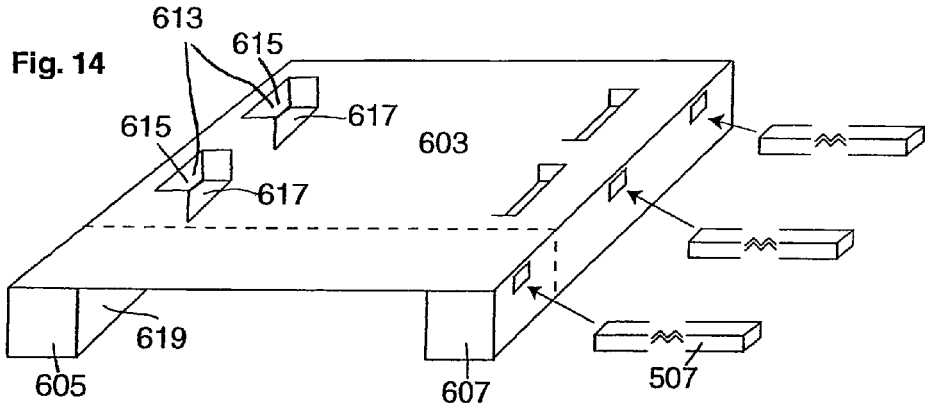
FIG. 14 shows an alternate embodiment of a pallet according to the present invention.

FIG. 14 shows the pallet of FIG. 13 with a locking feature 613 including a pair of die-cut flaps 615 and 617. Flap 615 is a rectangular flap positioned in the platform 603, which, when folded from the platform 603 into a vertical position, braces beam 607 into an open condition. Similarly, flap 617 is a rectangular flap, adjacent flap 615, which, when folded from the inner panel 619 into a horizontal position interlocks to support the beam 605 in an expanded condition. Beam 607, of course, is provided with a locking feature that functions as does 613.

Figure 15:
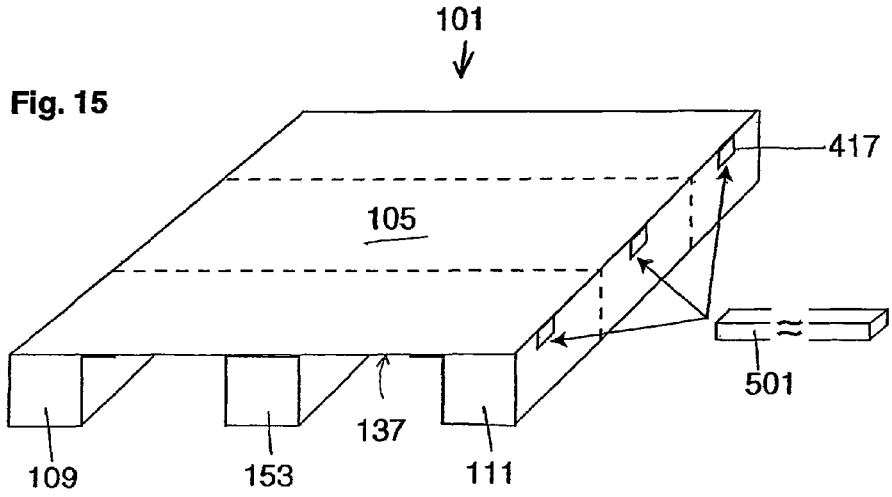
FIG. 15 shows a perspective view of the pallet of FIG. 1 with an optional auxiliary beam.
Figure 16:
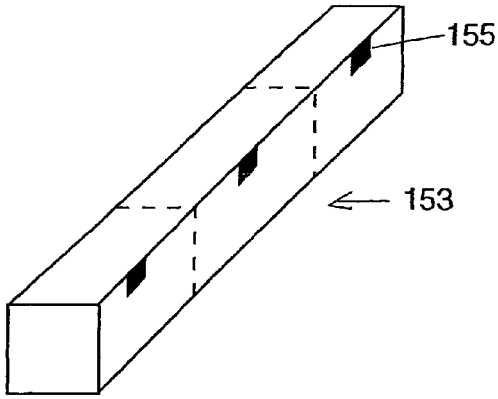
FIG. 16 shows a perspective view of the auxiliary beam shown in FIG. 15.
Figure 17:
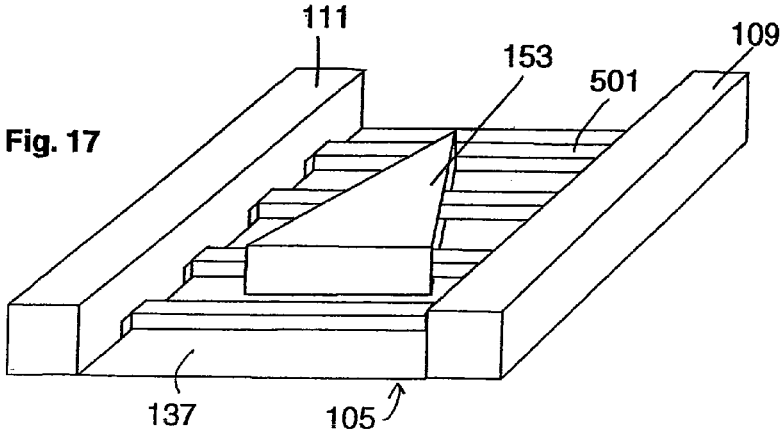
FIG. 17 shows a perspective view of another embodiment of the auxiliary beam shown in FIG. 15.
Figure 18:
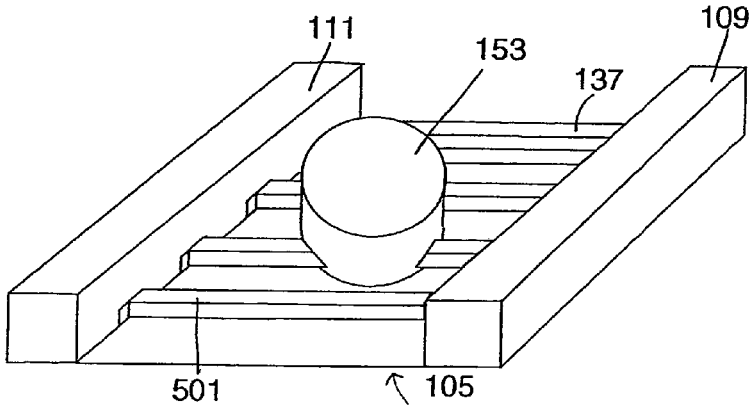
FIG. 18 shows a perspective view of yet another embodiment of the auxiliary beam shown in FIG. 15.
Figure 19:
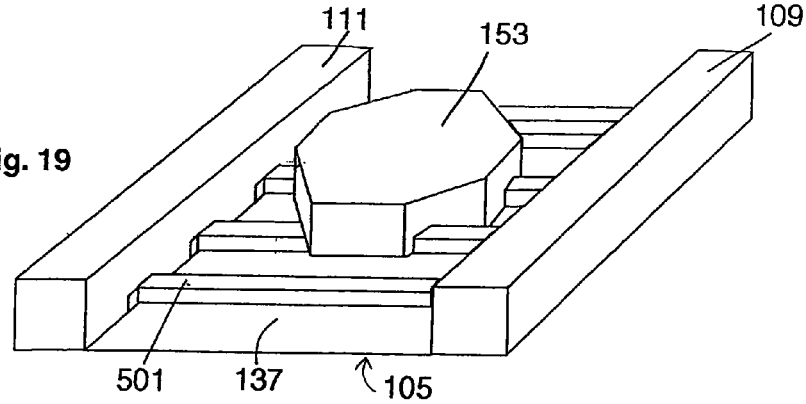
FIG. 19 shows a perspective view of yet another embodiment of the auxiliary beam shown in FIG. 15.

FIG. 15 illustrates an embodiment of the pallet 101 that includes an auxiliary or third beam 153 applied to an underside 137 of the platform 105 such as one shown in FIG. 1. The auxiliary beam 153 may be constructed largely in a similar fashion as any of beams 109, 111 (FIG. 1) by fastening together four panels of material, such as corrugated paper. An auxiliary beam 153 is illustrated in FIG. 16 where, in use, (See FIG. 15) the beam 153 is positioned midway between beams 109, 111 underneath platform 105. The auxiliary beam 153 may be added to the platform underside 137 of the pallet 101 to adequately distribute the load carried on the platform panel 105. Auxiliary beam 153, like beams 109, 111, includes cross brace beam openings 155 to permit insertion of cross braces 501 for supporting platform 105. As shown in FIGS. 17, 18, 19, the auxiliary beam, or more generically, the central support structure, 153 may be a variety of shapes and sizes.

FIG. 20 illustrates pallet 101 with insert, illustrated generally by reference to number 701, oriented to be inserted into hollow beam 109. Depending on the application and materials from which the pallet is made, it may be advantageous to use one or more additional structure or reinforcing element. When the beams 109, 111 are to be erected, for example, at a warehouse site, insert 701 may be placed in the beams 109, 111 to provide added support to each respective beam and thus to the pallet 101. The insert 701 may be elongate members, e.g., rectangular, sized and shaped to fill the interior 143, 145 of hollow beams 109, 111. The insert 701 is made of any suitable material, for example, wood, plastic, cardboard, fiberboard, rigid foam, fiberglass, carbon-fiber, composite materials and so on, capable of providing support to the beams 109, 111.

More specifically, as shown in FIG. 20, insert 703 includes a folded cardboard insert spacer 705 with one or more slots 707 and a rigid brace 710, shown generally at 709. The brace 710 may be made of any suitable material, such as, for example, wood. The insert 701 when assembled and inserted into beam interior 143 causes brace 709 to be vertically oriented in the beam 109 and thus, supportive of any load placed thereon. Slots 707 in the spacer 705 function to permit slats 501 to be passed through openings 417, bearing on brace 709 and through each respective beam 109, 111 without interfering with function of the insert 703. As shown in FIG. 21, spacer 703 may be formed of a folded sheet 711 including a plurality of five adjacent hinged panels. First and second bottom hinged panels 713, 715 are attached to a third hinged panel 717. Third hinged panel 717 is attached to a fourth hinged panel 719 including one or more slot 707. A fifth hinged panel 721 is attached to the fourth hinged panel 719.

Once folded into the configuration shown in FIG. 20, and attached or placed against brace 709, the insert 703 may be inserted one or the beams 109, 111.

In the event that inserts 701 are used in each beam interior 143, 145 in combination with cross braces 501, it will be understood that each insert 701 will be provided with a slot 707 lining up with each corresponding side opening 417 of the beam 109, 111 to permit insertion of a corresponding cross brace 501 through the outer panel 129 and inner panel 133 of beam 109 through inner panel 133 and outer panel 129 of beam 111 (see FIG. 1). It is contemplated that In the event that braces 709 (See FIGS. 11*a*-11*h*) are used in each insert 701 in combination with cross braces 501, it will be understood that each brace 709 will be provided with a slots lining up with each corresponding side Braces 709 are generally vertically oriented in the beam 109, 111 and, thus, supportive of any load placed thereon. In the event that inserts are used in each beam interior 143, 145 with braces 709 in combination with cross braces 501, it will be understood that each brace 709 will be provided with a groove or slot lining up with each corresponding side opening 417 to permit insertion of a corresponding cross brace 501 through the outer panel 129, insert 701, brace 709, inner panel 133, of beam 109 and through inner panel 133, insert 701, brace 709, and outer panel 129 of beam 111 (see FIG. 1).

Figure 22:
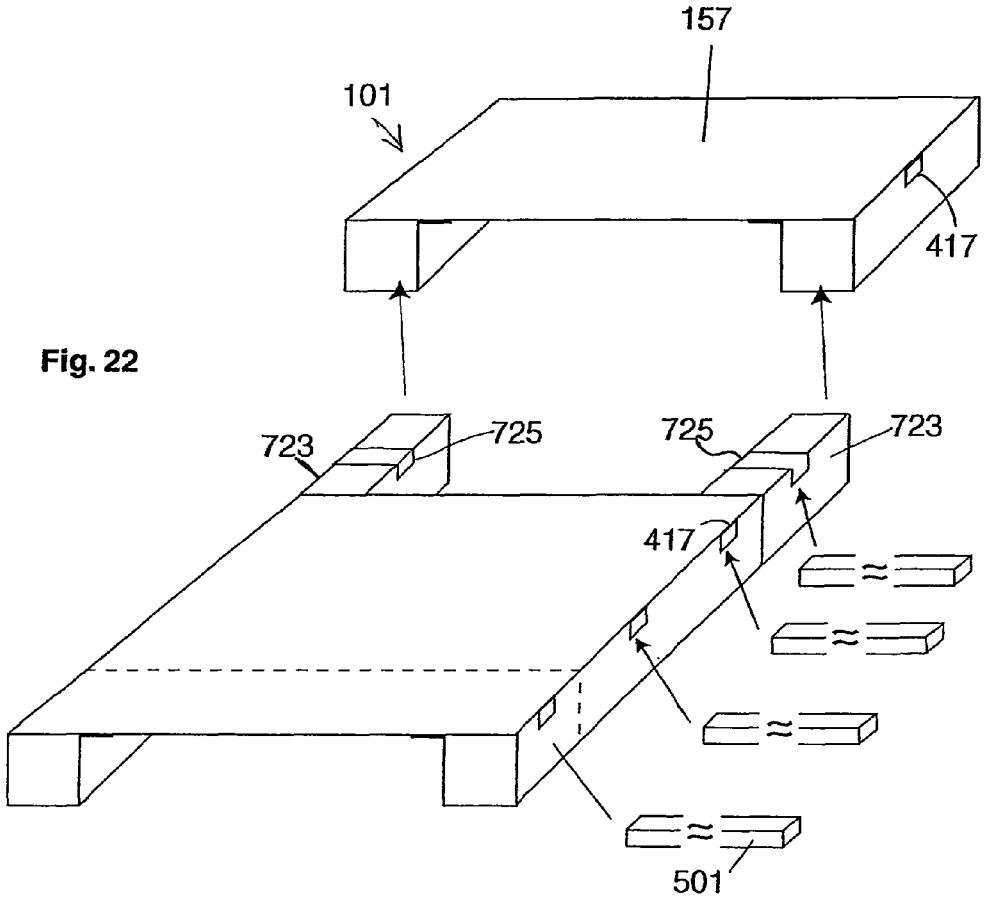
FIG. 22 shows a perspective view of the pallet of FIG. 1 with elongated beam insert members and a pallet extender module.

FIG. 22 illustrates a pallet 101 having elongated inserts 723 with slots 725. The elongated inserts 723 permit the fitting thereon of an extension 157, similar or identical in construction to that of pallet 101. In such a manner, the pallet 101 and extension 157 accommodates a greater amount of material for placement thereon than a pallet alone. As in FIG. 22, for example, the pallet 101 includes openings 417 for accepting cross braces 501.

Figure 23:
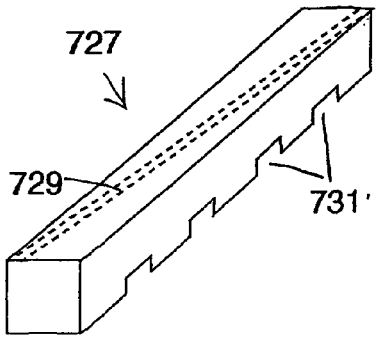
FIG. 23 shows a perspective view of an insert component.
Figure 24:
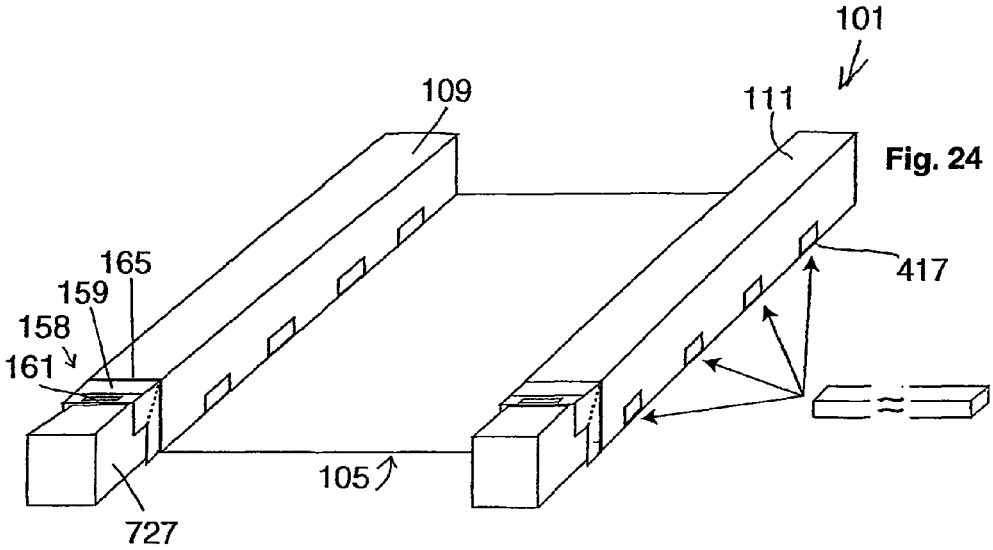
FIG. 24 shows a perspective view of the pallet of FIG. 1 including inserts.
Figure 25:
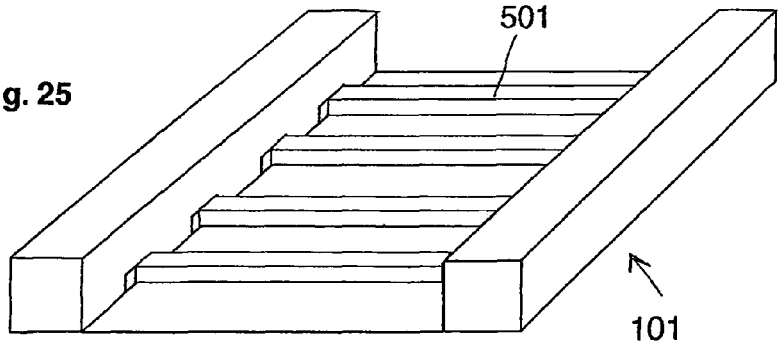
FIG. 25 shows a perspective view of an assembled pallet of FIG. 1 including inserts and cross-braces.

FIGS. 23, 24, 25 illustrate embodiments of pallet 101 including inserts 727 that may further include a rigid brace 729 for additional strength and support. The inserts 727 also include one or more slots 731. The beams 109, 111 as well as the platform 105 may be further structurally supported by cross braces 501 as shown in FIG. 25, which run at right angles to the beams 109, 111. The slots 731 positioned in the insert 727 allow for a cross brace 501 to pass therethrough. Similarly, the beams 109, 111 include cross brace beam openings 417. It is further contemplated that the braces 729 themselves may include apertures (not shown) that allow the cross braces 501 to pass through.

FIG. 24 further illustrates a locking feature 158 of the beam 109, 111 by which an insert 727 (and optional brace 729) may be secured within to provide aesthetic appeal without exposing flutes or corrugation after the insert 727 is positioned within the beam 109, 111. The end of each of the embodiments of the beams 109, 111 includes a flap 159 with a slit or cut 161 to engage with a stub 163 (not shown) of the pallet 101 (see FIG. 24). As shown in FIG. 24, the flap 159 extends from the end and folds downward toward the top of the platform 105 along a fold line 165. As shown in FIG. 24, after the insert 727 is positioned in the beam 109; the stub 163 is inserted in the cut 161 of the flap 159. This insertion secures the insert 727 (an optional insert 729) within the beam 109. This structure facilities the prevention of the entry of contaminants including water into inner portions of the pallet 101 including that which supports the platform. Embodiments of the pallet 101 are directed to be used in such moist or cool environments without appreciable loss in structured dependability. The locking feature described above may also be on insert itself described more fully in reference to FIGS. 30 and 31 below.

Figure 27:
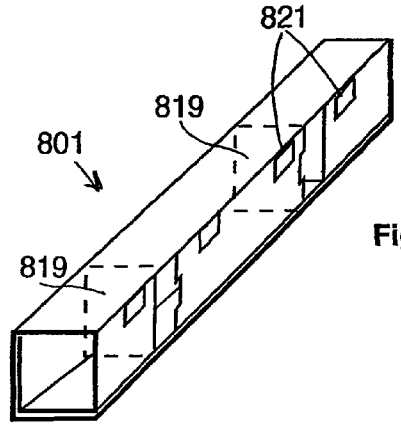
FIG. 27 shows the beam insert of FIG. 26 as assembled.
Figure 28:
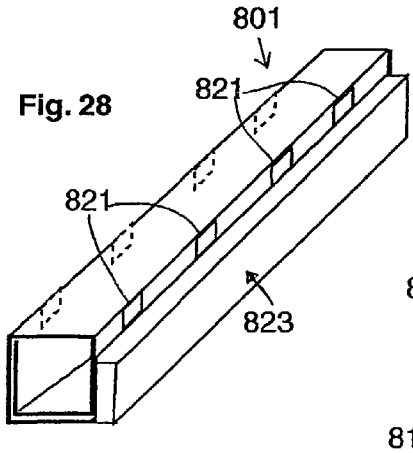
FIG. 28 shows a perspective view of the beam insert of FIGS. 26 and 27 with an optional brace.
Figure 26:
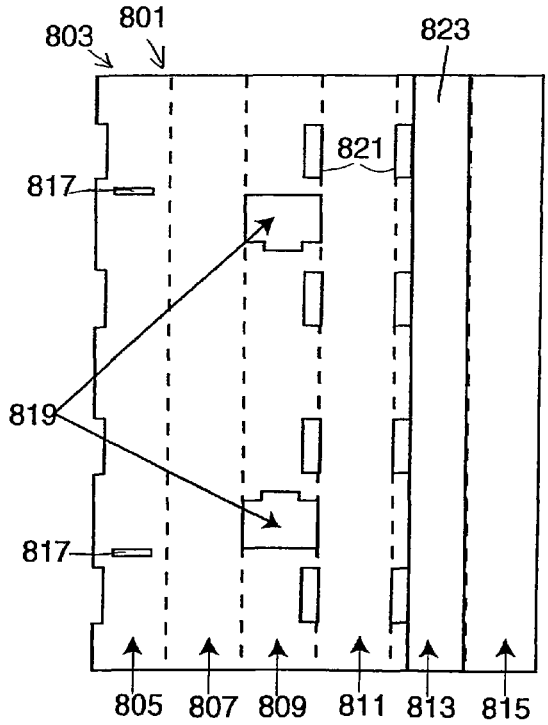
FIG. 26 shows an alternate embodiment of a beam insert in an unfolded condition.

FIGS. 26, 27 and 28 show an alternate embodiment of a beam insert 801. Beam insert 801 is formed of a sheet 803 of corrugated material with a plurality of fold lines to define six adjacent parallel panels 805, 807, 809, 811, 813, 815. Panel 805 includes a pair of parallel slots 817. Panel 187 is a plain sheet of material. Panel 809 includes a pair of die-cut reinforcing panels 819, which when folded out of the plane of the panel 809 and inserted into slots 817 act as a bulwark to reinforce the shape and structural integrity of the beam insert 801 (See FIGS. 27 and 28). Panel 809 also includes side openings 821, each of which are sized and shaped for receiving a respective cross brace (not shown). Panel 811 is a plain sheet of material. Panel 813 includes side openings 821, each of which are sized and shaped for receiving a respective slat (not shown) and may be provided with brace 823. Panel 815 is a plain sheet of material. The panels 805, 807, 809, 811, 813, 815 are rolled into a tube form having a rectangular cross-section as shown in FIGS. 27 and 28.

FIGS. 23, 24, 25 illustrate embodiments of pallet 101 including insert 825 that may further include a rigid brace 827 for additional strength and support. Several embodiments of inserts 825 along with various braces 827 are depicted in FIGS. 29*a*-29*h*. FIGS. 29*a*-29*d* illustrate embodiments of an insert 825 including a wall 829 having a generally rectangular shaped outer surface 831 having an inner surface 833, the latter of which defines an opening 835. The wall 829 of the illustrated insert 825 further includes a first flap 837 and a second flap 839. Once the brace 827 is positioned within the opening 835 of insert 825, the first flap 837 is folded inward toward the opening 835 along a fold line 841. Subsequently, the second flap 839 is folded inward toward the opening 835 along a fold line 843. The second flap 839 may be secured to the first flap 837 for example, mechanically or with an adhesive such as with glue, so that the brace 827 is contained within the opening 835.

FIGS. 29*e*-29*h* illustrate an additional embodiment of insert 825 including an opening 845 defined by a first insert member 847 and a second insert member 849. The first member 847 includes a flap 851—that is folded perpendicularly along a fold line 855—and a flap 853—that is folded along a fold line 857 such that flap 851 is parallel to flap 853. The second member 849 includes a flap 859—that is folded perpendicularly along a fold line 863—and a flap 861—that is folded along a fold line 865 such that flap 859 and flap 861, respectively, are parallel to each other. Once the brace 827 is positioned within the insert 825, the first member 847 and the second member 849 may be engaged such that flap 851 abuts inside flap 859 and flap 853 abuts outside the flap 861. The flaps of the first member 847 and the second member 849 can be secured to one another mechanically or with an adhesive such as glue such that the brace 827 is contained within the opening 845.

The brace 827 may be made of any suitable material, for example, wood, plastic, cardboard, fiberboard, rigid foam, fiberglass, carbon-fiber, composite materials and so on, that is capable of providing support to the inserts 825 and thereby the load carried by the pallet 101. Moreover, the brace 827 can be of any size or shape to fit inside the opening 845 of the insert 825 and carry the required load including those sizes and shapes illustrated in FIGS. 29*a*-29*h*.

Figure 29A:
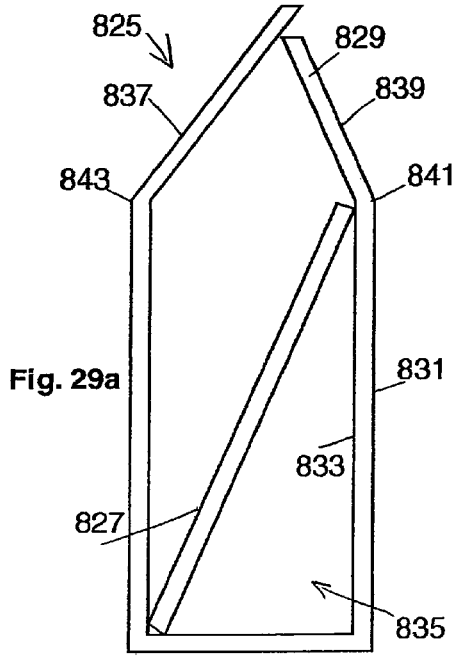
FIGS. 29*a*-29*h* shows various embodiments of the insert including braces of the improved pallet.
Figure 29C:
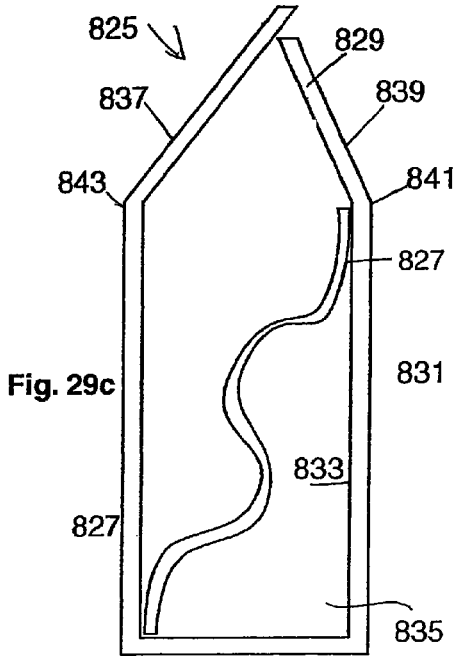
Figure 29B:
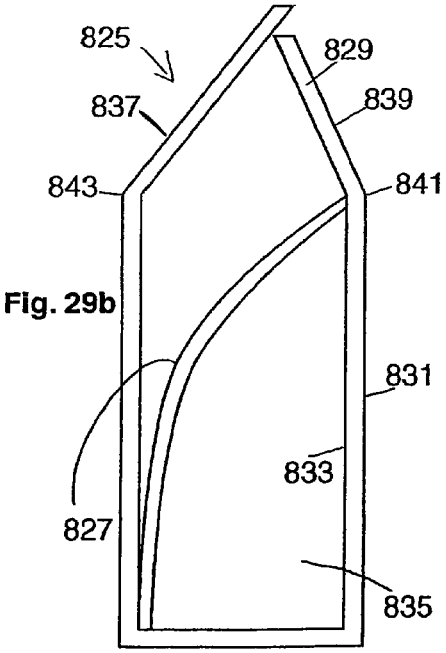
Figure 29D:
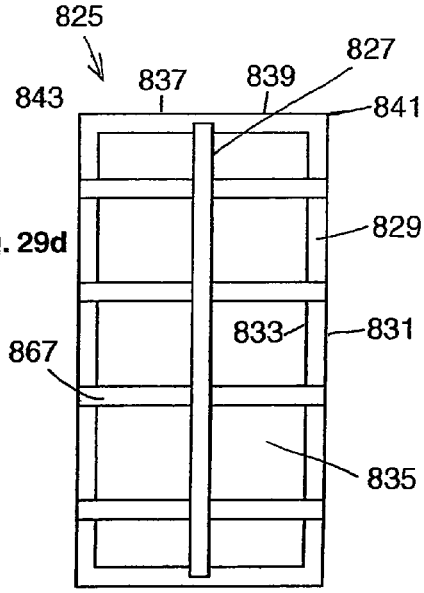
Figure 29E:
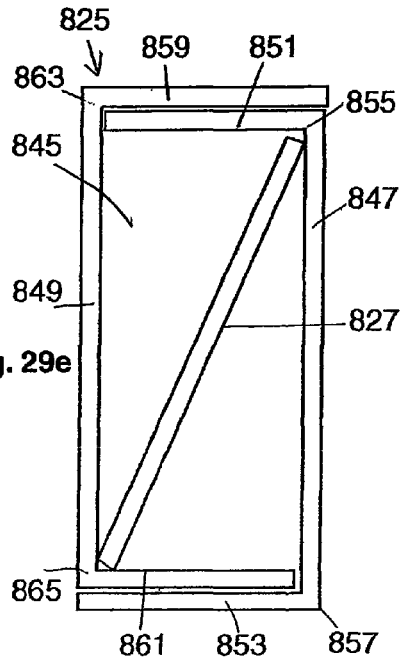
Figure 29G:
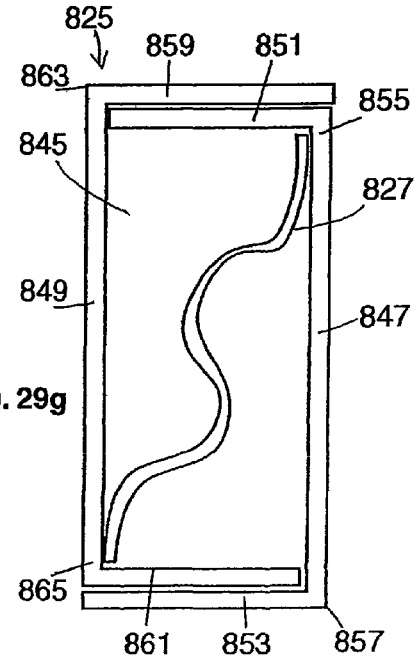
Figure 29F:
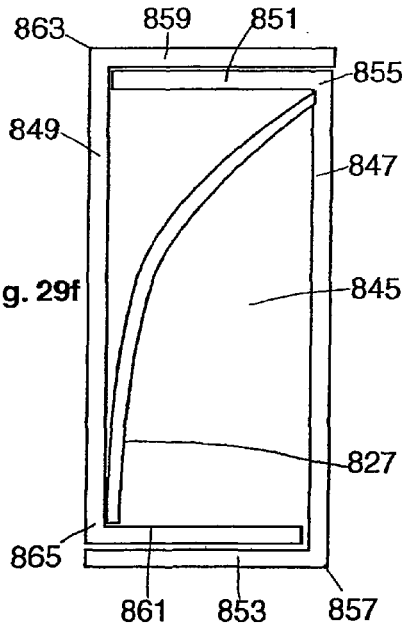
Figure 29H:
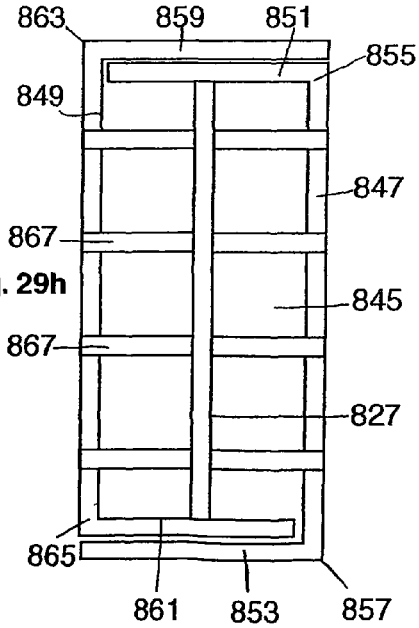

Each insert 825 may further include slots 867 (see FIGS. 29*d* and 29*h*) that allow cross-braces 501 to be passed through subsequent to the positioning of the inserts 825 into the beams 109, 111. FIG. 29*d* and FIG. 29*h* illustrate embodiments of inserts 827 in which cross braces 501 are positioned to extend through the inserts 825.

To prevent greater structured dependability, brace 827 may be placed at an angle or angles or configurations relative to insert 825. So braces 827 having such angles or configurations are shown in FIGS. 29*e*-29*h* and avoid the "parallelism" in support that causes a loss in the structured dependability of the pallet.

Figure 30:
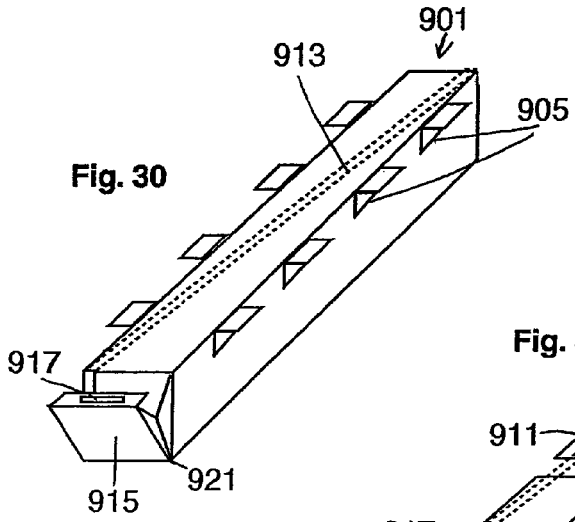
FIG. 30 shows a perspective view of an alternate embodiment of the insert shown in FIG. 23.
Figure 31:
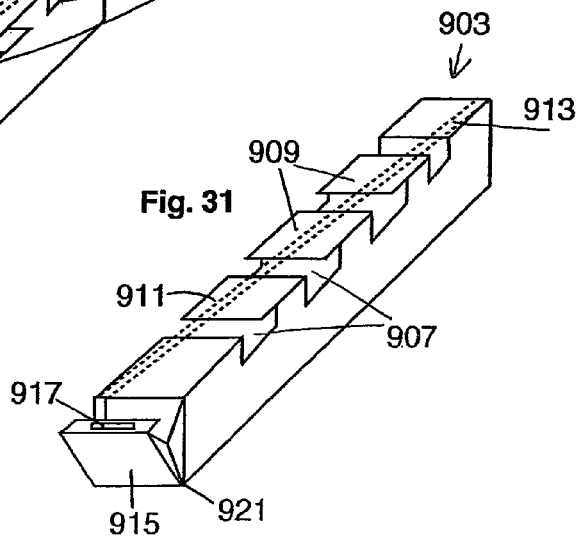
FIG. 31 shows a perspective view of yet an alternate embodiment of the insert shown in FIG. 23.

FIGS. 30 and 31 illustrate alternate embodiments of an insert 901, 903. This embodiment provides a "clip-on" feature that facilitates the adjustment of the structural dependability of the pallet by providing additional support. FIG. 30 illustrates an insert 901 with slots 905 punched out so that cross braces 501 (see FIG. 32) may pass therethrough. FIG. 31 illustrates an insert 903 that includes slots 907 separated by spacers 909. An overhang 911 extends from the spacers 909. Once a cross brace 501 is installed, the overhang 911 rests substantially on top of the cross brace 501 to secure it.

Figure 32:
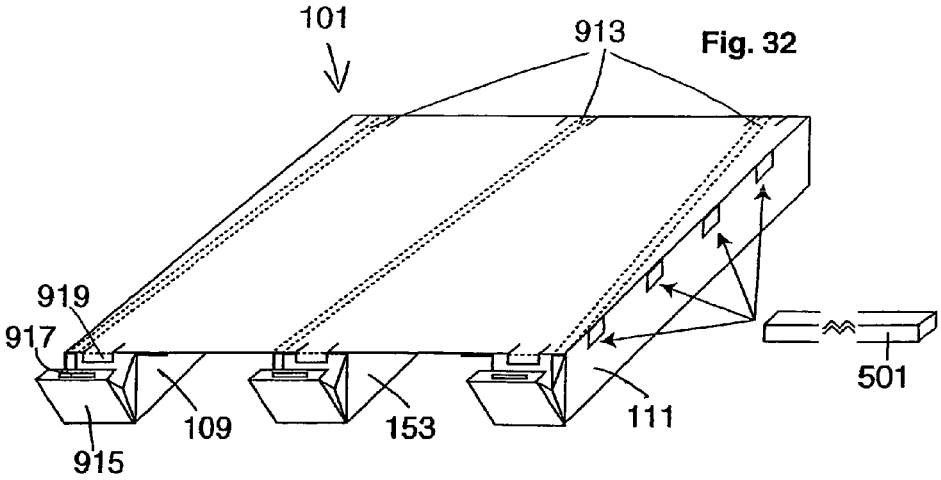
FIG. 32 shows a perspective view of an assembled pallet of FIG. 1 with an optional auxiliary beam including the alternate embodiment of the insert shown in FIGS. 30 and 31.

FIGS. 30 through 32 further illustrate embodiments of an insert 901 and 903 by which a brace 913 may be secured within the insert 901 and 903 to provide aesthetic appeal without exposing flutes or corrugation after the insert 901 and 903 is positioned within the beam 109, 111 and 153. The end of each of the embodiments of the inserts 901 and 903 includes a flap 915 with a slit or cut 917 to engage with a stub 919 of the pallet 101 (see FIG. 32). As shown in FIGS. 30 and 31, the flap 915 extends from the end and folds upward toward the top of the insert 901 and 903 along a fold line 921. As shown in FIG. 32, after the insert 901 and 903 is positioned in the beam 109, 111 and 153; the stub 919 is inserted in the cut 917 of the flap 915. This insertion secures the brace 913 within the insert 901 and 903 in addition to securing the insert 901 and 903 within the beam 109, 111 and 153. This structure facilities the prevention of the entry of contaminants including water into inner portions of the pallet 101 including that which supports the platform. Embodiments of the pallet 101 are directed to be used in such moist or cool environments without appreciable loss in structured dependability.

The above described system apparatus and method of containing a brace 913 within the insert 901 and 903 allows for an aesthetic appeal upon insertion into the beam 109, 111 and 153 such that no flutes or corrugation is exposed. It is further contemplated that the ends of the beams can include a flap with a slit (See FIG. 24) to contain the inserts 901 and 903 and also provide aesthetic appeal. Various other methods can be used to seal the insert within the beam without exposing flutes, for example with a separate end cap.

FIG. 33 illustrates an alternate embodiment. Insert 925 includes four flaps, 943, 945, 947, 949 that open and can be closed along the respective fold lines 951, 953, 955, 957 of each flap and include an inner wall surface 959 sized and shaped to create a cavity 961.

Braces, like the ones illustrated as element 827 with reference to FIGS. 29*a*-29*h*, is insertable into cavity 961 of beam 109 of the insert 925 of the pallet 101. The insert 925 is sized and shaped to be inserted within the inner wall surface 959 of cavity 961. The structure insert 925 includes slots 939 that are alignable with the openings 417 of the beam 111, 153, 109 to allow for the cross braces 501 to be inserted.

Figure 34:
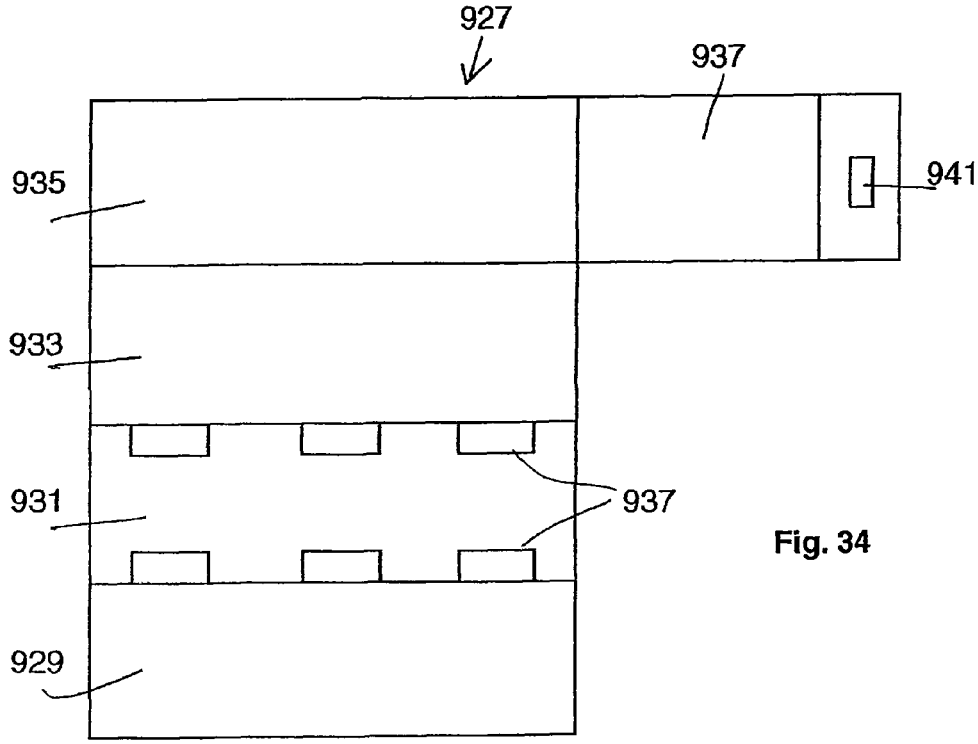
FIG. 34 shows a top unfolded view of the beam insert member of FIGS. 23, 30 and 31.

With reference to FIG. 33, insert 925 may be formed of a foldable sheet 927 including a plurality of adjacent hinged panels. The embodiment of sheet 927 shown in FIG. 34 includes five panels 929, 931, 933, 935 and 937. First and second bottom hinged panels 929, 931 are attached to a third hinged panel 933. Third hinged panel 933 is attached to a fourth hinged panel 935. Each panel 929, 931, 933, 935 may include one or more slots 939. The embodiment illustrated in FIG. 34 includes a panel 931 having a plurality of slots 939.

A fifth hinged panel or flap 937 may be alternatively be attached to the fourth hinged panel 935. Once folded into the configuration shown in FIG. 33, with an optional brace positioned inside the insert 925, the insert 925, may be inserted into one or more of the beams, such as 109, 111, 153. As shown, the slit 941 of the fifth hinged panel 937 engages with the pallet 101.

Figure 35:
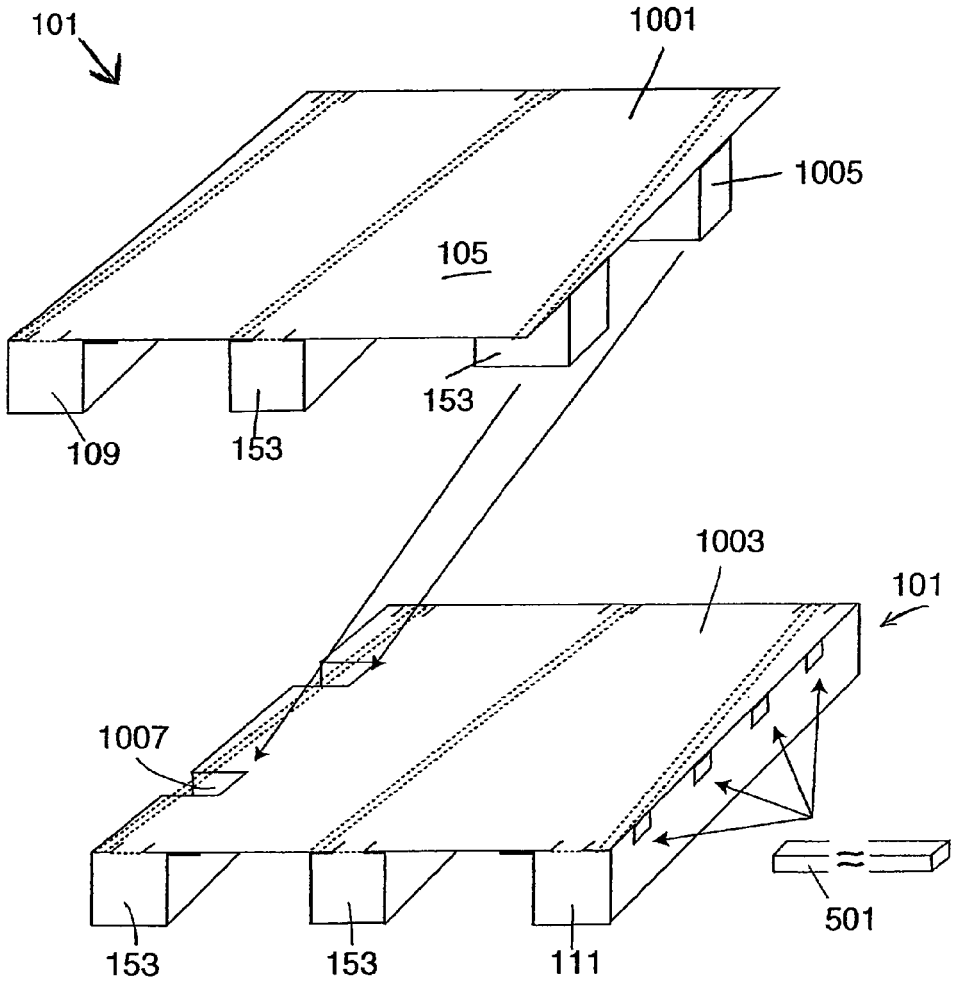
FIG. 35 shows a perspective view of yet another embodiment of an improved pallet including a locking and an enlargement feature that permits the unit to be organized in other arrangements to facilitate additional functionalities.

FIG. 35 shows the present invention with a locking and an extension feature. Multiple pallets, as in first pallet 1001 and second pallet 1003, can be interconnected by engaging a male protrusion 1005 down into a female receptacle 1007 each positioned within an auxiliary support beam 153. The male protrusion 1005 and female receptacle 1007 can be broken down flat along with the entirety of the pallet for ease of shipping and storage. The beams 109, 111, 153, when folded from the platform 105 into a vertical position, braces beams 109, 111, 153 into an open condition. The female receptacle 1007 is a rectangular recess. Similarly, the male protrusion 1005 may be a rectangular protrusion, which, when folded from the platform 105 into a vertical position is sized and shaped to interlock with the female receptacle 1007. Any beam 109, 111, 153, of course, may be provided with the locking feature such that multiple pallets 101 can be interconnected. Inserts 701 (as described generally with reference to FIG. 20) can be installed to provide support to each respective beam 109, 111. Inserts 701 may further include a rigid brace 709 (as described generally with reference to FIG. 20) for additional strength and support. The beams 109, 111 as well as the platform 105 may be further structurally supported by cross braces 501.

Figure 4:
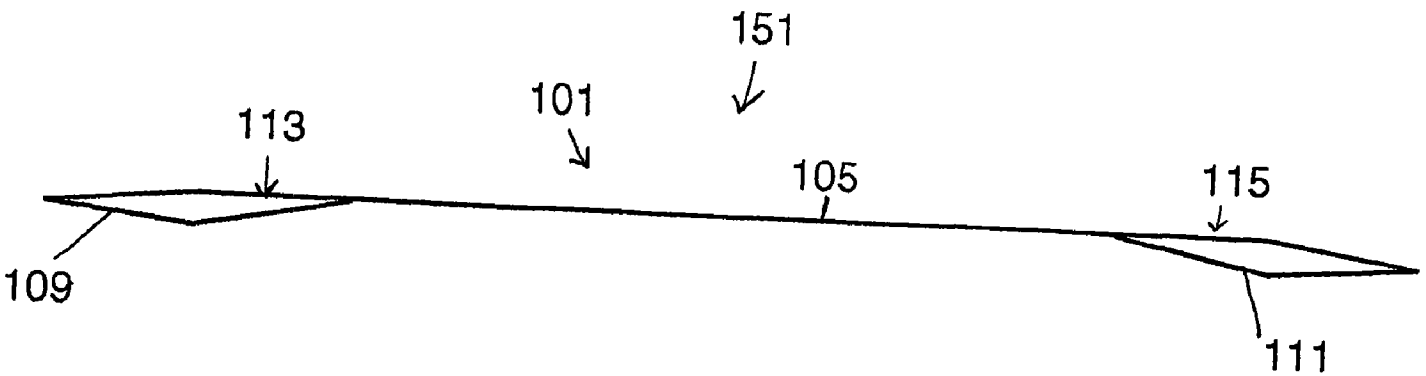
FIG. 4 shows an end view of the pallet of FIG. 1 in a contracted or flattened condition for shipping or storage.

In one example of operation, pallet 101 is provided in a compressed or unexpanded state 151 (See FIG. 4). Pallet beams 109, 111 are expanded to a state forming the pallet 101 shown in FIG. 1, for example, wherein each beam has a rectangular cross section. Each beam 109, 111 may be provided with a respective insert 701 assembled like that shown in FIG. 20. Cross braces 501 are inserted into side openings 417 (See FIG. 20) and the finished pallet 101 may be used. Advantageously, embodiments of the present invention permit the assembly process to be reversed so that the pallet 101 components of the pallet 101 can be largely separated from each other and be reversibly compressed into its initial flattened state 151.

Figure 36:
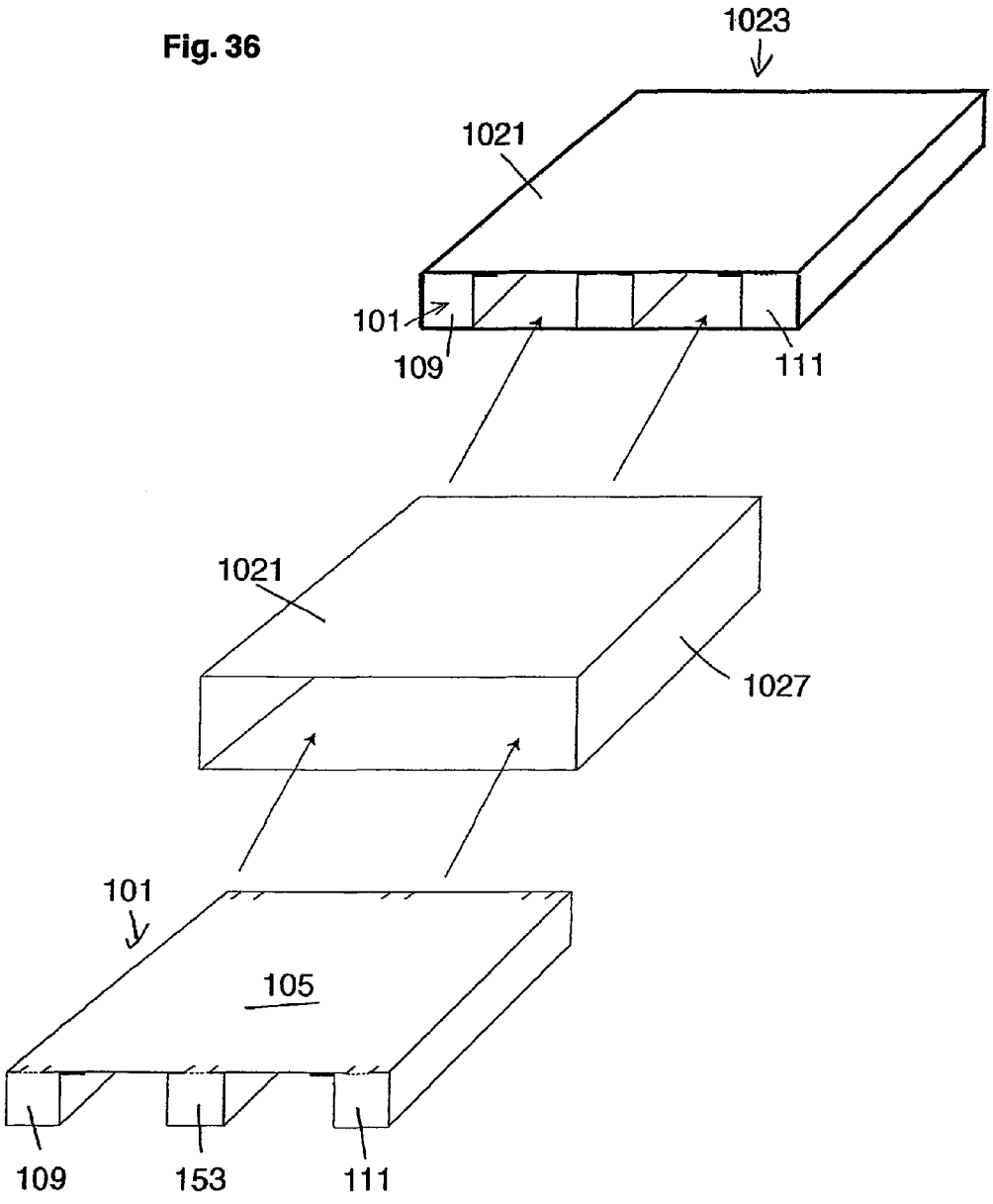
FIG. 36 shows a perspective view of yet another embodiment of an improved pallet including a sleeve so that the pallet may be reused.

A further embodiment of the present invention is shown in FIG. 36 and includes a sleeve 1021 that can be positioned around some portion of or the entire pallet 101. However, it will be understood that many or all of the novel pallets illustrated shown and described herein may be beneficially used with the sleeve 1021. The sleeve includes a top portion 1025 and a side portion 1027. The sleeve 1021 reinforces the top platform 105 as well as the beams 109, 153, 111. FIG. 18 shows a sequential drawing by which a sleeve 1021 is used to cover a pallet 101 to form a sleeve—covered pallet 1023. The top portion 1025 of sleeve 1021 generally abuts top platform 105 of pallet 101 and side portion 1027 generally abut beams 109, 111. Multiple sleeves 1021 can be added for additional support and added strength or to extend or join a surface of one or more pallets 101.

The protective sleeve 1021 preferably has a hollow rectangular shape positioned over and preferably snugly fitting around the pallet 101. The sleeve 1021 also reinforces the top platform 105 of the pallet 101 as well as provides additional overall structural support. The sleeve 1021 may be interchangeably fitted to more that one pallet 101 in case either sleeve or pallet is damaged, which is provided a cost savings or may be used with different pallets for reasons which will be described below.

The pallet 101 and sleeve 1021 may further each include a numbering configuration to prevent counterfeit or imitations from being used. The pallet 101 or sleeve 1021 may include RFID tags (not shown), holograms (not shown), bar coding (not shown), and/or other identification or tracking devices or combinations thereof (not shown), to convey tracking information or identification information as is known in the art. Tracking information may include shipment and delivery information, for example, or where the pallet with goods is located at any moment of time during shipment. Identification information includes the details about the load being transported or carried on the pallet, for example the product and manufacturer. Other functions of identification and tracking information, and so on, will be apparent to those with skill in the art.

Figure 37:
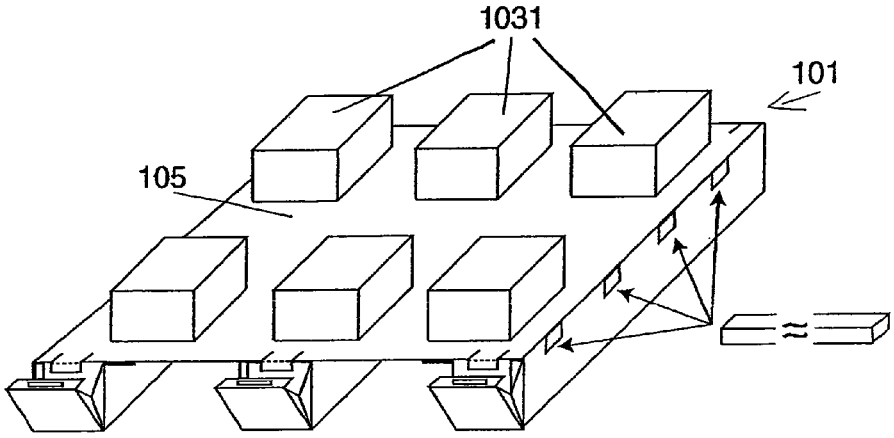
FIG. 37 shows a perspective view of yet another embodiment of an improved pallet including top structures such as components for display.
Figure 37:
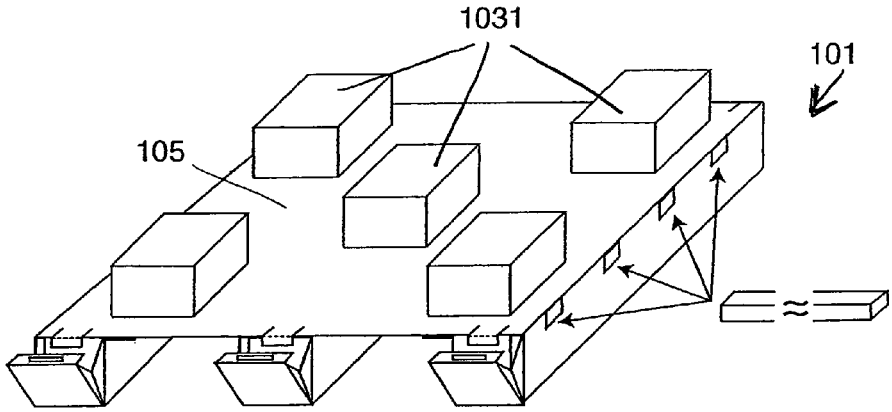

Various loads and configurations of structures 1031 can be mounted on the platform 105 as shown in FIG. 37 such as to improve the stability, securement and organization of the loads and articles (not-shown) placed on the platform of the pallet 105. The structures 1031 may be glued, or otherwise mounted to the platform 105. The structures can be arranged in any pattern and be of any shape to facilitate the positioning of the loads or the articles on the pallet 101.

Figure 38:
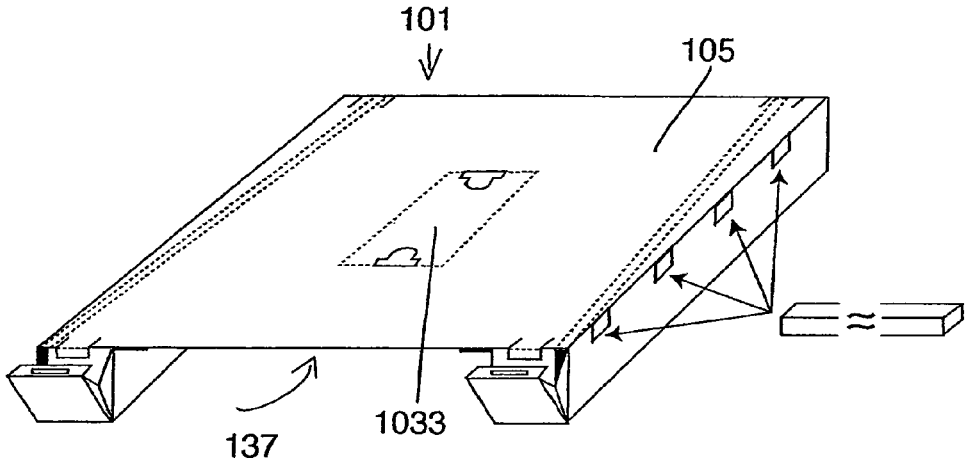
FIG. 38 shows a perspective view of yet another embodiment of an improved pallet including a stabilizer.

Another alternate embodiment to the auxiliary beam describe in reference to FIG. 38, is a stabilizer 1033 that may be added to the underside of the platform 137. As shown in FIG. 38, a stabilizer 1033 adequately distributes the load carried on the platform panel 105. The stabilizer 1033 can be of any shape or size. The stabilizer 1033 may be constructed of various materials including, wood, plastic, cardboard, fiberboard, rigid foam, fiberglass, carbon-fiber, composite materials and so on, capable of providing support to the platform panel of the pallet.

Figure 39:
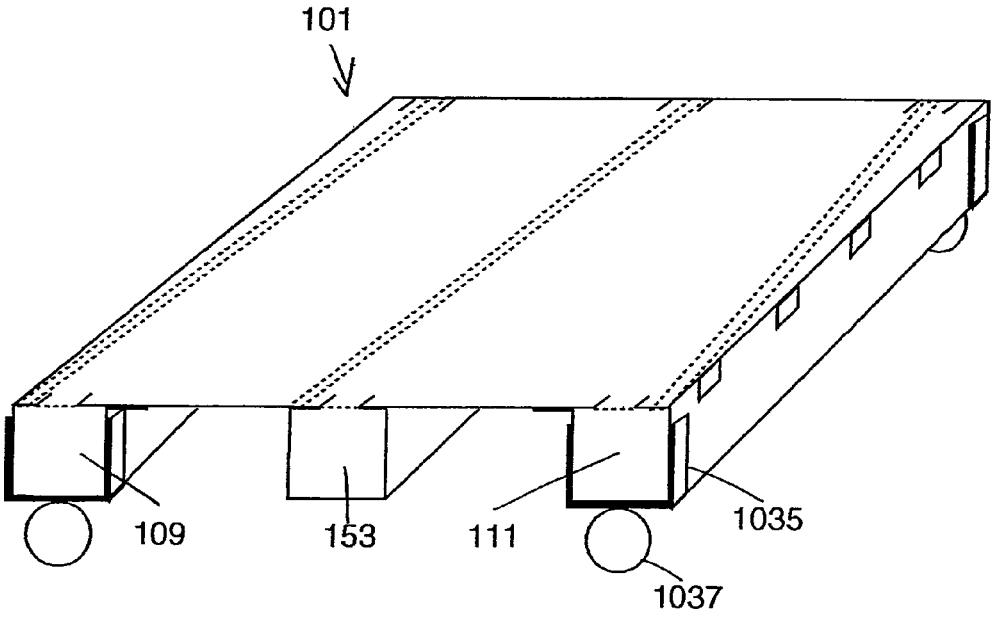
FIG. 39 shows a perspective view of yet another embodiment of an improved pallet including castors.

The pallets 101 are traditionally transported via a fork-lift. However, other components may be attached to the pallets 101 to facilitate their use. For example, wheels or castors 1037 may be placed on the beams 109, 153, 111 as shown in FIG. 39 for maneuverability of the pallet. The castors 1037 may attach to the pallet 101 such as through a U-shaped channel 1035 that is sized and shaped to fit securely over a beam 109, 111 and/or 153 (not shown).

Figure 40:
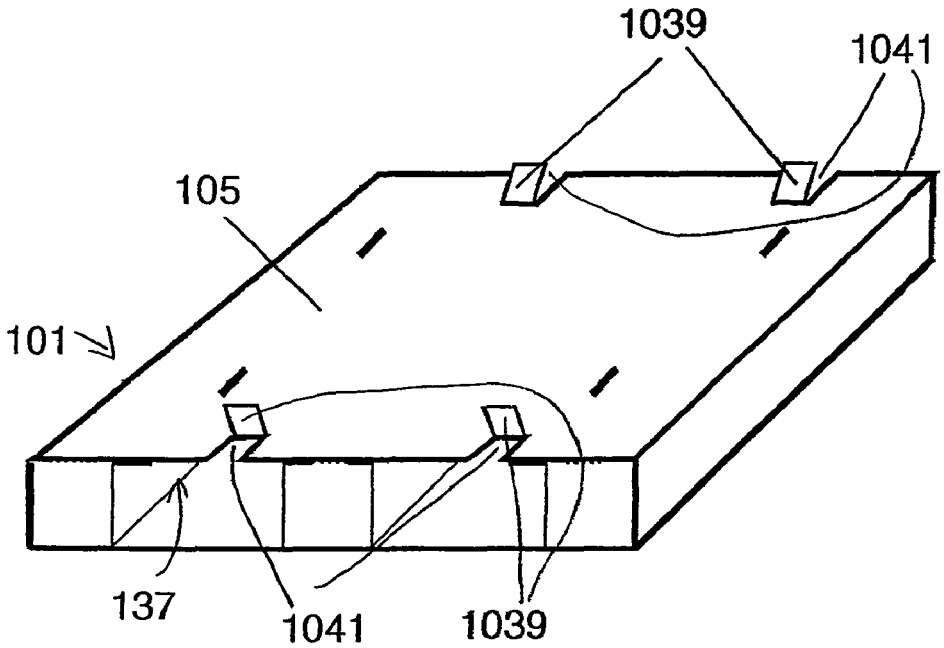
FIG. 40 shows a perspective view of yet another embodiment of an improved pallet including strapping tabs.

Additionally, it is contemplated the platform 105 may include tabs 1039 that create a cutout 1041 on the platform 105 of the pallet 101, as shown in FIG. 40, for applying and retaining straps (not shown) over articles (not shown) placed on the platform 105. The straps can be of any suitable material for securing loads such as articles placed on the platform 105, for example, nylon, elastic, or rubber. The straps may extend along the underside of the platform 137, through the cutout 1041 and over the articles on the platform 105.

It is understood that while the embodiments of the pallet shown in the figures are shown on as having a generally rectangular platform and one to three supporting legs, the pallet may be formed from components that provide a different sloped platform and for more than three supporting elements.

Furthermore, embodiments of the pallet may include insert components sized and shaped to enclose additional components for the assembly of the pallet or for storage by the user or customer. For example, the inserts may include desiccant bags to control moisture, be sized and shaped to permit bills of lading or identification or display elements, assembly tools, electric circuitry, tracking elements, magnet or other holding features, or measuring or scientific instrumentation.

The assembly of the platform from components that can be standardized permits the pallet to be certified as meeting given standards. Certification of the performance of the pallet is a distinct advantage and feature of the present invention. Details and examples of regulations related to wood and wood-derived packaging material can be gleaned from publications such as ISPM Pub. No. 15, dated March 2002. The present invention is intended to meet or exceed these regulations and all other relevant regulations or guidelines. If, for example, the pallet fails, due to components that do not meet the guaranteed performance, aspects of the pallet value may be reimbursed to the user.

Figure 41:
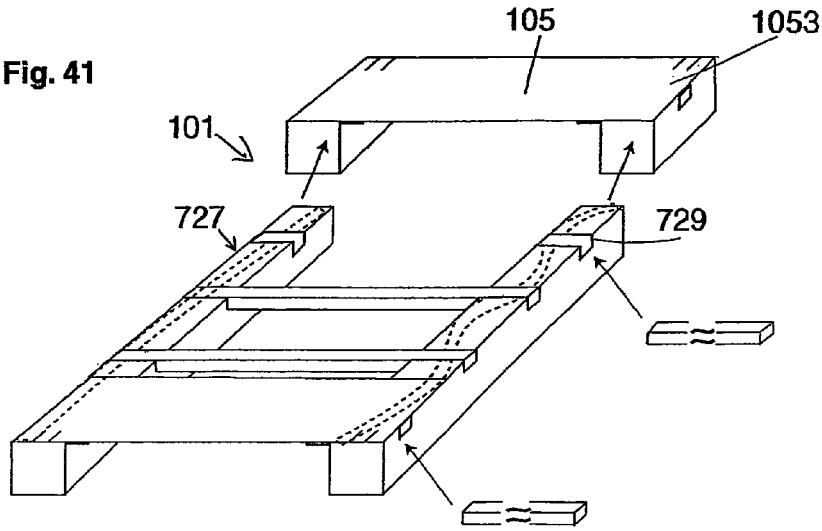
FIG. 41 shows perspective views of an additional embodiment that includes display elements which can unfold or be easily organized on a pallet base to achieve, for example, point of purchase objectives.
Figure 41:
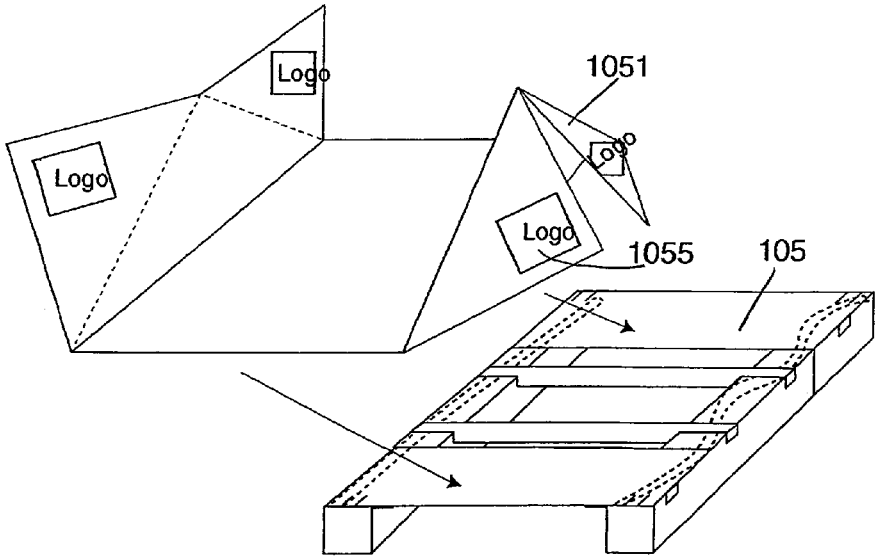

Another embodiment of the pallet 101 is shown in FIG. 41 and includes a display element 201 integratable as part of the platform 105. The inserts 727 of this embodiment are elongated with slots 729. The elongated inserts 727 of this embodiment permit the fitting thereon of a display element 1051 and an extension 1053 similar or identical in construction to that of pallet 101. The display element 1051 may be erected once the pallet 101 reaches its final display destination.

The display element 1051 may be confined by confinement elements—including plastic wrapping, (not shown)—and erected by tearing a perforation sealing of the display element 1051 such that the display element 1051 automatically erects into position. It is further contemplated the display element 1051 can be manually erected. The display element 1051 can be used as a point-of-purchase display that communicates display information 1055, such as advertising and so on, about product or articles (not shown) carried on the pallet. The display element 1051 may function as a structural part of the pallet 101 and disconnected therefrom to form a display (not shown) or as an additional panel or panels of material which are disconnected from the pallet before use as a display. Configurations of displays are well known in the art.

As has been shown above and provided in more detail below, aspects of the present invention are provided to add or increase a number of capabilities of a pallet in addition to reducing cost, weight, and environmental impact and so on. It will be recognized, based on the present application, that a pallet is not only a portable platform used for storing, packing, or moving cargo or freight, for example, but also a portable structure that can space items or be manipulated into various other functional structures such as a modular dance floor or advertising display or a kiosk, to name a few examples.

In terms of construction, pallets of the present invention can be easily assembled by hand, but are more efficiently assembled by machine in an automated process. It will be understood that automated assembly of the pallet saves time and reduces cost while providing control of quality. Automated assembly offers various options during the assembly of the pallet—for example, the addition of waterproofing chemicals, paint, water resistant or anti-static chemicals applied to the pallet during assembly all of which are contemplated by the present invention. For example, a waterproofed or water resistant pallet is ideal for storing goods off the floor in the event of moisture or flooding. Automated assembly may also seal the ends of the tubes, eliminating the need for end-caps or other closure type mechanisms to provide an aesthetic appeal by eliminating the exposure of the internal structure of the pallet. Automated assembly may further include the attachment of tracking devices, e.g., tags or labels, and including RFID devices, or hologram or other images, to convey tracking or identification information and other indicia or information as is known in the art. Tracking information includes shipment and delivery information, for example, where the pallet with goods is located from the shipment location to the delivery location. Identification information includes the details about the load being transported or carried on the pallet, for example the product and manufacturer. Instructional information or directions explaining the functionality of spacing items or manipulation of the pallets into various functional structures can also be integrated with the pallet during machine assembly. It is further contemplated that the machine assembly may include in-line printing and die cutting options.

Another embodiment of the pallet 101 is shown in FIG. 42 and includes a display element 1075 integratable as part of the platform 105 to form a container 1077. The display element 1075 may be erected once the pallet 101 reaches its final display destination.

The display element 1075 may be erected automatically or manually into position. The display element of FIG. 42 includes a front sheet 1079, a rear sheet 1081, two side sheets 1083, 1085 each with an inner surface 1087 and an outer surface 1089. The inner surfaces of each sheet create an interior space, a container 1077. The container 1077 encases goods 1071 and can be used as a point-of-purchase display.

The outer surfaces 1089 of each sheet 1079, 1081, 1083, 1085 can have display information 1055, such as advertising 1057. The side sheets 1083, 1085 have an extension sheet 1091 attached at fold line 1093. The extension sheet 1091 folds downwardly to conceal the beam ends 167, 169 for aesthetic appeal and also functions to prevent dirt and dust from collecting under the pallet 101. Although, the front sheet 1079 and rear sheet 1081 likewise may include an extension sheet. The outer panel 129 itself may include display information 1055, thus eliminating the use of extension sheets on the front sheet 1079 and rear sheet 1081.

Figure 43:
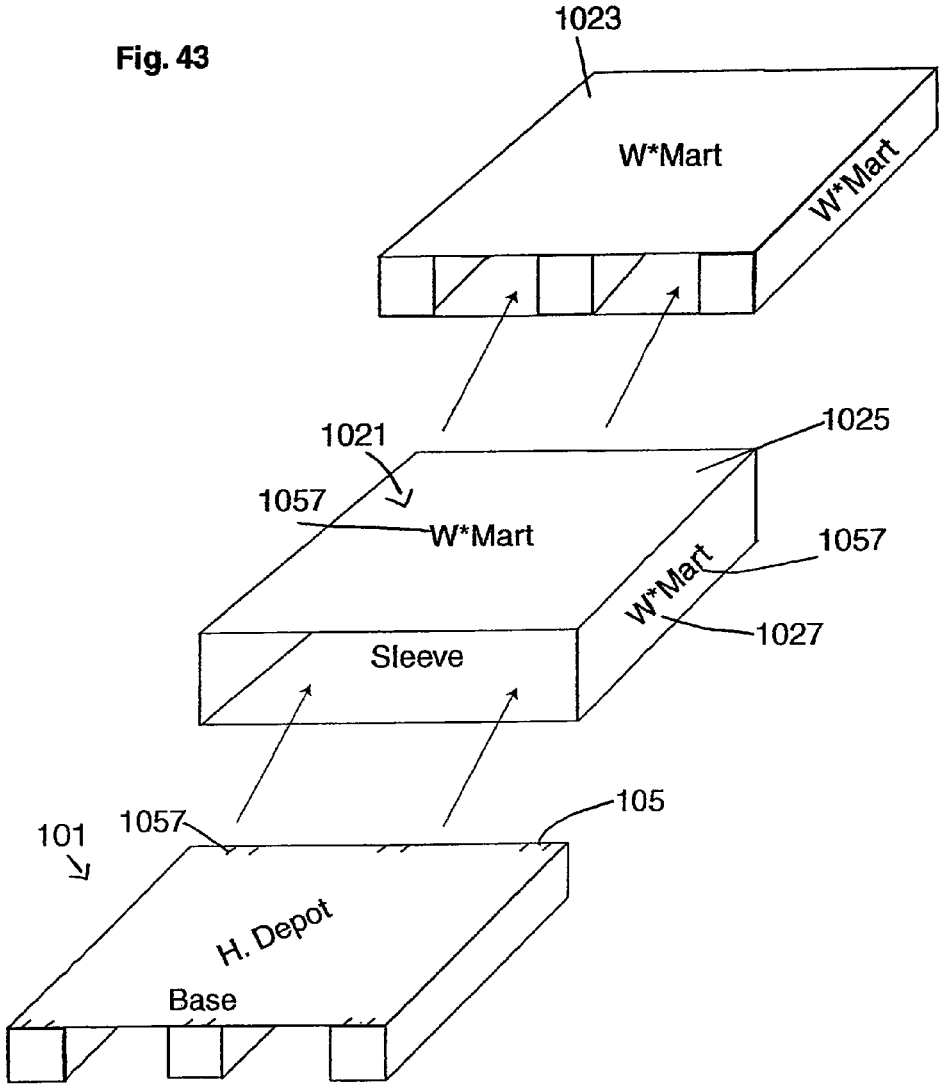
FIG. 43 shows a pallet according to one embodiment of the present invention combined with a protective sleeve according to another embodiment of the present invention.
Figure 44:
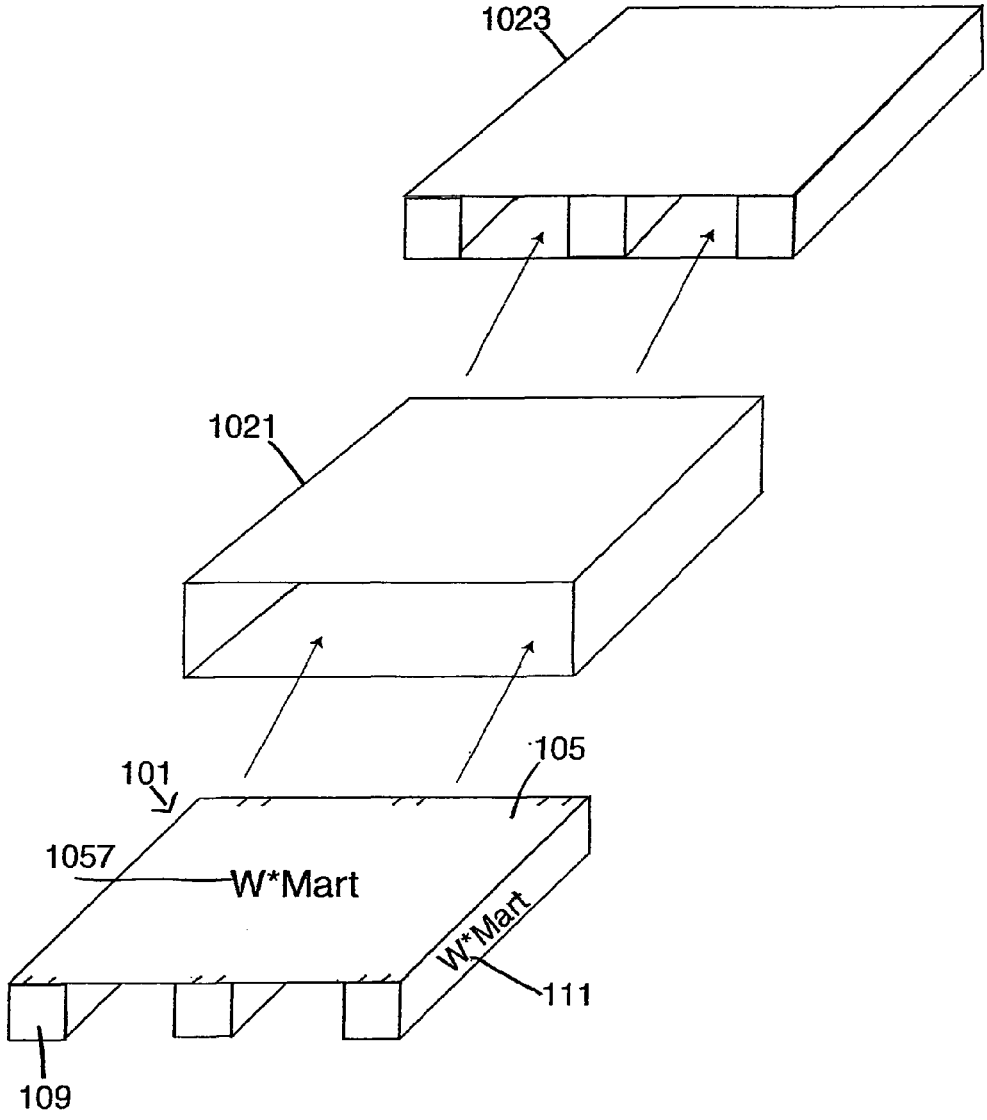
FIG. 44 shows a pallet according to one embodiment of the present invention combined with a protective sleeve according to another embodiment of the present invention.

As shown in FIG. 43, the pallet 101 may include advertising or marketing information 1057 in addition to other above-described information. Marketing and advertising information can be located anywhere on the sleeve 1021, such as, for example, a top portion 1025 or a side portion 1027 of sleeve 1021. FIG. 44 also illustrates an alternative embodiment with the advertising or marketing information 1057 on the pallet top platform 105 (See also FIG. 43) and beam 111 of the pallet 101 itself.

Figure 45:
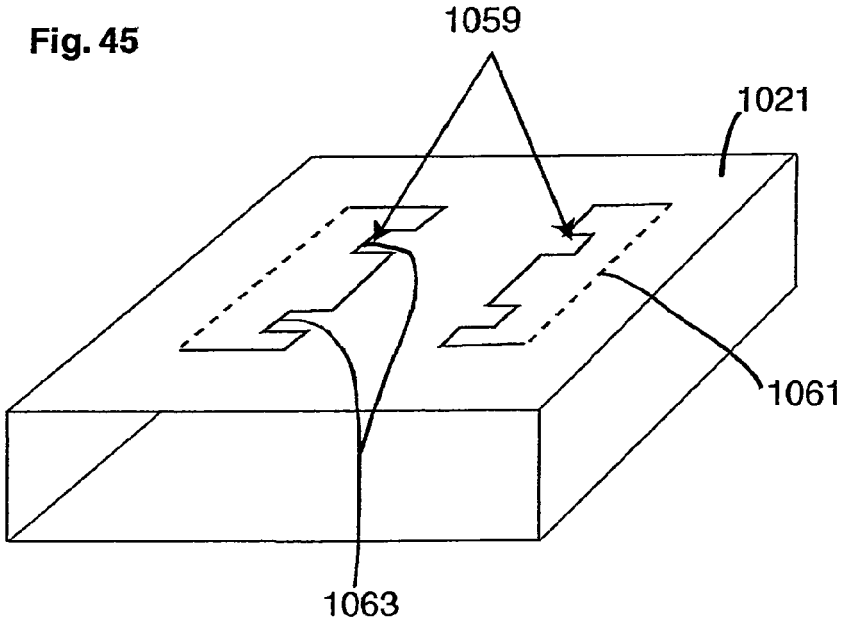
FIG. 45 shows one embodiment of a sleeve with a cutout for stabilization of pallet cross-braces.

FIG. 45 shows a sleeve 1021, like that shown in FIG. 36 with a pair of brace sections 1059 to stabilize pallet cross braces 501 (see FIG. 20, for example). The brace sections 1059 are folded along a fold line 1061 such that the brace sections 1059 can be folded downwardly. The brace sections 1059 each include rectangular shaped channels 1063 that, when engaged with the cross braces of a pallet 501 (see FIG. 20, for example), function to prevent the cross braces 501 from moving. The channels 1063 preferably securely fit with the cross braces 501.

Figure 46:
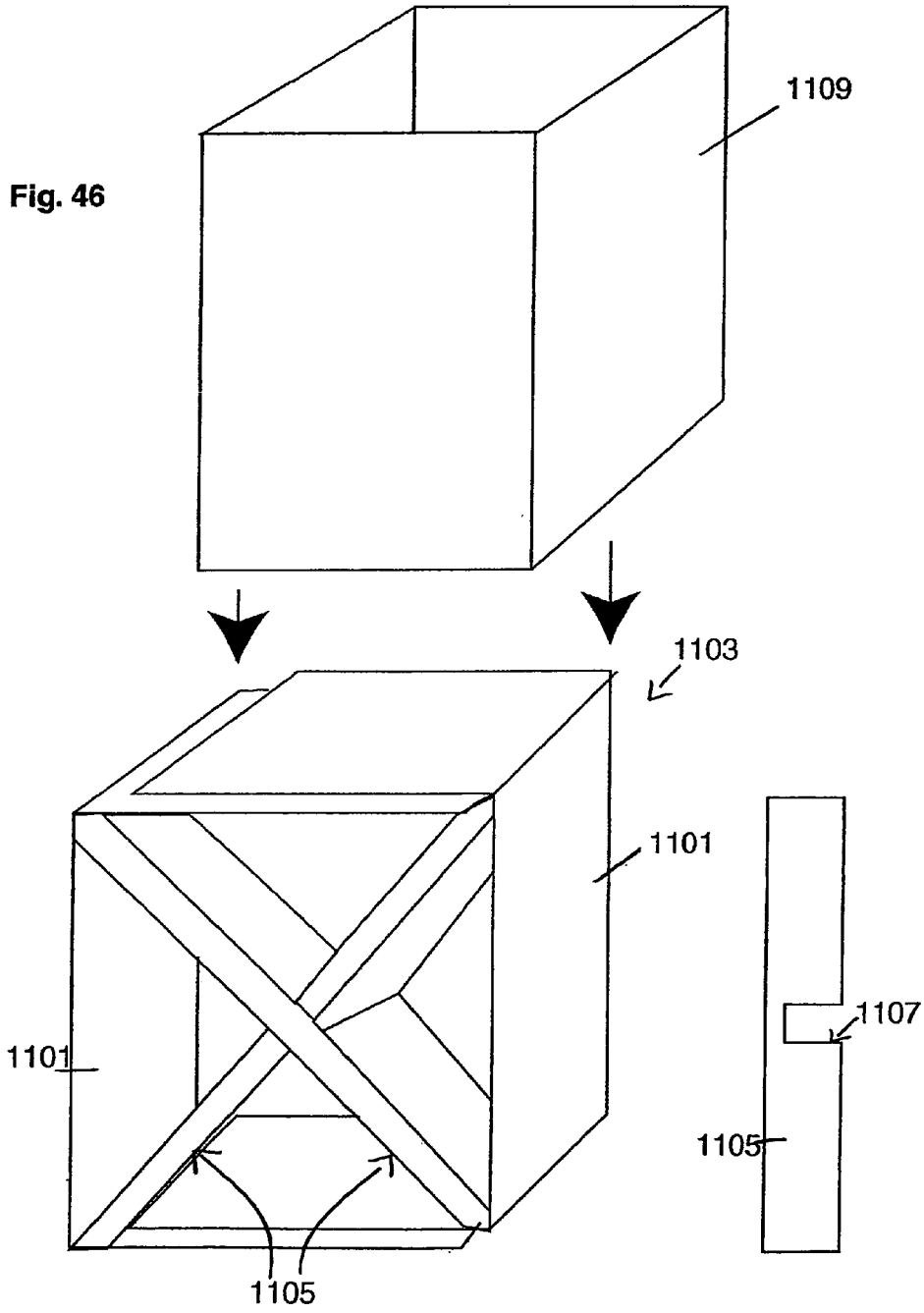
FIG. 46 shows a one embodiment of a pallet transformed into a rigid structural support or display.

As shown in FIG. 46, one or more single material sheet, shown at 1101 can be transformed into a rigid structural support 1103 or display. The support 1103 can space items or be manipulated into various other functional structures such as a modular dance floor or advertising display or kiosk (not shown). Two of the sheets 1101 are formed into a U-shape and interconnected as shown. Two reinforcing members 1105 interlock via slots 1107 located approximately in the middle of each wood plank. The reinforcing members 1105 may be wood planks, for example, or any suitably strong member. The reinforcing members 1105 are placed between the U-shaped main sheets 1101 such that they are assume a configuration similar to an "X". A sheath 1109 which is hollow and rectangular is slidably positioned over the U-shaped main sheets 1101 and reinforcing members 1105.

Figure 47:
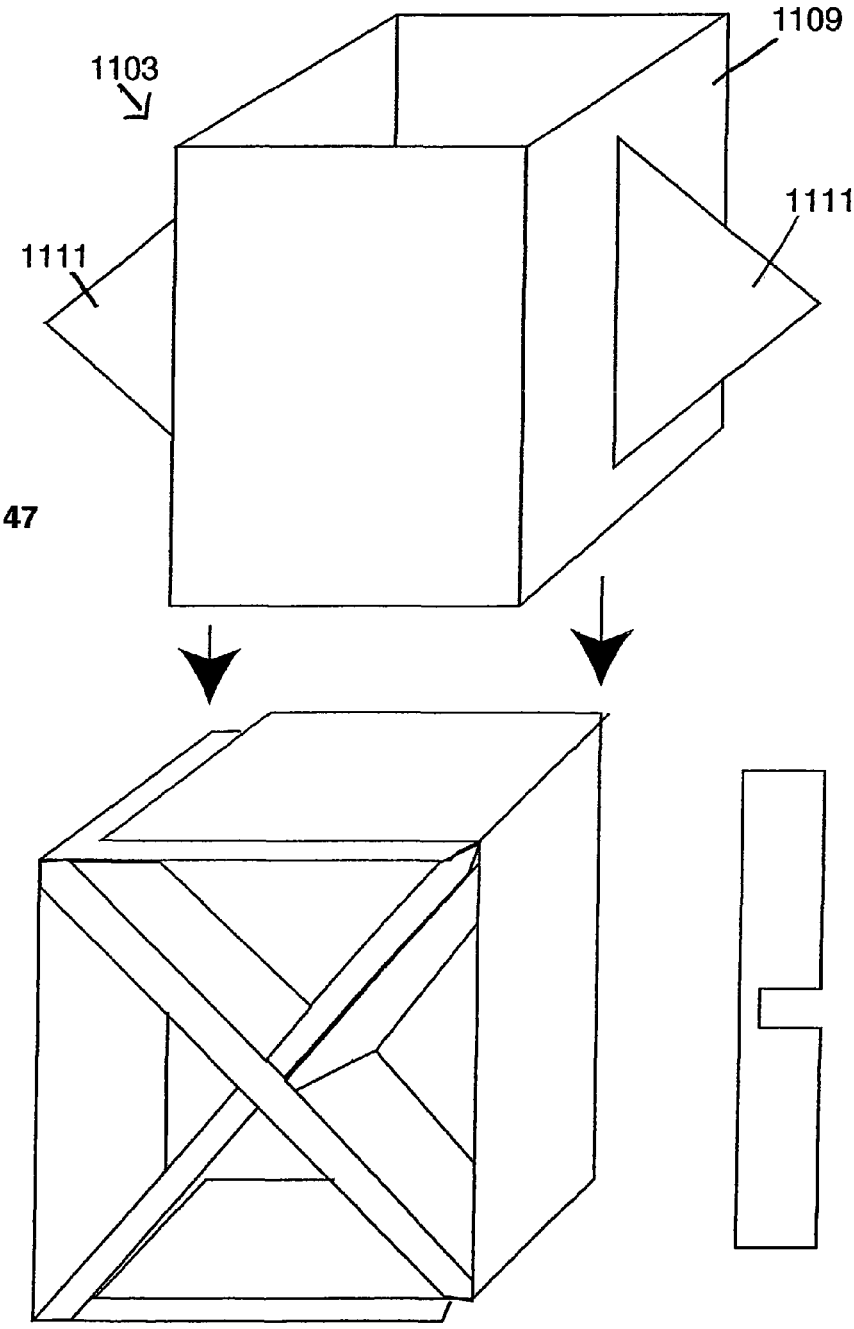
FIG. 47 shows an alternate embodiment of a pallet transformed into a rigid structural support or display.
Figure 48:
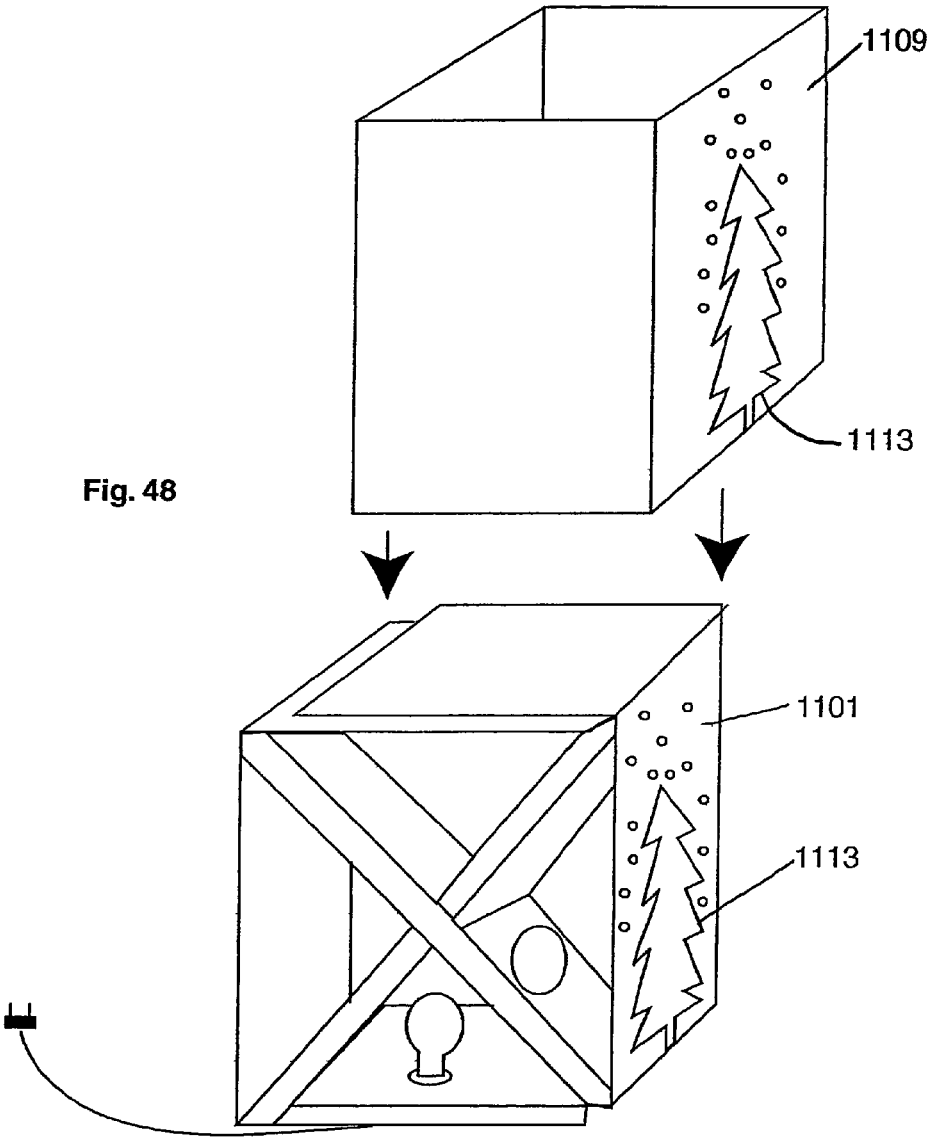
FIG. 48 shows the rigid structural support or display of FIG. 47 with additional features.

FIG. 47 depicts another embodiment of a display 1103, similar that shown in FIG. 46 wherein the display includes 2-dimensional or 3-dimensional extensions 1111 positioned on a sheath 1109 for use in providing an area for advertising and/or marketing. As shown in FIG. 48, either or both of the U-shaped main sheets 1101, in addition to the sheath 1109, can include printed logos or designs 1113. The design 1113 can also be transparent or translucent such that it emanates the design or logo when a light source 1115 is positioned within the sheets 1101.

Figure 49:
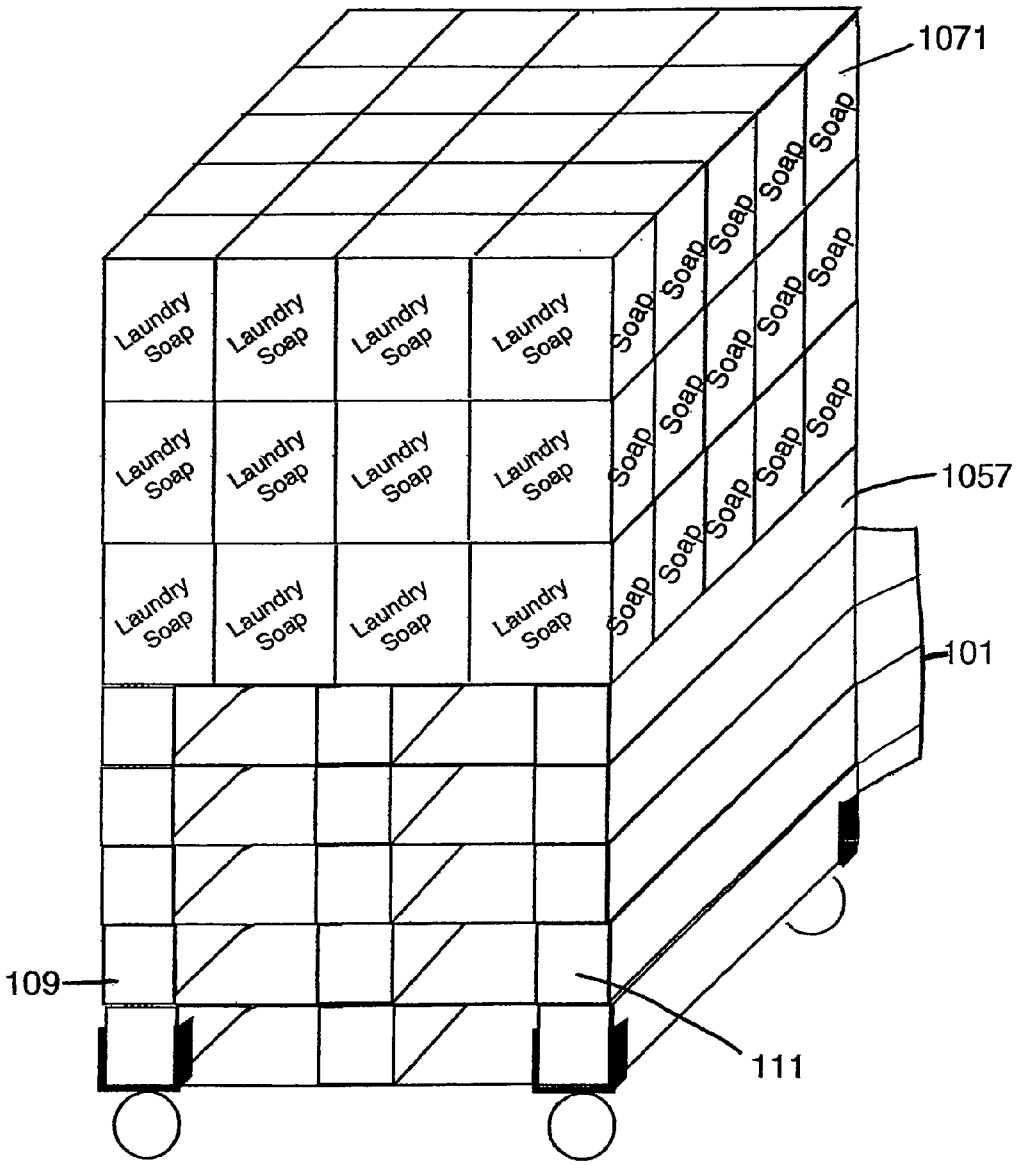
FIG. 49 shows the use of a plurality of one embodiment of a pallet according to the present invention used as a rigid structural support or display.

FIG. 49 shows a display of pallets 101 stacked upon one another. The beams 109, 111 of the pallet 101 or a sleeve (not shown) that is positioned over the pallets include information and/or advertisements 1057. Multiple pallets 101 can be stacked upon on another to provide a rigid base. Packaged goods 1071 can be placed on top of the stacked pallets 101 for display and/or sale.

Figure 50:
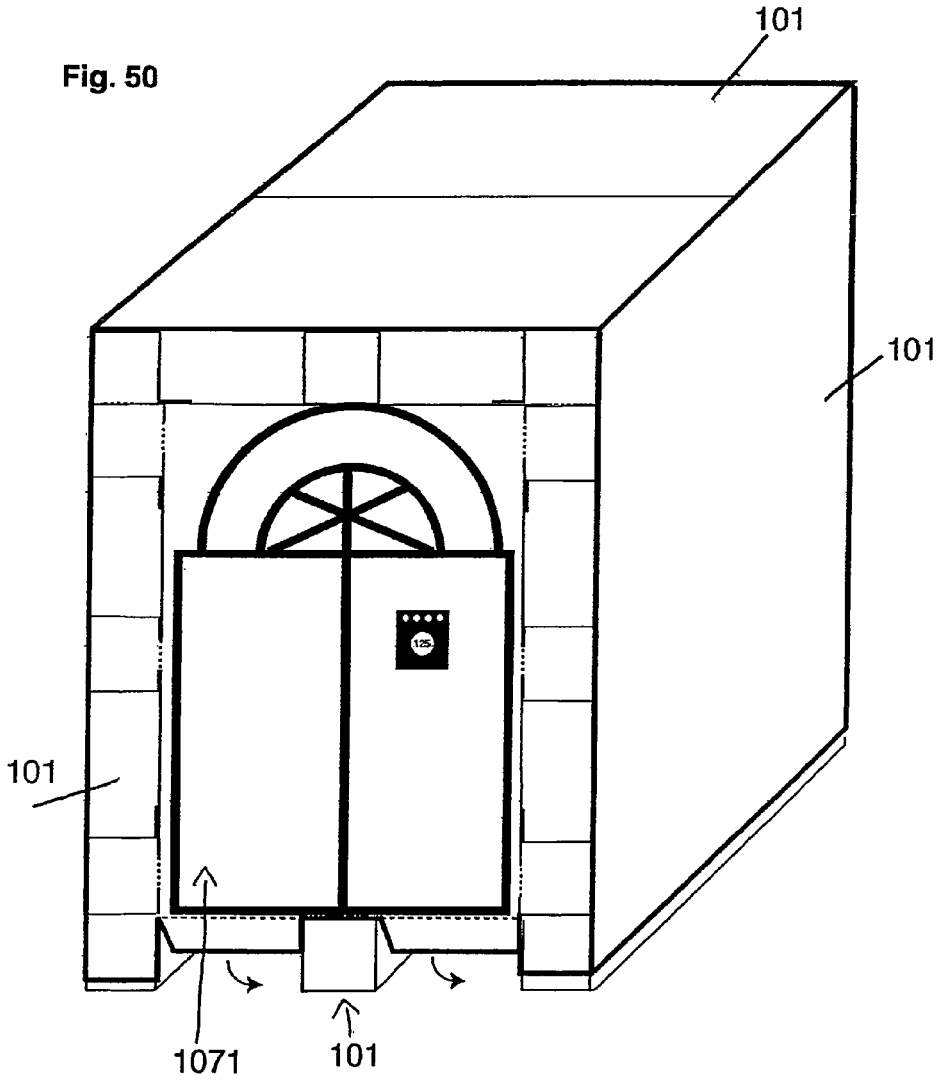
FIG. 50 shows the use multiple pallets of the present invention for protection or packaging of items for transport or shipping.

FIG. 50 shows multiple pallets 101 for protection or packaging of items 1071 for transport or shipping. The pallets 101 can be used to pack secure and/or protect a product by arranging a plurality of pallets on all sides and surfaces of a product 1071. The entire arrangement of pallets 101 and product(s) 1071 may be wrapped with a conventional plastic film (not shown) designed for wrapping products on pallets to secure the contents thereof.

FIG. 51 is an alternate embodiment of use of multiple pallets 101 for protection or packaging of items for transport or shipping. As shown, the pallets 101 are used as void fillers. A void filler is used to occupy un-used space to prevent existing contents or product from shifting during transport. Thus, the product shipped is protected in all directions.

Figure 52:
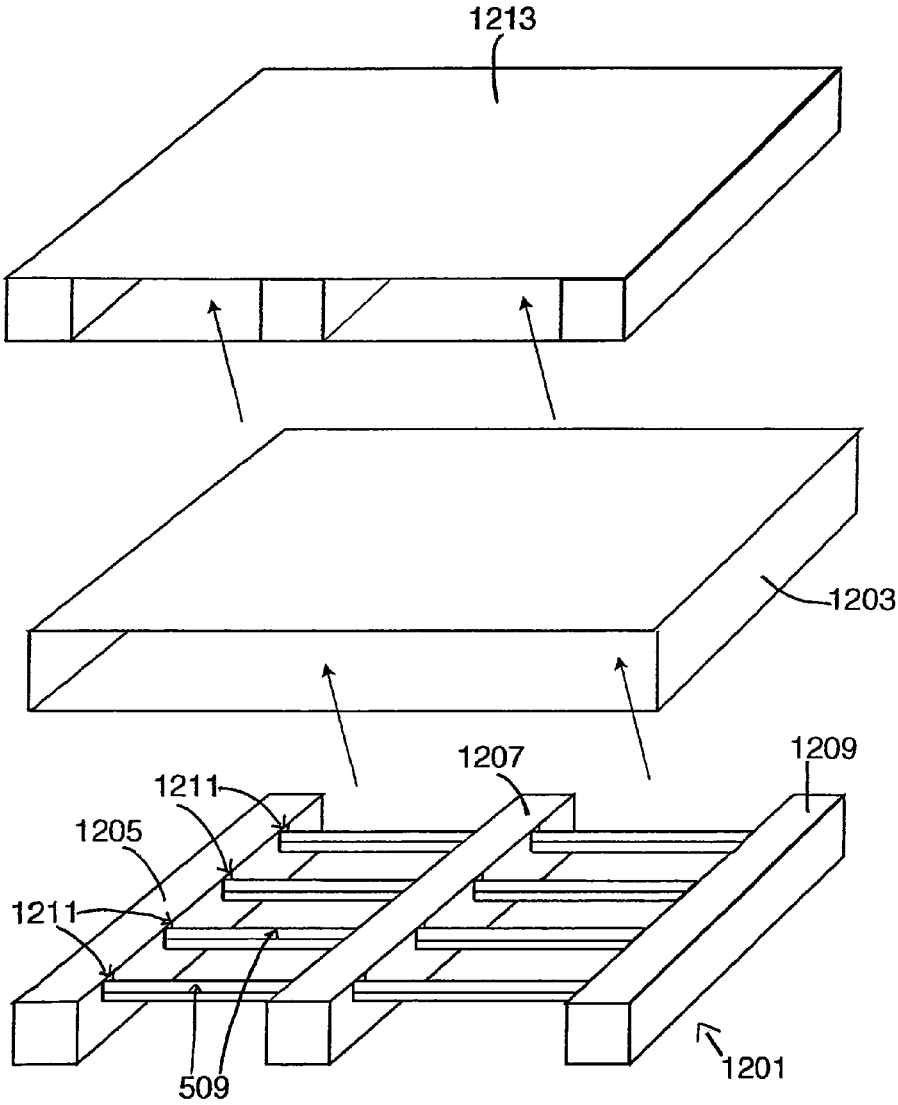
FIG. 52 shows yet another embodiment of a pallet and sleeve combination.

FIG. 52 is a pallet 1201 and sleeve 1203 combination according to an alternate embodiment of the present invention. The pallet 1201 includes a left beam 1205 and a right beam 1209 spaced from the left beam. The pallet 1201 includes a center beam 1207 spaced from and between the left beam 1205 and the right beam 1209. Each of the beams 1205, 1207 and 1209 are generally rectangular. Each of the beams 1205, 1207 and 1209 include a plurality of openings 1211 spaced to receive an equal number of cross braces 509. The combined beams 1205, 1207 and 1209 and cross braces 509 are inserted into a sleeve 1203, which is sized and shaped to receive the assembled pallet 1201 of beams 1205, 1207 and 1209 and cross braces 509 to form assembled pallet 1213.

Figure 53:
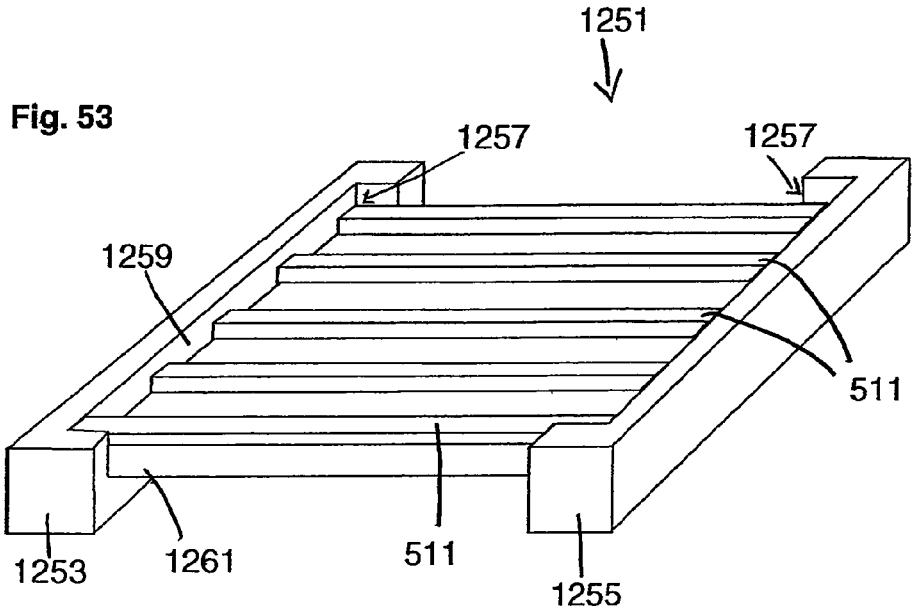
FIG. 53 shows yet another embodiment of a pallet according to the present invention.

FIG. 53 shows a pallet 1251 according to an alternate embodiment of the present invention. The pallet 1251 includes a left beam 1253 and a right beam 1255 spaced from the left beam 1253. Each of the left and right beams 1253, 1255 include an inner shelf 1257 defined by an inner, upper vertical panel 1259 and a horizontal panel 1261. A plurality of spaced cross braces 511 are positioned on the horizontal panel 1261 and span from the inner shelf 1257 of the left beam 1053 to the inner shelf 1257 of the right beam 1255.

Figure 54:
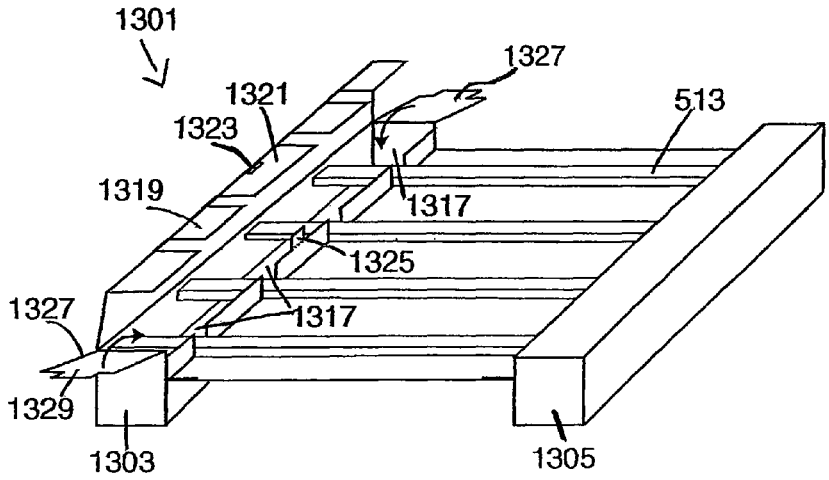
FIG. 54 shows yet another embodiment of a pallet according to the present invention.
Figure 54:
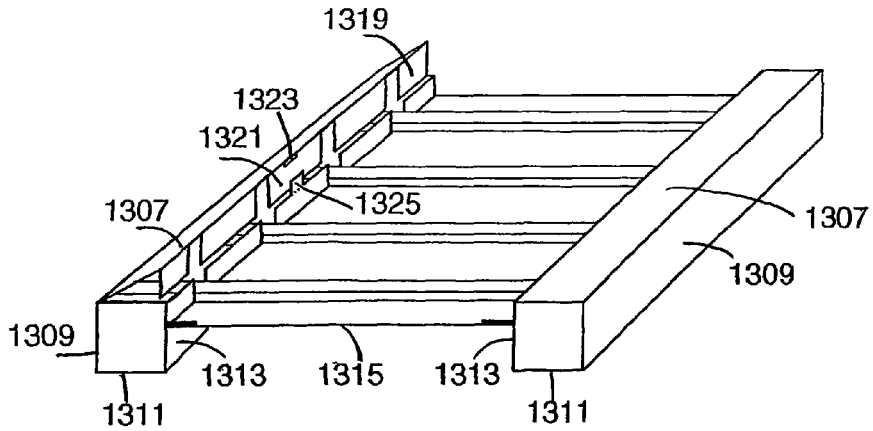

FIG. 54 shows a pallet 1301 according to yet another alternate embodiment of the present invention. The pallet 1301 includes a left beam 1303 and a right beam 1305 spaced from the left beam 1303. Each beam 1303, 1305 includes an upper panel 1307 an outer panel 1309, a lower panel 1311 and an inner panel 1313. A platform 1315 extends between the left beam 1303 and the right beam 1305 and supports a plurality of cross braces 513 thereon. The cross braces 513 insert into the beams 1303, 1305 through inner panel beam openings 1317. Each of the upper panels 1307 include a plurality of spaced tabs 1319, which interlock with the cross braces 513 and fasten inside respective beams 1303, 1305 adjacent respective inner walls 1313. A middle tab 1321 includes an opening 1323 which locks a respective upper panel 1307 when a tooth 1325, which is positioned on respective inner panels 1313 so as to insert into the opening. Additionally, a pair of opposed end flaps 1327 are provided to each of the left and right beams 1303, 1305 and include tabs 1329, which fold into the beams for added support.

Figure 55:
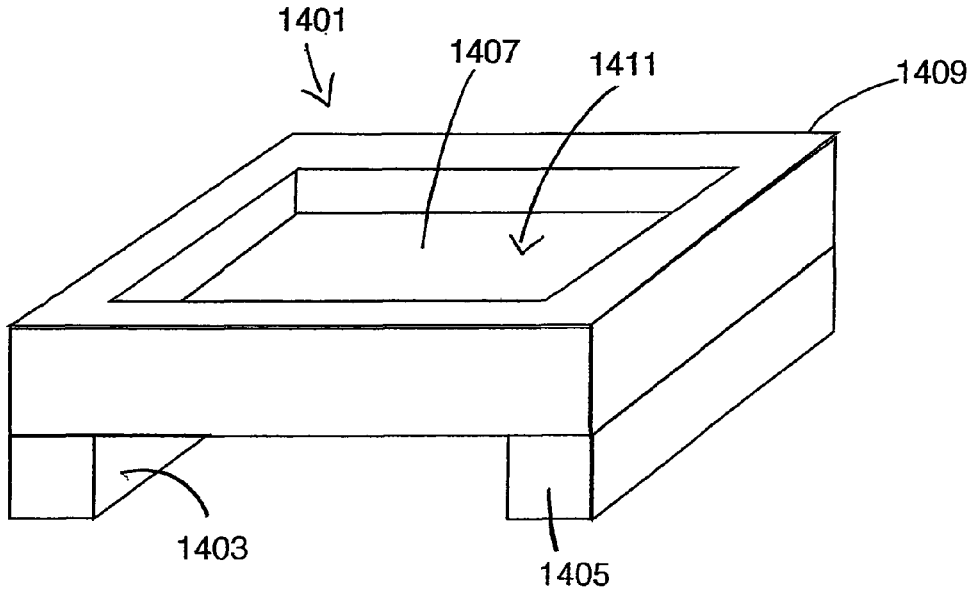
FIG. 55 shows yet another embodiment of a pallet according to the present invention.

FIG. 55 shows another embodiment of a pallet 1401 with a first beam 1403 spaced and parallel to a second beam 1405 for supporting the pallet. Spanning the distance between the first and second beam 1403, 1405 is a platform 1407 which serves to support any product, materials, good, etc., placed thereon for storage, transportation and/or display purposes. The pallet 1401 includes a generally rectangular bumper or wall 1409 on a periphery of the platform 1407 and defining with the platform a basket or well 1411. Product (not shown) which is placed in the well 1411 is cushioned and/or protected. So it can be seen that the pallet 1401 is particularly suited for the storage and/or transportation of fragile, crushable, or otherwise impact or abrasion sensitive packages, materials or items such as glass or food, for example.

Figure 56:
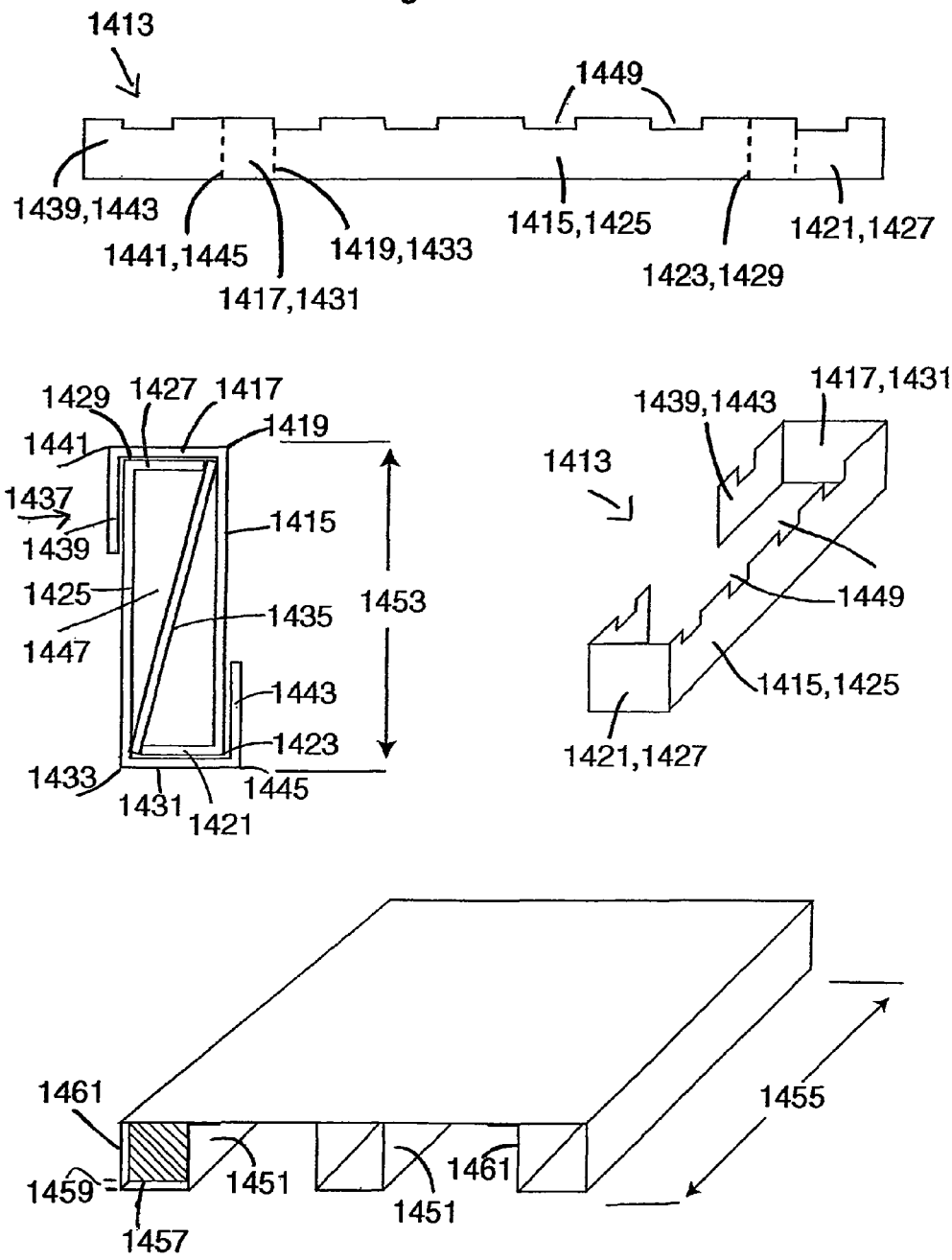
FIG. 56 shows yet another embodiment of a pallet according to the present invention.

FIG. 56 illustrates an insert embodiment similarly described above in reference to FIGS. 29*e-h*. In contrast to FIGS. 29*e-f* described above, the insert members 1415, 1425, not only each have a first flap 1421, 1427 and second flap 1417, 1431, but also includes arm flaps 1439, 1443.

Insert members are formed from one continuous sheet 1413, diagrammatically shown in FIG. 56. The first member 1415 includes a flap 1417—that is folded perpendicularly along a fold line 1419—and a flap 1421—that is folded along a fold line 1423 such that flap 1417 is parallel to flap 1421. The second member 1425 includes a flap 1427—that is folded perpendicularly along a fold line 1429—and a flap 1431—that is folded along a fold line 1433 such that flap 1427 and flap 1431, respectively, are parallel to each other as shown in the diagrammatic perspective representation of FIG. 56.

Once the brace 1435 is positioned within the insert 1437, the first member 1415 and the second member 1425 may be engaged such that flap 1427 abuts inside flap 1417 and flap 1431 abuts outside the flap 1421. The arm flap 1439 of the first member 1415 is folded perpendicularly along fold line 1441 and may be engaged such that flap 1439 abuts outside the second member 1425. The arm flap 1443 of the second member 1425 is folded perpendicularly along fold line 1445 and may be engaged such that flap 1443 abuts outside the first member 1415. The flaps of the first member 1415 and the second member 1425 can be secured to one another mechanically or with an adhesive such as glue such that the brace 1435 is contained within the opening 1447. Sheet 1413 may further include slots 1449 that allow cross braces (not shown) to be passed through subsequent to the positioning of the assembled insert 1437 into the beams 1451.

The length 1453 of the insert 1437, once assembled, is less than the length 1455 of beams 1451 such that the end 1457 of the insert 1437 is a distance 1459, for example ⅜", from the end 1461 of the beam 1451. Positioning the insert 1437 a distance 1459 from the end 1461 of the beam 1451 prevents the inserts 1437 from direct contact with moisture and further eliminates the use of a locking feature 158 as described in reference to FIG. 23.

Figure 57:
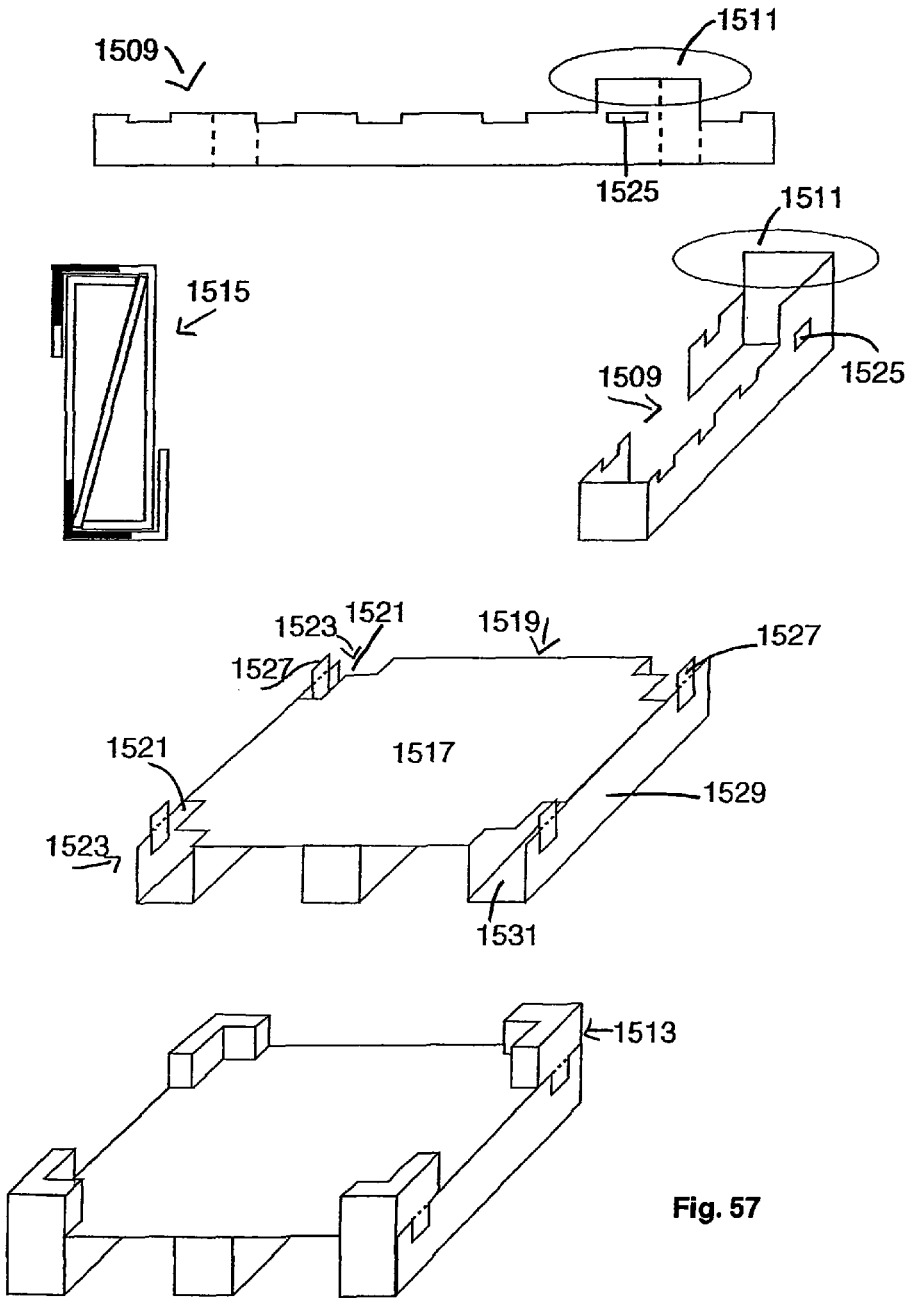
FIG. 57 shows the embodiment of a pallet of FIG. 56 with additional features.

FIG. 57 shows the embodiment of a pallet of FIG. 56 with additional features. Insert members 1515 are formed from one continuous sheet 1413, diagrammatically shown in FIG. 57, and are constructed in the same manner as described in reference to FIG. 56. Sheet 1413 has a raised area 1511 that forms a bumper 1513, or raised cushion, of the insert 1515.

Top platform 1517 of pallet 1519 includes L-shaped cutouts 1521 for receiving the raised surface 1511 of the assembled insert 1515 to form a bumper 1513. Sheet 1413 further includes a punch 1525 for receiving tab 1527 of the pallet 1519. Tabs 1527 extend from the outer surface 1529 of beam 1531. Once the insert 1515 is positioned within the beam 1531, tab 1527 is engaged into punch 1525 to secure the insert 1515, with bumper 1513 into place. The bumpers 1513 protect the corners 1523 of the pallet 1519 and further secure items carried on the top platform 1517.

Figure 58:
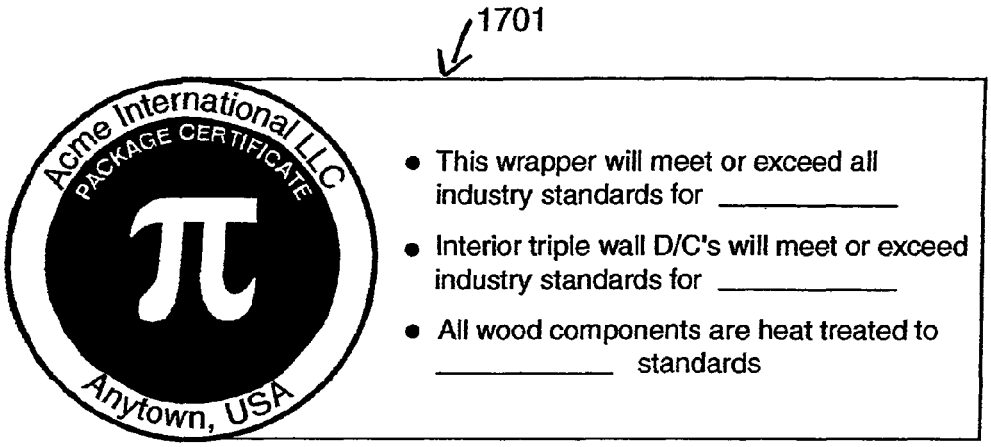
FIG. 58 shows a certification stamp, or package certificate stamp, positionable on a pallet.

FIG. 58 shows a certification stamp, or package certificate stamp, positionable on a pallet. As shown in FIG. 58, a certification stamp 1701 may convey a variety of information, for example, compliance with industry standards and/or structural data information, for example maximum crush resistance, vibration sustainability and packaging treatment such as heat treated. It is contemplated a variety of information may be communicated on the package certificate stamp. The certification stamp 1701 can be placed directly on the pallet.

Figure 59:
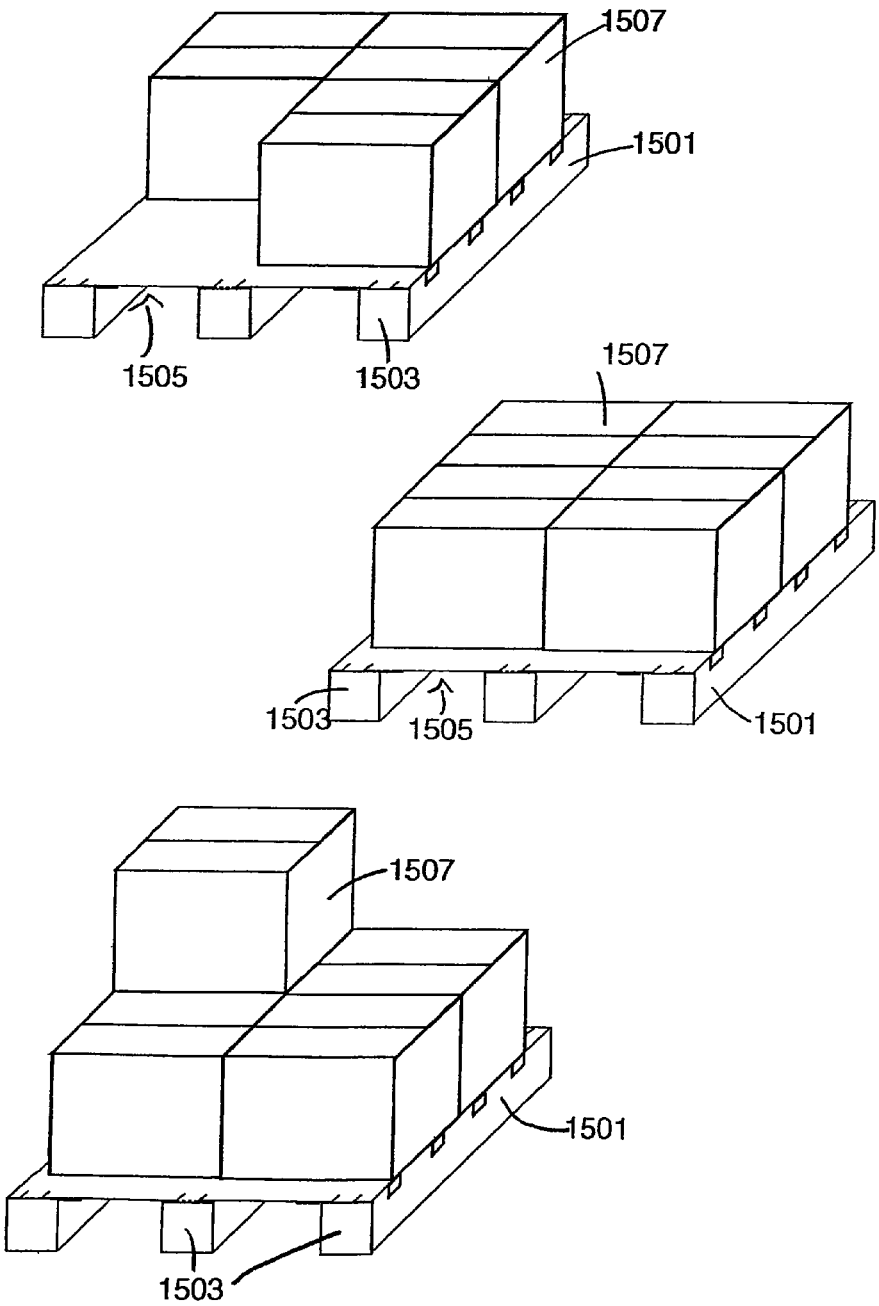
FIG. 59 show an embodiment of a pallet similar to that shown in FIG. 15 with product positioned thereon and employing RFID technology.

FIG. 59 shows a pallet 1501, like that shown in FIG. 15, and containers 1507 of product. Each pallet 1501 in FIG. 59 includes a tracking device, e.g., a RFID (not shown) or an equivalent thereof. The RFID (not shown) can be located in a beam 1503 or a compartment (not shown) formed in the beam. Likewise, the RFID (not shown) may be positioned in a layer of the material of the pallet or on the bottom surface 1505 of the pallet.

Each pallet 1501 includes containers 1507 with RFID (not shown) tracking devices. Each of the pallet 1501 and container 1507 RFID tracking devices include coding, programming or some electronic record which may relate the number and contents of the containers to the pallet for purposes of managing inventory and/or tracking the containers during transit and storage. For example, the pallet 1501 of FIG. 59 may include multiple containers 1507, for example three. So the RFID in the pallet includes a code which records that there are three containers loaded thereon in addition to a unique identifier which only applies to that set of boxes. Each unique pallet code will contain information related to all of the containers thereon including the number of containers and the identity of each of the boxes. And the RFID and code in each of the containers relates the pallet to which it belongs and any other containers.

Likewise, each container 1507 will include a RFID for identifying each container and relating the container to the lot of containers included on a particular pallet. This way, each container 1507 is related to a particular pallet 1501. An example of such a code is where a first field of code identifies a client, a second field of code provides a unique container or lot identity, and a third field of code identifies the total number of boxes on the pallet.

Figure 60:
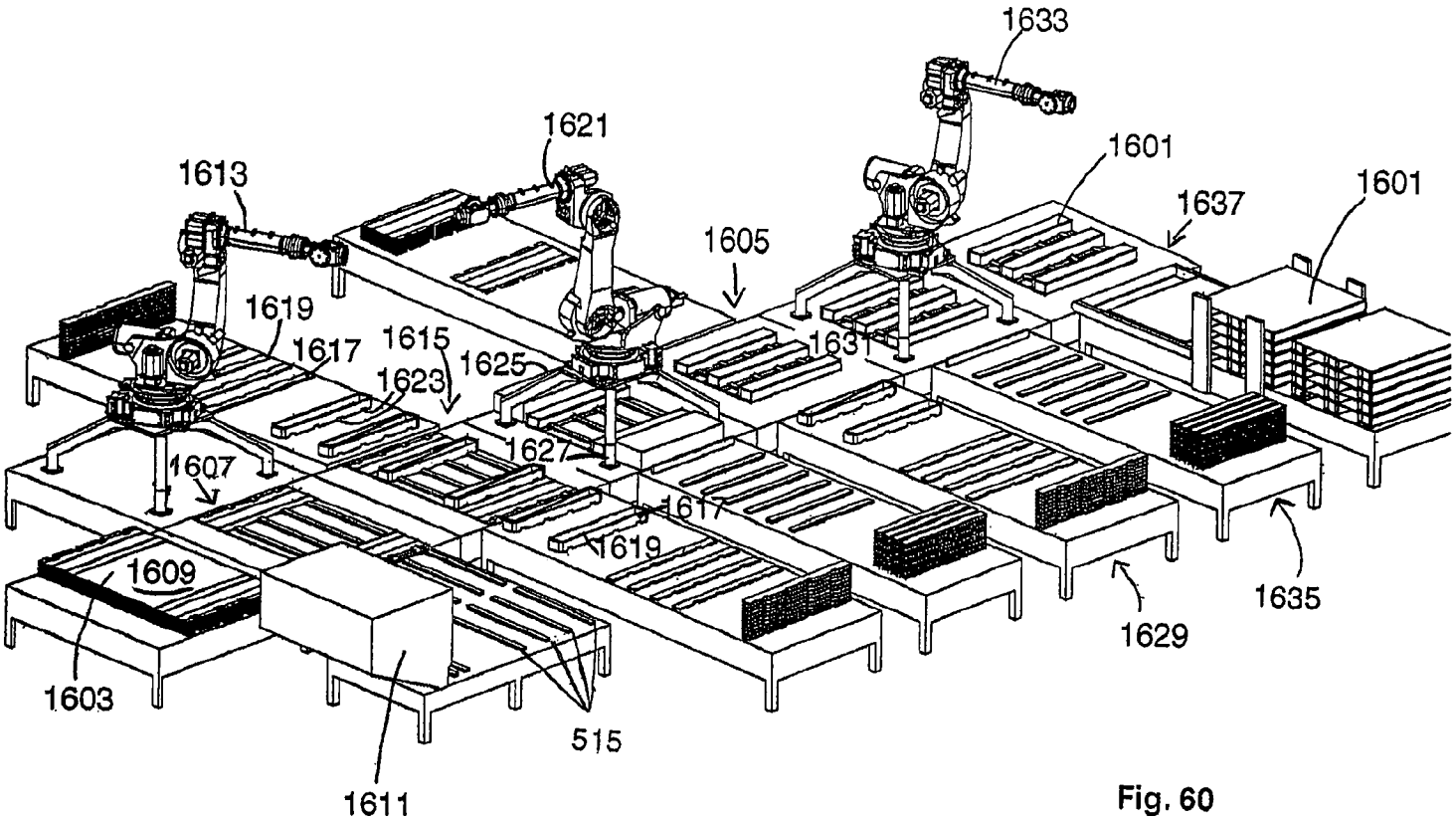
FIG. 60 shows a perspective view of one embodiment of an automated assembly process of a pallet according to the present invention.
Figure 61:
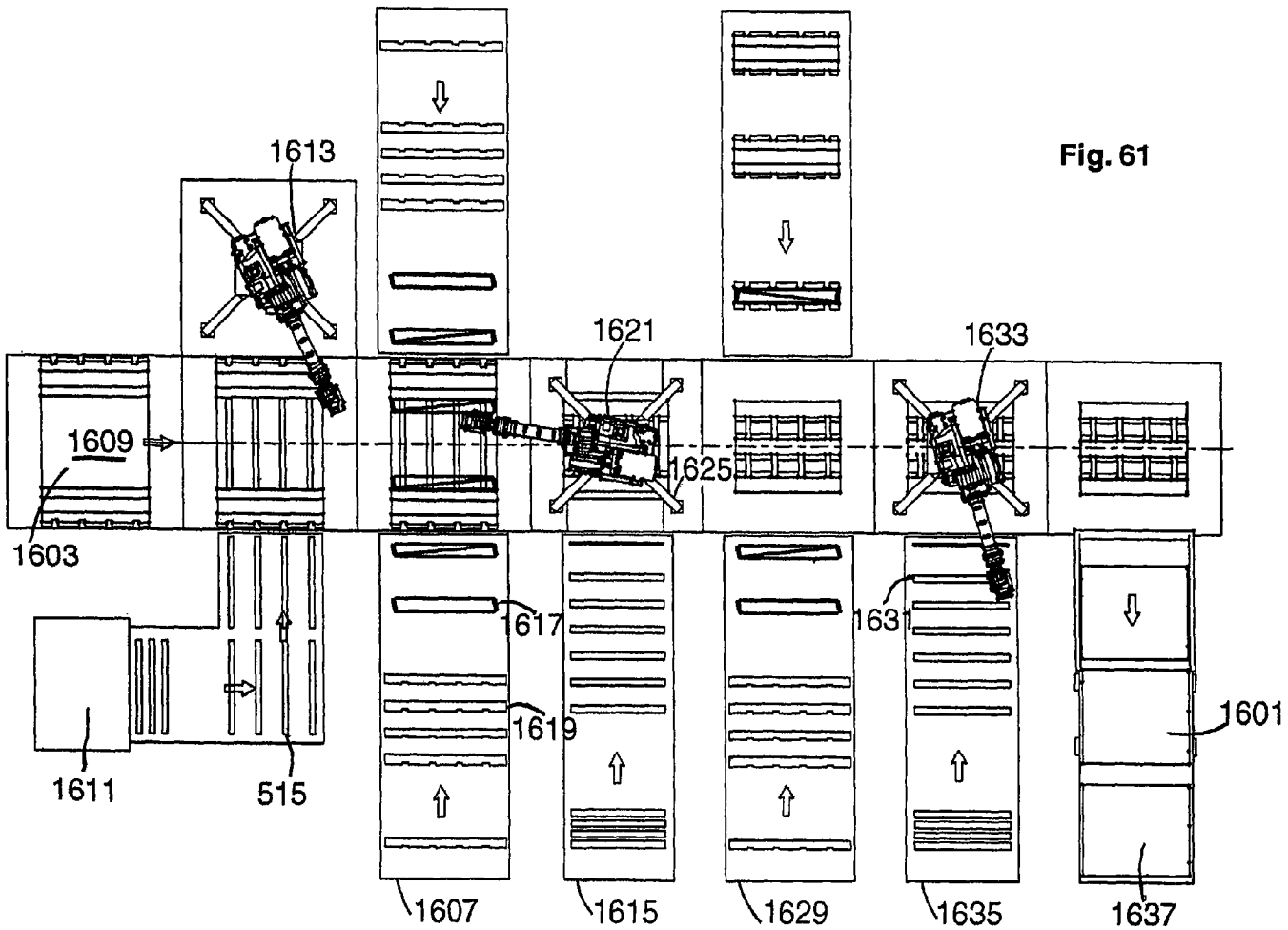
FIG. 61 shows a top view of assembly process of FIG. 56.
Figure 62:
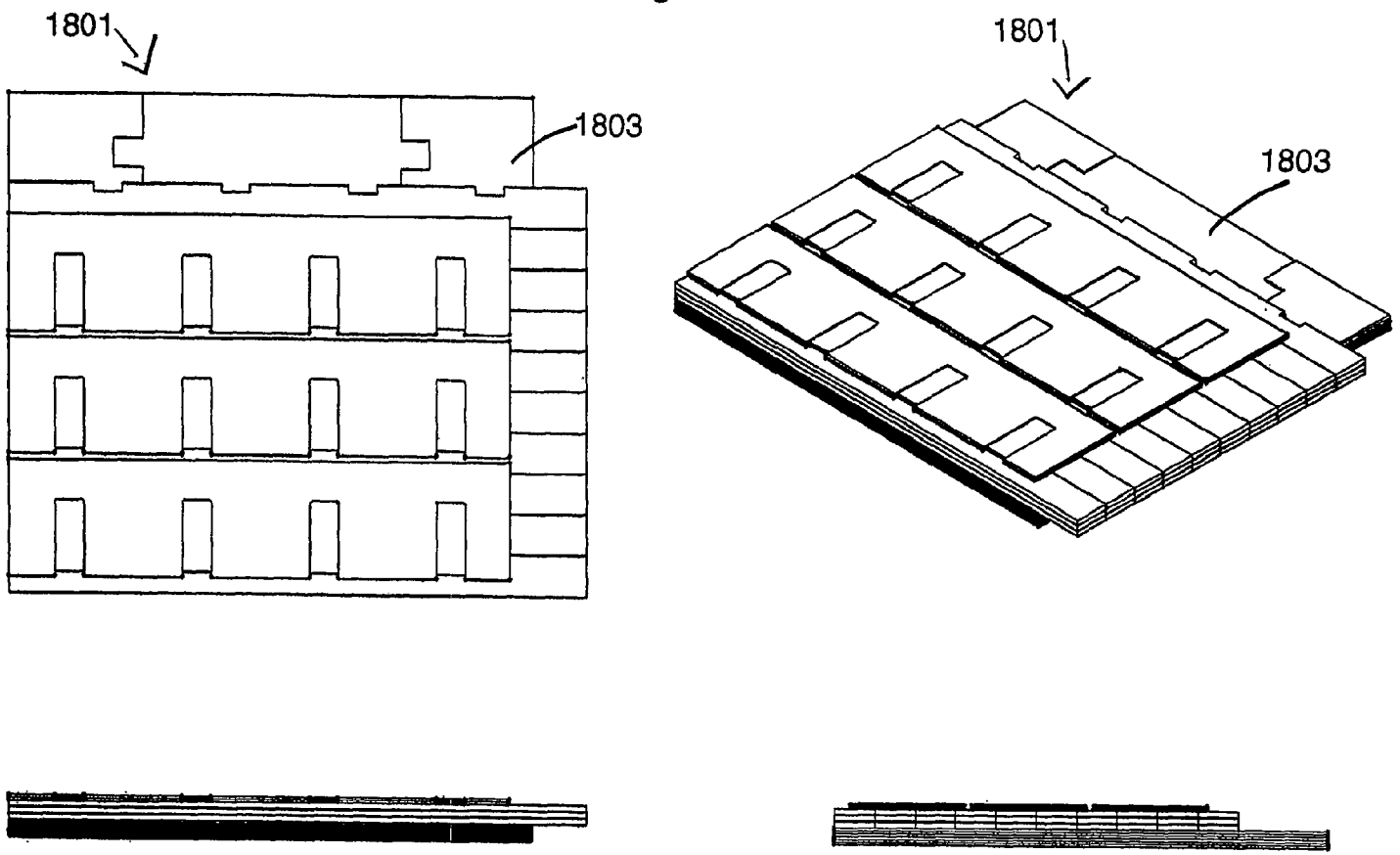
FIG. 62 shows one stacking configuration of an unassembled pallet.
Figure 63:
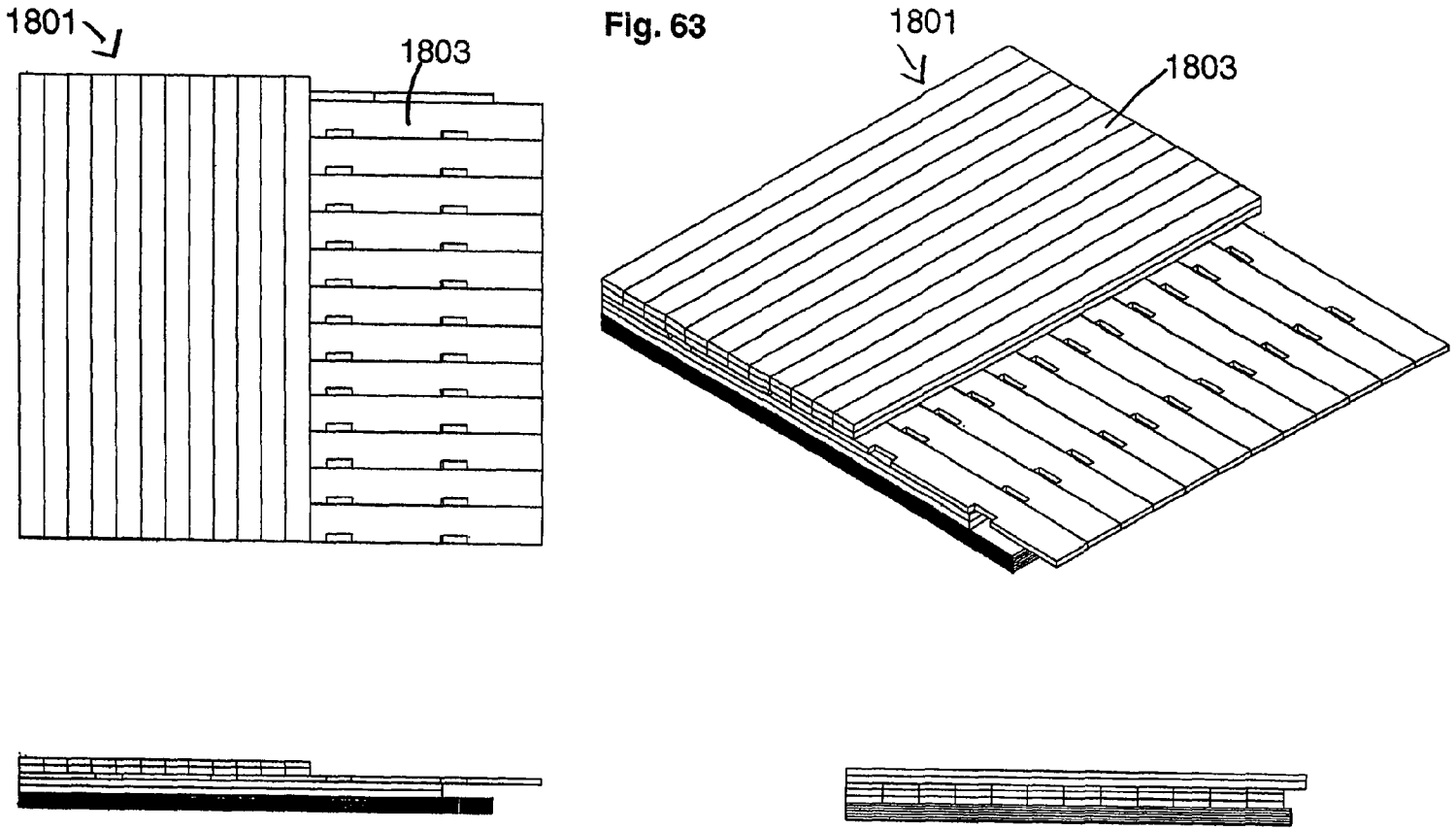
FIG. 63 shows another stacking configuration of an unassembled pallet.
Figure 64:
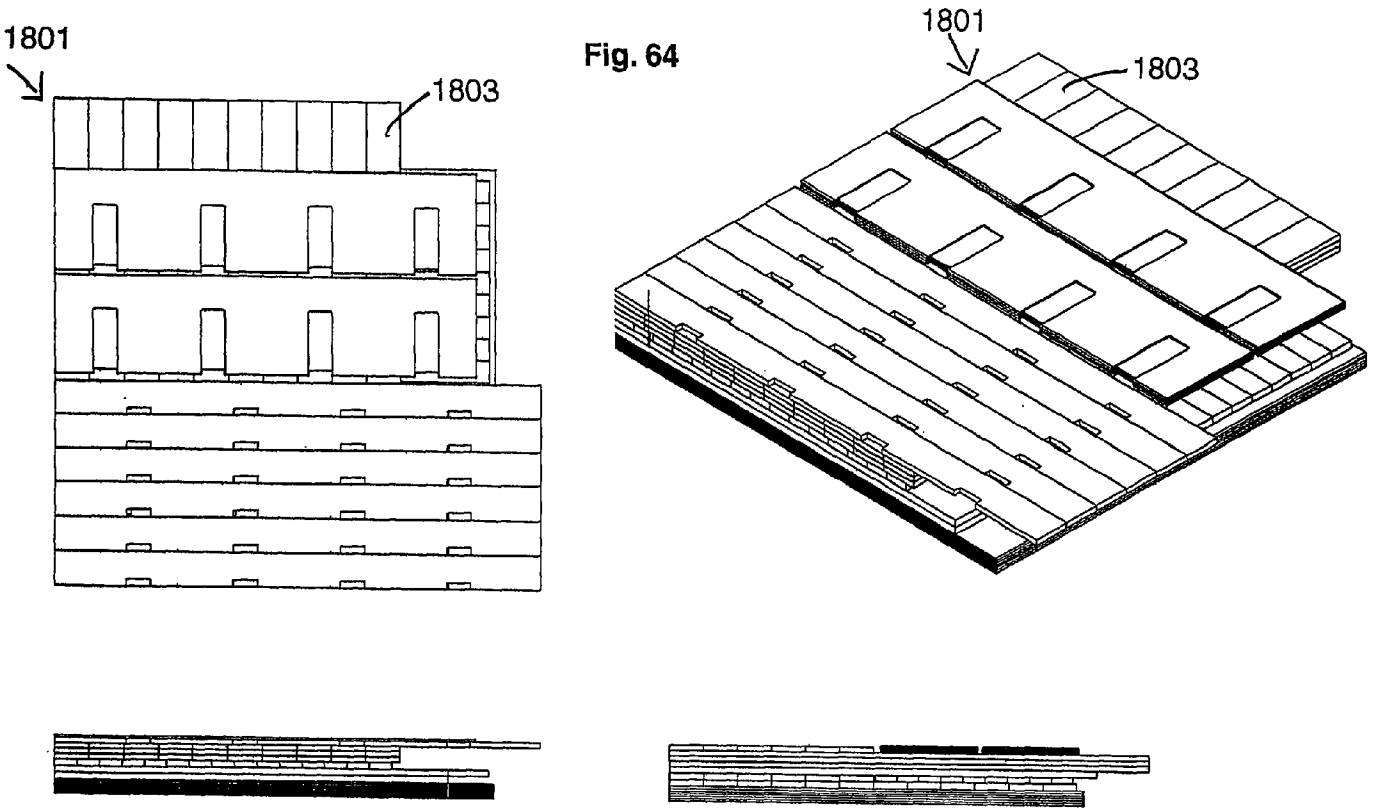
FIG. 64 shows yet another stacking configuration of an unassembled pallet.
Figure 65:
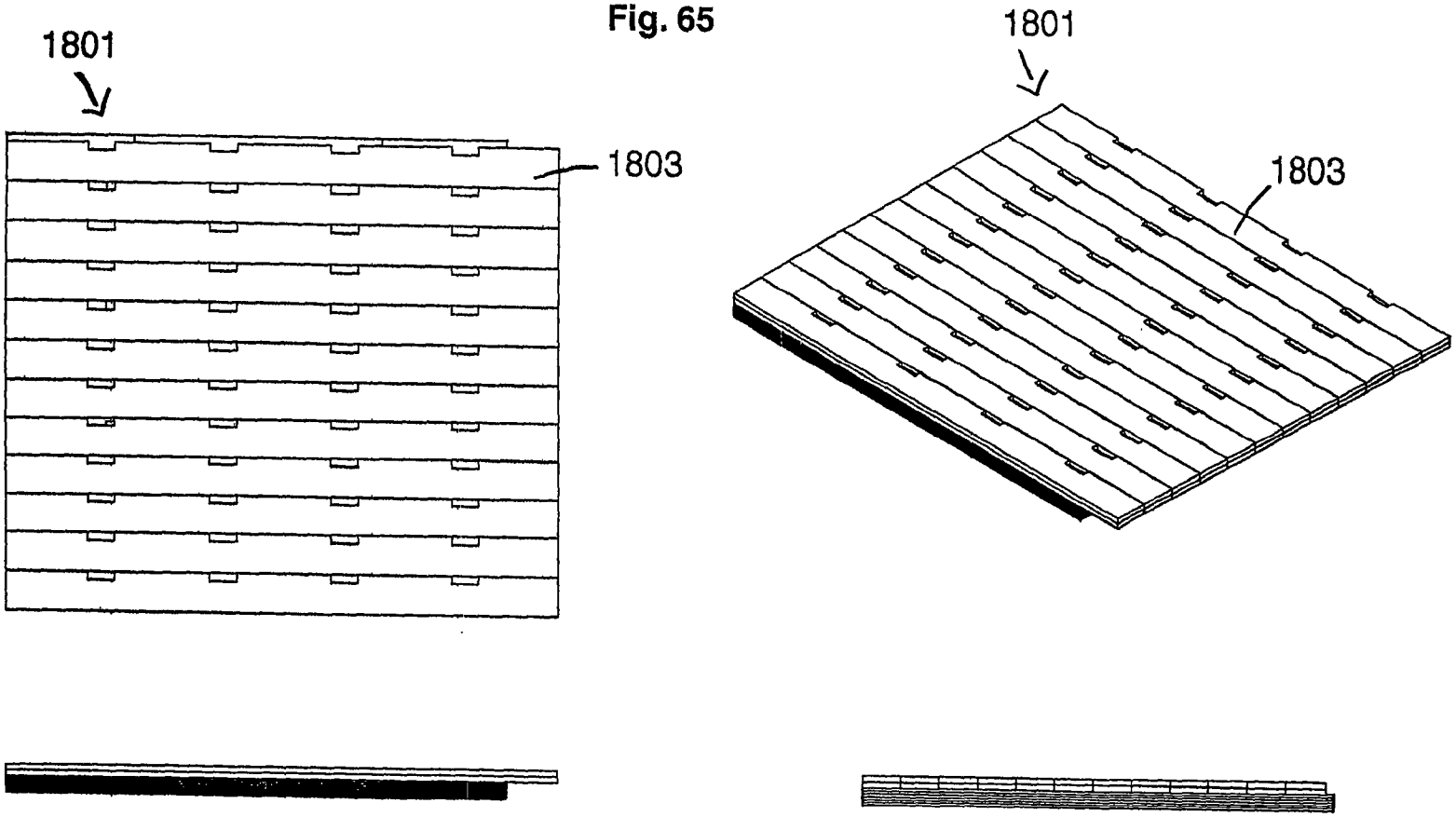
FIG. 65 shows yet another stacking configuration of an unassembled pallet.

FIGS. 60 and 61 illustrate one embodiment of an automated or semi-automated process for machine assembly of a preferred embodiment of the present invention. A pallet 1601 is created by providing a single material sheet or main sheet 1603. The single material sheet 1603 is carried or fed on a conveyer, generally indicated at 1605 to a first station 1607 in which cross-braces 515 are positioned on the underside 1609 of the material sheet 1603. A high volume cross-brace destacker 1611 selects and arranges the cross braces 515 for placement on the underside surface 1609 of the main sheet 1603. The cross braces 515 are positioned on the main sheet 1603 by a first robot or machine arm 1613.

From the first station 1607, main sheets 1603, with cross braces 515 positioned thereon, travel to a second station 1615 wherein inserts 1617 and braces 1619 are assembled and placed over the cross braces 515 on the main sheet 1603. A second robot 1621 positions the inserts 1617 on the underside 1609 of the main sheet 1603. The second robot 1621 then retrieves braces 1619 and places them within the inserts 1617. As described above, the braces 1619 provide additional strength and support to the inserts 1617. The inserts 1617 include slots 1623 to fit over the cross braces 515.

Once the braces 1619 are placed within the inserts 1617, the main sheet 1603 is conveyed to a third station 1625 for folding the main sheet 1603 so as to create beams 1627 surrounding the inserts 1617 (with braces 1619). The main sheet 1603 is then transported to a fourth station 1629 for assembly of a center beam 1631 with an insert 1617 and a brace 1619. A third robot 1633 retrieves a brace 1619 and positions it within insert 1617. The third robot 1633 then places the insert 1617, with brace 1619 positioned therein, within an unassembled center beam 1631. The third robot 1633 folds the beam 1631 to surround and enclose the insert 1617 and brace 1619.

Finally, the third robot 1633 secures the center beam 1631 between the opposing end beams 1627. The fully formed main sheet 1603 is then conveyed to a fifth station 1635 that seals or closes the center beam 1631 such that there are no openings in the center beam, similar to third station 1625 with beams 1627. The third robot 1633 then turns the pallet 1601 over 180 degrees such that the underside 1609 of the pallet is reversed and faces downwardly. The assembled pallet 1601 is conveyed to a sixth or last station 1637 for stacking.

FIGS. 62-65 illustrate various packaging configurations 1801 of the components of an unassembled pallet 1803. The packaging configurations 1801 allow for easy transport of the pallet prior to assembly. The various packaging configurations 1801 provide for controlled step-by-step manual or automated assembly. It can be seen that various configurations 1801 of pallet components are contemplated which contribute to space savings. Unassembled pallets 1803 may be put in water resistant enclosures for outside storage.

While the present inventions and what is considered presently to be the best modes thereof have been described in a manner that establishes possession thereof by the inventors and that enables those of ordinary skill in the art to make and use the inventions, it will be understood and appreciated that there are many equivalents to the exemplary embodiments disclosed herein and that myriad modifications and variations may be made thereto without departing from the scope and spirit of the inventions, which are to be limited not by the exemplary embodiments but by the appended claims.

The invention claimed is:

1. A pallet for receiving product, comprising:

a first pallet including a first component platform including a first platform side and a second platform side, said first platform side being opposite said second platform side, and forming a first beam located along said first platform side on an underside of said first component platform and a second beam located along said second platform side on said underside of said first component platform;

a second component insert in each of respective said first beam and second beam, each said second component insert being constructed and formed of a material capable of withstanding at least weight of the product bearing thereupon, each said second component insert comprising a foldable spacer having one or more slots and a rigid brace, said rigid brace and said underside of said first component platform forming a gap therebetween, wherein the gap is provided substantially along said rigid brace; and a display element including display information positioned on one of said first beam or said second beam of said first pallet, wherein said display element constitutes some or all of said first pallet.

2. A pallet for receiving product of claim 1, further comprising:

a second pallet including a second component platform including a third platform side and a fourth platform side, said third platform side being opposite said fourth platform side;

a third beam located along said third platform side on an underside of said second component platform;

a fourth beam located along said fourth platform side on said underside of said second component platform, wherein said fourth beam includes one or more female receptacles sized and shaped to receive one or more male protrusions of said second beam to form a combined pallet system from said first pallet and said second pallet;

said second component insert in each of respective said first beam, said second beam, said third beam and said fourth beam, each said second component insert being constructed and formed of a material capable of withstanding at least weight of the product bearing thereupon.

3. A pallet for receiving product of claim 2, further comprising a display element including display information positioned on said second pallet and wherein said display element constitutes some or all of said second pallet.

4. A pallet for receiving product of claim 1, wherein each of said first beam and said second beam includes a plurality of cross-brace beam openings formed therethrough.

5. A pallet for receiving product of claim 4, further comprising a plurality of cross-braces; said plurality of cross-braces being positioned in said cross-brace beam openings to extend from said first platform side to said second platform side and adjacent said underside of said first component platform to support said first component platform.

6. A pallet for receiving product, comprising:

a first pallet including a first component platform including a first platform side and a second platform side, said first platform side being opposite said second platform side, wherein said first component platform forms a first beam located along said first platform side on an underside of said first component platform, a second beam located along said second platform side on said underside of said first component platform, and a third beam positioned between said first beam and said second beam;

a second component insert in each of said first beam, second beam and third beam, each said second component insert being constructed and formed of a material capable of withstanding at least weight of the product bearing thereupon, each said second component insert comprising a foldable spacer having one or more slots and a rigid brace, said rigid brace and said underside of said first component platform forming a gap therebetween, wherein the gap is provided substantially along said rigid brace; and a display element including display information positioned on one of said first beam or said second beam of said first pallet, wherein said display element constitutes some or all of said first pallet.

7. A pallet for receiving product of claim 6, further comprising:

a second pallet including a second component platform including a third platform side and a fourth platform side, said third platform side being opposite said fourth platform side;

a fourth beam located along said third platform side on an underside of said second component platform;

a fifth beam located along said fourth platform side on said underside of said second component platform, wherein said fifth beam includes one or more female receptacles sized and shaped to receive one or more male protrusions of said second beam to form a combined pallet system from said first pallet and said second pallet;

said second component insert in each of respective said first beam, said second beam, said fourth beam and said fifth beam, each said second component insert being constructed and formed of a material capable of withstanding at least weight of the product bearing thereupon.

8. A pallet for receiving product of claim 7, further comprising a display element including display information positioned on said second pallet and wherein said display element constitutes some or all of said second pallet.

9. A pallet for receiving product of claim 6, wherein each of said first beam, said second beam and said third beam includes a plurality of cross-brace beam openings formed therethrough.

10. A pallet for receiving product of claim 9, further comprising a plurality of cross-braces; said plurality of cross-braces being positioned in said cross-brace beam openings to extend from said first platform side to said second platform side and adjacent said underside of said first component platform to support said first component platform.

11. A lightweight, foldable cost-saving pallet system for shipping product, comprising:

a pallet including a first component single sheet of foldable material including a central platform including a first platform side and a second platform side, said first platform side being opposite said second platform side, wherein said first component single sheet forms a first beam and a second beam;

said first beam located along said first platform side on an underside of said central platform, said first beam shaped to expand from a first configuration to a second configuration, wherein said first configuration is rhomboid in cross section and said second configuration is in the form of a hollow rectangle in cross section;

said second beam located along said second platform side on said underside of said central platform, wherein said second beam has the same shape as said first beam;

a second component insert sized and shaped to fit within each of said first beam and said second beam when said first beam and said second beam are in said second configuration, each said second component insert being constructed and formed of a material capable of withstanding at least weight of the product bearing thereupon, each said second component insert comprising a foldable spacer having one or more slots and a rigid brace, said rigid brace and said underside of said first component platform forming a gap therebetween, wherein the gap is provided substantially along said rigid brace; and a display element including display information positioned on one of said first beam or said second beam of said pallet and wherein said display element constitutes some or all of said pallet.

* * * * *